US007156391B2

(12) United States Patent
Okamoto et al.

(10) Patent No.: US 7,156,391 B2
(45) Date of Patent: Jan. 2, 2007

(54) DRIVING APPARATUS, SHEET PROCESSING APPARATUS HAVING DRIVING APPARATUS, IMAGE FORMING APPARATUS HAVING SHEET PROCESSING APPARATUS AND CONTROL SYSTEM

(75) Inventors: Kiyoshi Okamoto, Ibaraki (JP); Yuji Yamanaka, Ibaraki (JP); Kiyoshi Watanabe, Chiba (JP); Yuichi Yamamoto, Ibaraki (JP); Yoshiyuki Nakajima, Ibaraki (JP); Hiroyuki Sekine, Aichi (JP)

(73) Assignee: Canon Kabushiki Kaisha, Tokyo (JP)

( * ) Notice: Subject to any disclaimer, the term of this patent is extended or adjusted under 35 U.S.C. 154(b) by 201 days.

(21) Appl. No.: 10/438,073

(22) Filed: May 15, 2003

(65) Prior Publication Data

US 2003/0235450 A1 Dec. 25, 2003

(30) Foreign Application Priority Data

May 15, 2002 (JP) ..... 2002-140266
May 29, 2002 (JP) ..... 2002-155625

(51) Int. Cl.
*B65H 7/02* (2006.01)

(52) U.S. Cl. ..... 271/258.01; 271/265.01; 271/270

(58) Field of Classification Search ..... 271/121, 271/162, 171, 256, 258.01, 259, 265.01, 271/265.02, 270, 202
See application file for complete search history.

(56) References Cited

U.S. PATENT DOCUMENTS

| | | | | |
|---|---|---|---|---|
| 4,460,852 | A * | 7/1984 | Kondo et al. | 318/67 |
| 4,763,889 | A * | 8/1988 | Dei et al. | 271/9.03 |
| 4,882,778 | A * | 11/1989 | Hosaka et al. | 700/82 |
| 5,316,289 | A * | 5/1994 | Matsuo | 271/258.03 |
| 5,412,295 | A * | 5/1995 | Maruyama et al. | 318/434 |
| 5,689,756 | A * | 11/1997 | Taki et al. | 399/33 |
| 5,796,221 | A * | 8/1998 | Cramer et al. | 318/68 |
| 5,924,686 | A * | 7/1999 | Jacobson et al. | 271/3.17 |
| 5,991,556 | A * | 11/1999 | Yamashita | 399/23 |
| 6,112,156 | A * | 8/2000 | Kang | 702/58 |
| 6,339,685 | B1 | 1/2002 | Okamoto et al. | 399/16 |

FOREIGN PATENT DOCUMENTS

| | | |
|---|---|---|
| JP | 05-162892 | * 6/1993 |
| JP | 7-264893 | 10/1995 |
| JP | 9-190916 | 7/1997 |

* cited by examiner

*Primary Examiner*—Patrick Mackey
*Assistant Examiner*—Thomas Morrison
(74) *Attorney, Agent, or Firm*—Fitzpatrick, Cella, Harper & Scinto

(57) ABSTRACT

A driving apparatus includes a plurality of driving devices, a plurality of detectors for detecting a malfunction of the driving devices, and a controller, which is responsive to a detection result of the detectors, for decreasing a driving speed of a driving device at which a malfunction is detected and increases a driving speed of another driving device.

8 Claims, 47 Drawing Sheets

| INFLUENCES | RANK |
|---|---|
| FEEDING PERFORMANCE FOR EACH SHEET, BASIC OPERATION | A |
| PROCESSING PERFORMANCE FOR EACH SHEET | B |
| PROCESSING PERFORMANCE FOR EACH SET | C |
| NO | D |

| DRIVING DEVICES | INFLUENTIAL RANGE | RANK | MEASUREMENTS |
|---|---|---|---|
| INLET MTR | FEEDING PERFORMANCE FOR EACH SHT | A | CURRENT UP/DWN SPEED UP/DWN |
| BUFFER MTR | FEEDING PERFORMANCE FOR EACH SHT | A | CURRENT UP/DWN SPEED UP/DWN |
| SHEET DISCHARGE MTR | FEEDING PERFORMANCE FOR EACH SHT | A | CURRENT UP/DWN SPEED UP/DWN |
| ALIGNMENT MTR (SHEET) | FEEDING PERFORMANCE FOR EACH SHT | B | CURRENT UP/DWN SPEED UP/DWN |
| KNURLED SOL | FEEDING PERFORMANCE FOR EACH SHT | B | CURRENT UP/DWN SPEED UP/DWN |
| SWINGING MTR | FEEDING PERFORMANCE FOR EACH SET | C | CURRENT UP/DWN SPEED UP/DWN |
| SET DISCHARGE | FEEDING PERFORMANCE FOR EACH SET | C | CURRENT UP/DWN SPEED UP/DWN |
| ALIGNMENT MTR (SET) | FEEDING PERFORMANCE FOR EACH SHT | C | CURRENT UP/DWN SPEED UP/DWN |
| STAPLE SLIDING MTR | FEEDING PERFORMANCE FOR EACH SET | C | CURRENT UP/DWN SPEED UP/DWN |
| STACK TRAY MTR | NO | D | CURRENT UP/DWN SPEED UP/DWN |

FIG. 11

| DRIVING DEVICES | REF CURRENT | MAX CURRENT | STNDRD SPEED | MAX SPEED | MIN SPEED |
|---|---|---|---|---|---|
| INLET MTR | 35 | 50 | 2500 | - | 1000 |
| BUFFER MTR | 40 | 50 | 2500 | - | 1000 |
| SHEET DISCHARGE MTR | 35 | 50 | 2500 | - | 1000 |
| ALIGNMENT MTR (SHEET) | 40 | 60 | 700 | 700 | 200 |
| KNURLED SOL | 35 | 50 | - | - | - |
| SWINGING MTR | 40 | 60 | 550 | 600 | 300 |
| SET DISCHARGE MTR | 40 | 60 | 350 | 400 | 150 |
| ALIGNMENT MTR (SET) | 40 | 60 | 700 | 700 | 200 |
| STAPLE SLIDING MTR | 35 | 50 | 450 | 550 | 100 |
| STACK TRAY MTR | 25 | 50 | 450 | - | 150 |

FIG. 12

| DRIVING DEVICES | STNDRD CURRENT | STNDRD SPEED |
|---|---|---|
| INLET MTR | 25 | 1500 |
| BUFFER MTR | 25 | 1500 |
| SHEET DISCHARGE MTR | 25 | 1500 |
| ALIGNMENT MTR (SHEET) | 20 | 300 |
| KNURLED SOL | 30 | - |
| SWINGING MTR | 20 | 400 |
| SET DISCHARGE MTR | 20 | 200 |
| ALIGNMENT MTR (SET) | 20 | 300 |
| STAPLE SLIDING MTR | 25 | 300 |
| STACK TRAY MTR | 25 | 450 |

FIG. 13

| FIG. 22A | FIG. 22B | FIG. 22C |
|---|---|---|

LEGEND ( X : COM. CNTRLR
MFP : IMAGE FORMING APD. )

PROTOCOL

- E-MAIL
- PUBLICK CKT (MODEM)
- TCP/IP

| DATA | SEND TO | |
|---|---|---|
| DATA | DEVICE MANAGER | HOST |
| ERROR | X | X |
| JAM | X | X |
| ALARM | X | X |
| DEGENERATION INFORMATION | X | X |
| COUNT | X | X |
| PARTS COUNTER | X | X |
| COUNTER FOR RESP. MODE | X | X |
| CONSUMABLES LOW/OUT | - | NO |
| CONSUMABLES NOT IN STOCK | - | NO |

FIG. 31

DRIVING APPARATUS, SHEET PROCESSING APPARATUS HAVING DRIVING APPARATUS, IMAGE FORMING APPARATUS HAVING SHEET PROCESSING APPARATUS AND CONTROL SYSTEM

BACKGROUND OF THE INVENTION

1. Field of the Invention

The present invention relates to a sheet processing apparatus for sorting the sheets discharged from an image forming apparatus or the like, binding the sorted sheets, and stacking the bound stacks of sheets; in other words, the present invention relates to a sheet processing apparatus for processing sheets after the formation of an image thereon.

2. Related Art

There have long been known sheet processing apparatuses which sort the sheets discharged from an image forming apparatus after the formation of an image thereon, bind the sorted sheets, and stack the bound stacks of sheets.

These sheet processing apparatuses are structured so that they can be connected to a plurality of image forming apparatuses different in performance.

Generally, a sheet processing apparatus is combined with an image forming apparatus to create a printing system, or is combined with two or more image forming apparatuses different in function or performance, creating printing systems different in function and performance. Thus, normally, the specifications of the motors and motor drivers of a sheet processing apparatus, and the values of the electric currents for driving the motors, are set in accordance with the specifications of the image forming apparatuses which are currently fastest in processing speed, or are set in anticipation of the possibility that it may be connected in the future, to image forming apparatuses which are much faster than the currently fastest image forming apparatuses. Therefore, in the case of a printing system created by connecting a sheet processing apparatus to an image forming apparatus inferior in processing capacity to the sheet processing apparatus, the processing speed of the sheet processing apparatus is faster than that of the image forming apparatus. In such a case, it does not occur that the sheet processing apparatus operates at its capacity. Thus, in such a case, in order to prevent the sheet processing from operating at an unnecessarily high performance level, to conserve energy, and to reduce noise, the amount of the electric current for driving the sheet processing apparatus, the revolutions of the motors of the sheet processing apparatus, etc., are reduced so that the performance of the sheet processing apparatus matches that of the image forming apparatus.

Japanese Patent Application Laid-open No. 7-264893, which relates to an image forming apparatus, a sheet processing apparatus connected thereto, and the stepping motors employed by the sheet processing apparatus, discloses a method for increasing the torque of the stepping motors by increasing the amount of the electric current supplied thereto, in response to the changes in load. Further, Japanese Patent Application Laid-open No. 9-190916, which relates to a solenoid, discloses another method for increasing the torque of a motor by increasing the amount of the electric current supplied thereto, in response to load.

However, the aforementioned methods suffer from the problem that as the amounts of the electric currents supplied to various driving systems are independently increased in response to their loads, the total electric power required by the printing system unexpectedly increases.

Further, in the case of a design in which the amount of electric current is increased in response to the loads measured by load measuring apparatuses, when the amount of the electric current required at a given moment by the printing system is greater than the sum of the maximum capacities of the driving systems of the printing system, the amount of the electric current cannot be increased to a target value, and therefore, the system is forced to operate at a reduced performance level, which is also problematic.

The present invention was made in consideration of the above described problems, and its primary object is to provide a driving apparatus for a sheet processing apparatus, systemized so that if an abnormality is detected in any of the driving systems of the driving apparatus, and the amount of the electric current being supplied to the driving system in which the abnormality was detected is at the maximum electric current limit thereof, the speed of the driving system in which the abnormality was detected is reduced, and one or more driving systems, other than the driving system in which the abnormality was detected, are increased in speed in the order of priority to compensate for the effect of the speed reduction of the driving system in which the abnormality was detected, so that even if an abnormality is detected in any of the driving systems, the driving apparatus is prevented from simply shutting down, and also so that the overall performance of the sheet processing apparatus is prevented from declining; so that abnormality detection is prohibited during sheet conveyance, making it possible for an abnormality of a driving means traceable to a sheet jam to be differentiated from an abnormality of a driving system itself by simple control; and so that it can be known by a remote control operator or a service person that the driving apparatus is operating in the mode in which the driving apparatus is prevented from shutting down, making it unnecessary to call for a service person when it is possible for the driving apparatus to automatically recover, reducing thereby the maintenance cost of the driving apparatus. Another object of the present invention is to provide a sheet processing apparatus having the above described driving apparatus, an image forming apparatus connectible to the sheet processing apparatus, and a system for controlling the apparatuses.

SUMMARY OF THE INVENTION

According to the aspects of the present invention, there are provided:

(1) A sheet conveying apparatus comprising:

a plurality of driving portions;

a detecting portion for detecting an abnormality in said driving portions;

a controller for reducing the driving speed of the driving portion in which an abnormality was detected, in accordance with the results of the abnormality detection by said detecting portion, and increasing the driving speed of a driving portion other than the driving portion in which the abnormality was detected.

(2) A sheet conveying apparatus comprising:

a plurality of driving portions;

a detecting portion for detecting an abnormality in said driving portions;

a controller for increasing the amount of the electric current for driving the driving portion in which an abnormality was detected, in accordance with the results of the abnormality detection by said detecting portion, and decreasing the amount of the electric current for driving a driving portion other than the driving portion in which the abnormality was detected.

(3) A driving apparatus comprising: a plurality of driving means; a plurality of operational, abnormality detecting means corresponding to the plurality of driving means, one for one; a plurality of electric current amount setting means for setting the amounts of the electric currents supplied to the plurality of driving means, one for one; a controlling means for controlling the plurality of driving means, the plurality of operational abnormality detecting means, and the plurality of electric current amount setting means, wherein, the controlling means has the functions of setting the normal electric current value for each driving means, the maximum electric current value for each driving means, the normal speed value for each driving means, the minimum speed value for each driving means, at which each driving means is rotatable, the maximum speed value for each driving means, and the value of the sum of the electric currents supplied to the plurality of driving means, categorizes the plurality of the driving means in terms of function, and ranks the driving means in each functional group, in the order of priority in terms of the their effect upon the overall performance of the printing system;

(a) if an operational abnormality is detected in any of the plurality of driving means by the operational abnormality detecting means, the controlling means increases the amount of the electric current supplied to the driving means in which the abnormality was detected, to a value which is not more than the maximum electrical current limit for the driving means in which the abnormality was detected, and which does not cause the total amount of the electric current supplied to the driving apparatus, to exceed the maximum electric current limit for the driving apparatus;

(b) if an operational abnormality is detected in any of the plurality of driving means, by the operational abnormality detecting means, and increasing the amount of the electric current supplied to the driving means in which the abnormality was detected, causes the amount of the electric current supplied to the driving means in which the abnormality was detected, to exceed the maximum electric current limit therefor, the controlling means reduces the speed of the driving means in which the abnormality was detected, to a value no less than the minimum speed limit at which the driving system in which the abnormality was detected, is rotatable, increases the speeds of any of the driving means, other than the driving means in which the abnormality was detected, chosen in the order of the above described priority, to a value no more than the maximum speed limit thereof, and increases the amount of the electric current supplied thereto, in proportion to the new speed set therefor, in order to prevent the productivity of the system from declining.

(4) A sheet processing apparatus having the driving apparatus in the preceding paragraphs (3), further comprises; a conveying means for receiving, and conveying further, the sheets outputted by an image forming apparatus; an aligning means for aligning the sheets outputted from the image forming apparatus; a stapler for stapling the set of aligned sheets; a moving means for moving the stapler to a predetermined location; a sheet stack discharging means for discharging the stack of aligned sheets; a vertically movable stacking means for stacking the stacks of the aligned sheets.

(5) An image forming apparatus having the sheet processing apparatus described in the preceding paragraph (4).

(6) A control system for controlling an image forming apparatus having a sheet processing apparatus comprising: a step of receiving, and conveying further, the sheets outputted by the image forming apparatus; a step of aligning the sheets outputted from the image forming apparatus; a step of stapling the set of aligned sheets; a step of moving the stapler to a predetermined location; a step of discharging the stack of aligned sheets; a step of stacking the stacks of the aligned sheets, further comprising:

a plurality of driving means; a plurality of operational abnormality detecting means corresponding to the plurality of driving means, one for one; a plurality of electric current amount setting means for setting the amounts of the electric currents supplied to the plurality of driving means, one for one; a controlling means for controlling the plurality of driving means, the plurality of operational abnormality detecting means, and the plurality of electric current amount setting means, wherein, the controlling means has the functions of setting the normal electric current value for each driving means, the maximum electric current value for each driving means, the normal speed value for each driving means, the minimum speed value for each driving means, at which each driving means is rotatable, the maximum speed value for each driving means, and the value of the sum of the electric currents supplied to the plurality of driving means, categorizes the plurality of the driving means in terms of function, and ranks the driving means in each functional group, in the order of priority in terms of the their effect upon the overall performance of the printing system;

(a) if an operational abnormality is detected in any of the plurality of driving means by the operational abnormality detecting means, the controlling means increases the amount of the electric current supplied to the driving means in which the abnormality was detected, to a value which is not mote than the maximum electrical current limit for the driving means in which the abnormality was detected, and which does not cause the total amount of the electric current supplied to the driving apparatus, to exceed the maximum electric current limit for the driving apparatus;

(b) if an operational abnormality is detected in any of the plurality of driving means, by the operational abnormality detecting means, and increasing the amount of the electric current supplied to the driving means in which the abnormality was detected, causes the amount of the electric current supplied to the driving means in which the abnormality was detected, to exceed the maximum electric current limit therefor, the controlling means reduces the speed of the driving means in which the abnormality was detected, to a value no less than the minimum speed limit at which the driving system in which the abnormality was detected, is rotatable, increases the speeds of any of the driving means, other than the driving means in which the abnormality was detected, chosen in the order of the above described priority, to a value no more than the maximum speed limit thereof, and increases the amount of the electric current supplied thereto, in proportion to the new speed set therefor, in order to prevent the productivity of the system from declining.

(7) An image forming apparatus having a sheet processing apparatus comprising:

a conveying means for receiving, and conveying further, the sheets outputted by an image forming apparatus; an aligning means for aligning the sheets outputted from the image forming apparatus; a stapler for stapling the set of aligned sheets; a moving means for moving the stapler to a predetermined location; a sheet stack discharging means for discharging the stack of aligned sheets; a vertically movable stacking means for stacking the stacks of the aligned sheets, further comprising:

a plurality of driving means; a plurality of operational abnormality detecting means corresponding to the plurality of driving means, one for one; a plurality of electric current amount setting means for setting the amounts of the electric currents supplied to the plurality of driving means, one for one; a controlling means for controlling the plurality of driving means, the plurality of operational abnormality detecting means, and the plurality of electric current amount setting means, wherein the controlling means has the functions of setting the normal electric current value for each driving means, the maximum electric current value for each driving means, the normal speed value for each driving means, the minimum speed value for each driving means, at which each driving means is rotatable, the maximum speed value for each driving means, and the value of the sum of the electric currents supplied to the plurality of driving means, categorizes the plurality of the driving means in terms of function, and ranks the driving means in each functional group, in the order of priority in terms of the their effect upon the overall performance of the printing system;

(a) if an operational abnormality is detected in any of the plurality of driving means by the operational abnormality detecting means, the controlling means increases the amount of the electric current supplied to the driving means in which the abnormality was detected, to a value which is no more than the maximum electrical current limit for the driving means in which the abnormality was detected, and which does not cause the total amount of the electric current supplied to the driving apparatus, to exceed the maximum electric current limit for the driving apparatus;

(b) if an operational abnormality is detected in any of the plurality of driving means, by the operational abnormality detecting means, and increasing the amount of the electric current supplied to the driving means in which the abnormality was detected, causes the amount of the electric current supplied to the driving means in which the abnormality was detected, to exceed the maximum electric current limit therefor, the controlling means reduces the speed of the driving means in which the abnormality was detected, to a value no less than the minimum speed limit, at which the driving system in which the abnormality was detected, is rotatable, increases the speeds of any of the driving means, other than the driving means in which the abnormality was detected, chosen in the order of the above described priority, to a value no more than the maximum speed limit thereof, increases the amount of the electric current supplied thereto, in proportion to the new speed set therefor, in order to prevent the productivity of the system from declining; and prohibits the abnormality detection by the driving means involved in sheet conveyance, during sheet conveyance.

(8) A control system for controlling an image forming apparatus having a sheet processing apparatus, comprising: a step of receiving, and conveying further, the sheets outputted by the image forming apparatus; a step of aligning the sheets outputted from the image forming apparatus; a step of stapling the set of aligned sheets; a Step of moving the stapler to a predetermined location; a step of discharging the stack of aligned sheets; a step of stacking the stacks of the aligned sheets, further comprising:

a plurality of driving means; a plurality of operational abnormality detecting means corresponding to the plurality of driving means, one for one; a plurality of electric current amount setting means for setting the amounts of the electric currents supplied to the plurality of driving means, one for one; a controlling means for controlling the plurality of driving means, the plurality of operational abnormality detecting means, and the plurality of electric current amount setting means, wherein the controlling means has the functions of setting the normal electric current value for each driving means, the maximum electric current value for each driving means, the normal speed value for each driving means, the minimum speed value for each driving means, at which each driving means is rotatable, the maximum speed value for each driving means, and the value of the sum of the electric currents supplied to the plurality of driving means, categorizes the plurality of the driving means in terms of function, and ranks the driving means in each functional group, in the order of priority in terms of the their effect upon the overall performance of the printing system;

(a) if an operational abnormality is detected in any of the plurality of driving means by the operational abnormality detecting means, the controlling means increases the amount of the electric current supplied to the driving means in which the abnormality was detected, to a value which is no more than the maximum electrical current limit for the driving means in which the abnormality was detected, and which does not cause the total amount of the electric current supplied to the driving apparatus, to exceed the maximum electric current limit for the driving apparatus;

(b) if an operational abnormality is detected in any of the plurality of driving means, by the operational abnormality detecting means, and increasing the amount of the electric current supplied to the driving means in which the abnormality was detected, causes the amount of the electric current supplied to the driving means in which the abnormality was detected, to exceed the maximum electric current limit therefor, the controlling means reduces the speed of the driving means in which the abnormality was detected, to a value no less than the minimum speed limit at which the driving system in which the abnormality was detected, is rotatable, increases the speeds of any of the driving means, other than the driving means in which the abnormality was detected, chosen in the order of the above described priority, to a value no more than the maximum speed limit thereof, increases the amount of the electric current supplied thereto, in proportion to the new speed set therefor, in order to prevent the productivity of the system from declining; and prohibits the abnormality detection by the driving means involved in sheet conveyance, during sheet conveyance.

(9) An image forming apparatus having a sheet processing apparatus, controllable through a remote control system comprising: a network to which a plurality of image forming apparatuses are connectible; a minimum of one device management apparatus for collecting data from the group of the plurality of image forming apparatuses; and a host apparatus capable of collecting the data accumulated in the device management apparatus, through the network, wherein the sheet processing apparatus comprises:

a driving portion; a plurality of operational abnormality detecting means corresponding to the plurality of driving means, one for one; a plurality of electric current amount setting means for setting the amounts of the electric currents supplied to the plurality of driving means, one for one; a controlling means for controlling the plurality of driving means, the plurality of operational abnormality detecting means, and the plurality of electric current amount setting means;

the driving portion comprises:

a plurality of driving means; a plurality of operational abnormality detecting means corresponding to the plurality of driving means, one for one; a plurality of electric current amount setting means for setting the amounts of the electric currents supplied to the plurality of driving means, one for one; a controlling means for controlling the plurality of driving means, the plurality of operational abnormality detecting means, and the plurality of electric current amount setting means;

the controlling means has the functions of setting the normal electric current value for each driving means, the maximum electric current value for each driving means, the normal speed value for each driving means, the minimum speed value for each driving means, at which each driving means is rotatable, the maximum speed value for each driving means, and the value of the sum of the electric currents supplied to the plurality of driving means, categorizes the plurality of the driving means in terms of function, and ranks the driving means in each functional group, in the order of priority in terms of the their effect upon the overall performance of the printing system;

(a) if an operational abnormality is detected in any of the plurality of driving means by the operational abnormality detecting means, the controlling means increases the amount of the electric current supplied to the driving means in which the abnormality was detected, to a value which is no more than the maximum electrical current limit for the driving means in which the abnormality was detected, and which does not cause the total amount of the electric current supplied to the driving apparatus, to exceed the maximum electric current limit for the driving apparatus;

(b) if an operational abnormality is detected in any of the plurality of driving means, by the operational abnormality detecting means, and increasing the amount of the electric current supplied to the driving means in which the abnormality was detected, causes the amount of the electric current supplied to the driving means in which the abnormality was detected, to exceed the maximum electric current limit therefor, the controlling means reduces the speed of the driving means in which the abnormality was detected, to a value no less than the minimum speed limit at which the driving system in which the abnormality was detected, is rotatable, increases the speeds of any of the driving means, other than the driving means in which the abnormality was detected, chosen in the order of the above described priority, to a value no more than the maximum speed limit thereof, increases the amount of the electric current supplied thereto, in proportion to the new speed set therefor; and wherein the controlling means further comprises a means for detecting whether or not the sheet processing means is in the reduced performance mode, and sending to the device management apparatus the information that the sheet processing apparatus is in the reduced performance mode.

(10) An image forming apparatus having a sheet processing apparatus described in the preceding cause (9), wherein the device management apparatus comprises: a reduced performance mode information collecting and retaining means for collecting and retaining the information regarding the reduced performance of the image forming apparatus; a data transmitting means for transmitting the data through the information transmission network; and a means for transmitting to the host apparatus, the performance reduction information collected from the image forming apparatus by way of the data transmitting means of the device management apparatus.

(11) An image forming apparatus having a sheet processing apparatus, controllable through a remote control system comprising: a network to which a plurality of image forming apparatuses are connectible; a minimum of one device management apparatus for collecting data from the group of the plurality of image forming apparatuses; and a host apparatus capable of collecting the data accumulated in the device management apparatus, through the network, wherein the sheet processing apparatus comprises:

a driving apparatus; a plurality of operational abnormality detecting means corresponding to the plurality of driving means, one for one; a plurality of electric current amount setting means for setting the amounts of the electric currents supplied to the plurality of driving means, one for one; a controlling means for controlling the plurality of driving means, the plurality of operational abnormality detecting means, and the plurality of electric current amount setting means, the driving apparatus comprising: a plurality of driving means; a plurality of operational abnormality detecting means corresponding to the plurality of driving means, one for one; a plurality of electric current amount setting means for setting the amounts of the electric currents supplied to the plurality of driving means, one for one; a controlling means for controlling the plurality of driving means, the plurality of operational abnormality detecting means, and the plurality of electric current amount setting means;

the controlling means having a means for setting; the normal electric current value for each driving means, the maximum electric current value for each driving means, the normal speed value for each driving means, the minimum speed value for each driving means, at which each driving means is rotatable, the maximum speed value for each driving means, and the value of the sum of the electric currents supplied to the plurality of driving means, categorizes the plurality of the driving means in terms of function, and ranks the driving means in each functional group, in the order of priority in terms of the their effect upon the overall performance of the printing system;

wherein (a) if an operational abnormality is detected in any of the plurality of driving means by the operational abnormality detecting means, the controlling means increases the amount of the electric current supplied to the driving means in which the abnormality was detected, to a value which is no more than the maximum electrical current limit for the driving means in which the abnormality was detected, and which does not cause the total amount of the electric current supplied to the driving apparatus, to exceed the maximum electric current limit for the driving apparatus;

(b) if an operational abnormality is detected in any of the plurality of driving means, by the operational abnormality detecting means, and increasing the amount of the electric current supplied to the driving means in which the abnormality was detected, causes the amount of the electric current supplied to the driving means in which the abnormality was detected, to exceed the maximum electric current limit therefor, the controlling means reduces the speed of the driving means in which the abnormality was detected, to a value no less than the minimum speed limit at which the driving system in which the abnormality was detected, is rotatable, increases the speeds of any of the driving means, other than the driving means in which the abnormality was detected, chosen in the order of the above described priority, to a value no more than the maximum speed limit thereof, increases the amount of the electric current supplied thereto, in proportion to the new speed set therefor; and wherein the controlling means further comprises: a nonvolatile performance reduction information storing means capable of recognizing that the controlling means of the sheet processing apparatus is in the reduced performance mode, and storing the information that the sheet processing apparatus is in the reduced performance mode; a nonvolatile storing means for the data for driving the sheet driving apparatus in the reduced performance mode; a reduced performance mode setting means for checking whether or not the reduced performance mode is to be automatically set; a performance mode checking means for checking whether or not the reduced performance mode has been automatically set by the reduced performance setting means; a performance mode rechecking means for checking, by looking up the performance reduction information stored in the performance reduction information storing image, whether or not the sheet processing apparatus should be set again in the reduced performance mode, when the image forming operation is started, and also when the electric power is turned on again; a reduced performance data establishing means for establishing, as operational data, the driving data stored in the reduced performance driving data storing means, based on the results obtained by the performance mode rechecking; and a means for sending the reduced performance data to the device management apparatus.

(12) An image forming apparatus having a sheet processing apparatus, described in the preceding paragraph (11), wherein the device management apparatus is provided with a data transmitting means for transmitting data through the information transmission network, collects the information regarding whether or not the image forming apparatus is in the reduced performance mode, and transmits the results of the collection, to the host apparatus.

(13) An image forming apparatus having a sheet processing apparatus, described in the preceding paragraph (11), wherein if it is determined, by the performance mode rechecking moans, that it is unnecessary to set the sheet processing apparatus in the reduced performance mode, the performance reduction information stored in the reduced performance storing means is cleared, and the device management apparatus is informed that the performance reduction information has been cleared.

(14) An image forming apparatus having a sheet processing apparatus, described in the preceding paragraph (11), wherein the host apparatus has a performance reduction information displaying means for displaying for an operator, the performance reduction information from the device management apparatus.

(15) A driving apparatus comprising: a plurality of driving means; a plurality of operational abnormality detecting means corresponding to the plurality of driving means, one for one; a plurality of electric current amount setting means for setting the amounts of the electric currents supplied to the plurality of driving means, one for one; a controlling means for controlling the plurality of driving means, the plurality of operational abnormality detecting means, and the plurality of electric current amount setting means, wherein the controlling means has the functions of setting the normal electric current value for each driving means, the maximum electric current value for each driving means, the normal speed value for each driving means, the minimum speed value for each driving means, at which each driving means is rotatable, the maximum speed value for each driving means, and the value of the sum of the electric currents supplied to the plurality of driving means, categorizes the plurality of the driving means in terms of function, and ranks the driving means in each functional group, in the order of priority in terms of the their effect upon the overall performance of the printing system;

if an operational abnormality is detected in any of the plurality of driving means by the operational abnormality detecting means, the controlling means compares the amount of the electric current necessary to be increased to clear the operational abnormality, to the amount by which the electric current supplied to any of the driving means, other than the driving means in which the abnormality was detected, chosen in the order of the above described priority, needs to be increased to prevent the overall performance of the printing system from declining, choosing thereby the driving system smaller in the amount by which the electrical current supplied thereto needs to be increased, to deal with the operational abnormality of the driving means in order to prevent the overall performance of the printing system from declining.

(16) A sheet processing apparatus having the driving apparatus, described in the preceding paragraph (15), further comprising: a conveying means for receiving, and conveying further, the sheets outputted by an image forming apparatus; an aligning means for aligning the sheets outputted from the image forming apparatus; a stapler for stapling the set of aligned sheets; a moving means for moving the stapler to a predetermined location; a sheet stack discharging means for discharging the stack of aligned sheets; a vertically movable stacking means for stacking the stacks of the aligned sheets.

(17) An image forming apparatus having the sheet processing apparatus described in the preceding paragraph (16).

(18) A control system for controlling an image forming apparatus having a sheet processing apparatus, comprising: a step of receiving, and conveying further, the sheets outputted by the image forming apparatus; a step of aligning the sheets outputted from the image forming apparatus; a step of stapling the set of aligned sheets; a step of moving the stapler to a predetermined location; a step of discharging the stack of aligned sheets; a step of stacking the stacks of the aligned sheets, further comprising:

a plurality of driving means; a plurality of operational abnormality detecting means corresponding to the plurality of driving means, one for one; a plurality of electric current amount setting means for setting the amounts of the electric currents supplied to the plurality of driving means, one for one; a controlling means for controlling the plurality of driving means, the plurality of operational abnormality detecting means, and the plurality of electric current amount setting means;

the controlling means has the functions of setting the normal electric current value for each driving means, the maximum electric current value for each driving means, the normal speed value for each driving means, the minimum speed value for each driving means, at which each driving means is rotatable, the maximum speed value for each driving means, and the value of the sum of the electric currents supplied to the plurality of driving means, categorizes the plurality of the driving means in terms of function, and ranks the driving means in each functional group, in the order of priority in terms of the their effect upon the overall performance of the printing system;

if an operational abnormality is detected in any of the plurality of driving means by the operational abnormality detecting means, the controlling means compares the amount by which the electric current supplied to the driving means with the abnormality needs to be increased to clear the operational abnormality, to the amount by which the electric current supplied to any of the driving means, other than the driving means in which the abnormality was detected, chosen in the order of the above described priority, needs to be increased to prevent the overall performance of the printing system from declining, choosing thereby the driving system smaller in the amount by which the electrical current supplied thereto needs to be increased, to deal with the operational abnormality of the driving means in order to prevent the overall performance of the printing system from declining.

(19) An image forming apparatus having a sheet processing apparatus, controllable through a remote control system comprising: a network to which a plurality of image forming apparatuses arc connectible; a minimum of one device management apparatus for collecting data from the group of the plurality of image forming apparatuses; and a host apparatus capable of collecting the data accumulated in the device management apparatus, through the network, wherein the sheet processing apparatus comprises: a driving means; a conveying means for receiving, and conveying further, the sheets outputted by an image forming apparatus; an aligning means for aligning the sheets outputted from the image forming apparatus; a stapler for stapling the set of aligned sheets; a moving means for moving the stapler to a predetermined location; a sheet stack discharging means for discharging the stack of aligned sheets; a vertically movable stacking means for stacking the stacks of the aligned sheets;

the driving means comprises: a plurality of driving means; a plurality of operational abnormality detecting means corresponding to the plurality of driving means, one for one; a plurality of electric current amount setting means for setting the amounts of the electric currents supplied to the plurality of driving means, one for one; a controlling means for controlling the plurality of driving means, the plurality of operational abnormality detecting means, and the plurality of electric current amount setting means;

the controlling means has the functions of setting the normal electric current value for each driving means, the maximum electric current value for each driving means, the normal speed value for each driving means, the minimum speed value for each driving means, at which each driving means is rotatable, the maximum speed value for each driving means, and the value of the sum of the electric currents supplied to the plurality of driving means, categorizes the plurality of the driving means in terms of function, ranks the driving means in each functional group, in the order of priority in terms of the their effect upon the overall performance of the printing system, and if an operational abnormality is detected in any of the plurality of driving means by the operational abnormality detecting means, the controlling means compares the amount by which the electric current supplied to the driving means with the abnormality needs to be increased to clear the operational abnormality, to the amount by which the electric current supplied to any of the driving means, other than the driving means in which the abnormality was detected, chosen in the order of the above described priority, needs to be increased to prevent the overall performance of the printing system from declining, choosing thereby the driving system smaller in the amount by which the electrical current supplied thereto needs to be increased, to deal with the operational abnormality of the driving means in order to prevent the overall performance of the printing system from declining;

wherein the controlling means further comprising:

a non-volatile performance reduction information storing means capable of recognizing that the controlling means of the sheet processing apparatus is in the reduced performance mode, and storing the information that the controlling means of the sheet processing apparatus is in the reduced performance mode;

a non-volatile storing means for storing the data for driving the sheet driving apparatus, in the reduced performance mode;

a reduced performance setting means for checking whether or not the reduced performance mode is to be automatically set;

a performance mode checking means for checking whether or not the reduced performance mode has been automatically set by the reduced performance setting means;

a performance mode rechecking means for checking, by looking up the performance reduction information stored in the performance reduction information storing image, whether or not the sheet processing apparatus should be set again in the reduced performance mode, when an image forming operation is started, and also when the electric power is turned on again;

a reduced performance data establishing means for establishing, as operational data, the driving data stored in the reduced performance driving data storing means, based on the results obtained by the performance mode rechecking means; and a means for sending the reduced performance data to the device management apparatus.

(20) An image forming apparatus having the sheet processing apparatus, described in the preceding paragraph (19), wherein the device management apparatus is provided with a data transmitting means for transmitting data through the information transmission network, collects the information regarding whether or not the image forming apparatus is in the reduced performance mode, and transmits the results of the collection, to the host apparatus.

(21) An image forming apparatus having a sheet processing apparatus, described in the preceding paragraph (19), wherein if it is determined, by the performance mode rechecking means for checking whether or not the sheet processing apparatus should be set again in the reduced performance mode, that it is unnecessary to set the sheet processing apparatus in the reduced performance mode, the performance reduction information stored in the reduced performance storing means is cleared, and the device management apparatus is informed that the information that the performance reduction information has been cleared.

(22) An image forming apparatus having a sheet processing apparatus, controllable through a remote control system comprising: a network to which a plurality of image forming apparatuses are connectible; a minimum of one device management apparatus for collecting data from the group of the plurality of image forming apparatuses; and a host apparatus capable of collecting the data accumulated in the device management apparatus, through the network, comprising: a step of receiving, and conveying further, the sheets outputted by the image forming apparatus; a step of aligning the sheets outputted from the image forming apparatus; a step of stapling the set of aligned sheets; a step of moving the stapler to a predetermined location; a step of discharging the stack of aligned sheets; a step of stacking the stacks of the aligned sheets, further comprising:

a plurality of driving means; a plurality of operational abnormality detecting means corresponding to the plurality of driving means, one for one; a plurality of electric current amount setting means for setting the amounts of the electric currents supplied to the plurality of driving means, one for one; a controlling means for controlling the plurality of driving means, the plurality of operational abnormality detecting means, and the plurality of electric current amount setting means;

the controlling means has the functions of setting the normal electric current value for each driving means, the maximum electric current value for each driving means, the normal speed value for each driving means, the minimum speed value for each driving means, at which each driving means is rotatable, the maximum speed value for each driving means, and the value of the sum of the electric currents supplied to the plurality of driving means, categorizes the plurality of the driving means in terms of function, ranks the driving means in each functional group, in the order of priority in terms of the their effect upon the overall performance of the printing system, and it an operational abnormality is detected in any of the plurality of driving means by the operational abnormality detecting means, the controlling means compares the amount, by which the electric current supplied to the driving means with the abnormality needs to be increased to clear the operational abnormality, to the amount, by which the electric current supplied to any of the driving means, other than the driving means in which the abnormality was detected, chosen in the order of the above described priority, needs to be increased to prevent the overall performance of the printing system from declining, choosing thereby the driving system smaller in the amount by which the electrical current supplied thereto needs to be increased, to deal with the operational abnormality of the driving means in order to prevent the overall performance of the printing system from declining;

wherein the controlling means further comprising:

a non-volatile performance reduction information storing means capable of recognizing that the sheet processing apparatus is in the reduced performance mode, and storing the information that the sheet processing apparatus is in the reduced performance mode;

a non-volatile storing means for storing the data for driving the sheet driving apparatus, in the reduced performance mode; and a checking means for checking whether or not the reduced performance mode is to be automatically set;

the controlling means comprising:

a step of checking whether or not the sheet processing apparatus is to be automatically set in the reduced performance mode, when an image forming operation is started, and when the electric power is turned on again;

a step of checking whether or not the sheet processing apparatus has been be set in the reduced performance mode;

a step of checking, by looking up the reduced performance mode stored in the performance reduction information storing means, whether or not the sheet processing apparatus is set again in the reduced performance mode, when an image forming operation is started, and also when the electric power is turned on again;

a step of establishing, as operational data, the driving data stored in the reduced performance driving data storing process, based on the results obtained by the checking process; and a step of sending the reduced performance data to the device management apparatus;

the device management apparatus is provided with a data transmitting means for transmitting data through the information transmission network, collects the information regarding whether or not the image forming apparatus is in the reduced performance mode, and transmits the results of the collection, to the host apparatus;

if it is determined, by the performance mode rechecking means, that it is unnecessary for the sheet processing apparatus to be set in the reduced performance mode, the controlling means clears the performance reduction information stored in the performance reduction information storing means, and informs the device management apparatus that the performance reduction information has been cleared.

(23) An image forming apparatus having a sheet processing apparatus, controllable through a remote control system comprising: a network to which a plurality of image forming apparatuses are connectible; a minimum of one device management apparatus for collecting data from the group of the plurality of image forming apparatuses; and a host apparatus capable of collecting the data accumulated in the device management apparatus, through the network, wherein the sheet processing apparatus comprises: a driving portion; a conveying means for receiving, and conveying further, the sheets outputted by an image forming apparatus; an aligning means for aligning the sheets outputted from the image forming apparatus; a stapler for stapling the set of aligned sheets; a moving means for moving the stapler to a predetermined location; a sheet stack discharging means for discharging the stack of aligned sheets; a vertically movable stacking means for stacking the stacks of the aligned sheets;

the driving portion comprises: a plurality of driving means; a plurality of operational abnormality detecting means corresponding to the plurality of driving means, one for one; a plurality of electric current amount setting means for setting the amounts of the electric currents supplied to the plurality of driving means, one for one; a controlling means for controlling the plurality of driving means, the plurality of operational abnormality detecting means, and the plurality of electric current amount setting means;

the controlling means has the functions of setting the normal electric current value for each driving means, the maximum electric current value for each driving means, the normal speed value for each driving means, the minimum speed value for each driving means, at which each driving means is rotatable, the maximum speed value for each driving means, and the value of the sum of the electric currents supplied to the plurality of driving means, categorizes the plurality of the driving means in terms of function, ranks the driving means in each functional group, in the order of priority in terms of the their effect upon the overall performance of the printing system, and if an operational abnormality is detected in any of the plurality of driving means by the operational abnormality detecting means, the controlling means compares the amount, by which the electric current supplied to the driving means with the abnormality needs to be increased to clear the operational abnormality, to the amount, by which the electric current supplied to any of the driving means, other than the driving means in which the abnormality was detected, chosen in the order of the above described priority, needs to be increased to prevent the overall performance of the printing system from declining, choosing thereby the driving system smaller in the amount, by which the electrical current supplied thereto needs to be increased, to deal with the operational abnormality of the driving means in order to prevent the overall performance of the printing system from declining;

wherein the controlling means further comprising:

a reduced image forming apparatus performance transmitting means capable of recognizing that the controlling means of the sheet processing apparatus is in the reduced performance mode, and transmitting to the device management apparatus, the information that the controlling means of the sheet processing apparatus is in the reduced performance mode.

(24) An image forming apparatus having a sheet processing apparatus, described in the preceding paragraph (23), wherein the device management apparatus comprises a means for transmitting the performance reduction information regarding the image forming apparatus, to the host apparatus, with the use of the performance reduction information collecting means for collecting and storing the reduced performance regarding the image forming apparatus, and the data transmitting means for transmitting data through the information transmission network.

(25) A control system for controlling an image forming apparatus having a sheet processing apparatus, controllable through a remote control system comprising: a network to which a plurality of image forming apparatuses are connectible; a minimum of one device management apparatus for collecting data from the group of the plurality of image forming apparatuses; and a host apparatus capable of collecting the data accumulated in the device management apparatus, through the network, comprising:

a step of receiving, and conveying further, the sheets outputted by the image forming apparatus; a step of aligning the sheets outputted from the image forming apparatus; a step of stapling the set of aligned sheets; a step of moving the stapler to a predetermined location; a step of discharging the stack of aligned sheets; a step of stacking the stacks of the aligned sheets, further comprises:

a plurality of driving means; a plurality of operational abnormality detecting means corresponding to the plurality of driving means, one for one; a plurality of electric current amount setting means for setting the amounts of the electric currents supplied to the plurality of driving means, one for one; a controlling means for controlling the plurality of driving means, the plurality of operational abnormality detecting means, and the plurality of electric current amount setting means;

the controlling means has the functions of setting the normal electric current value for each driving means, the maximum electric current value for each driving means, the normal speed value for each driving means, the minimum speed value for each driving means, at which each driving means is rotatable, the maximum speed value for each driving means, and the value of the sum of the electric currents supplied to the plurality of driving means, categorizes the plurality of the driving means in terms of function, ranks the driving means in each functional group, in the order of priority in terms of the their effect upon the overall performance of the printing system, and if an operational abnormality is detected in any of the plurality of driving means by the operational abnormality detecting means, the controlling means compares the amount, by which the electric current supplied to the driving means with the abnormality needs to be increased to clear the operational abnormality, to the amount, by which the electric current supplied to any of the driving means, other than the driving means in which the abnormality was detected, chosen in the order of the above described priority, needs to be increased to prevent the overall performance of the printing system from declining, choosing thereby the driving system smaller in the amount, by which the electrical current supplied thereto needs to be increased, to deal with the operational abnormality of the driving means in order to prevent the overall performance of the printing system from declining; and wherein the controlling means further comprises a reduced image forming apparatus performance transmitting means capable of recognizing that the controlling means of the sheet processing means is in the reduced performance mode, and sending to the device management apparatus, the information that the controlling means of the sheet processing apparatus is in the reduced performance mode; and the device management apparatus comprises a means for transmitting to the host apparatus, the performance reduction information collected from the image forming by the performance reduction information collecting and retaining means for collecting and retaining the performance reduction information regarding the image forming apparatus, a data transmitting means for transmitting data through the information transmission network, and performance reduction information regarding the image forming apparatus.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 11 is a table showing the evaluation of the driving portions of the sheet processing apparatus in accordance with the present invention, made according to the ranking table in FIG. 10.

FIG. 12 is a table showing the values to which the performances of various driving portions of the sheet processing apparatus in accordance with the present invention are set when creating a printing system A by connecting the sheet processing apparatus to an image forming apparatus.

FIG. 13 is a table showing the values of the normal speed and normal amount of electric current of each of the various driving portions of the sheet processing apparatus in accordance with the present invention, when creating a printing system B by connecting the sheet processing apparatus to an image forming apparatus.

FIG. 31 is a table showing examples of the data transmitted through the network, and examples of devices to which the data are transmitted.

DESCRIPTION OF THE PREFERRED EMBODIMENT

Hereinafter, a driving apparatus in accordance with the present invention, a sheet processing apparatus having the driving apparatus, and an image forming apparatus having the sheet processing apparatus, and a control system therefor, will be described.

Figure 1:
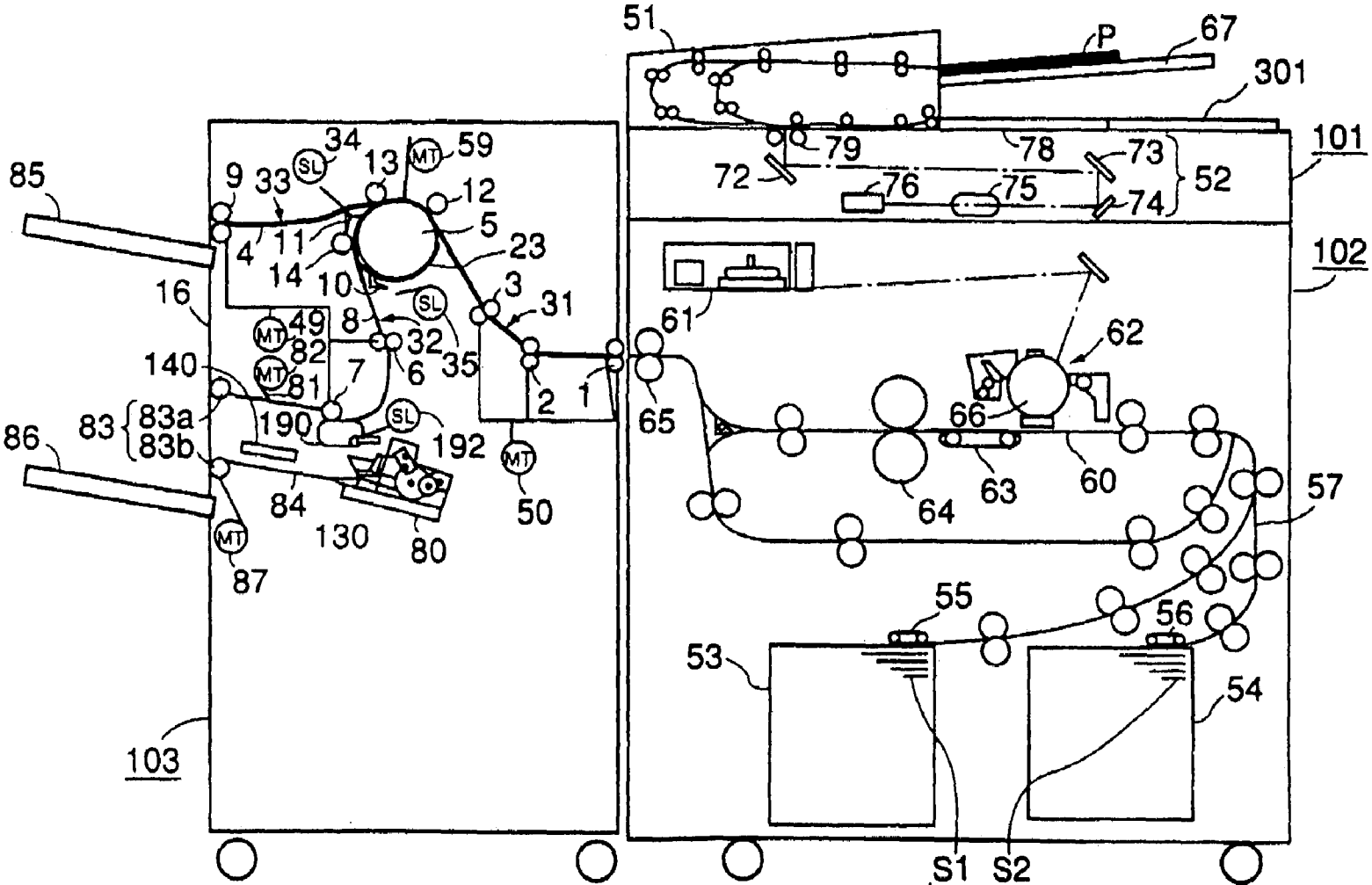
FIG. 1 is a schematic vertical sectional view of the combination of a driving apparatus in accordance with the present invention, a sheet processing apparatus having the driving apparatus, and a copying machine, as an example of an image forming apparatus having the sheet processing apparatus, parallel with the front panel of the image forming apparatus, describing the structures of the essential portions thereof.
Figure 2:
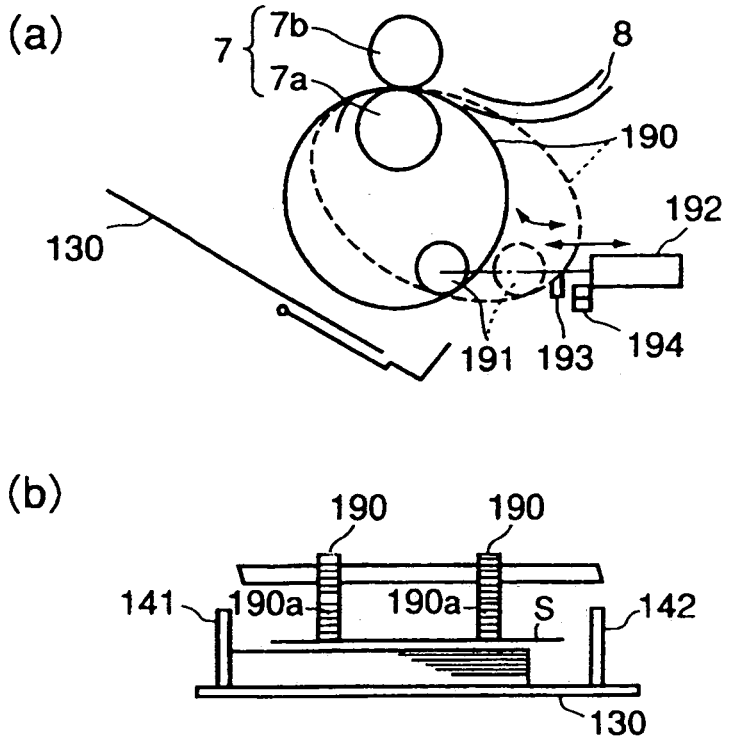
FIG. 2 is comprised of FIGS. 2(*a*) and 2(*b*). which are schematic drawings showing the structure of the knurled belt in the sheet processing apparatus, wherein FIGS. 2(*a*) and 2(*b*) are plan and side views, respectively.

FIG. 1 is a schematic vertical sectional view of the combination of a driving apparatus in accordance with the present invention, a sheet processing apparatus having the driving apparatus, and a copying apparatus, as an example of an image forming apparatus, connected to the sheet processing apparatus, parallel with the front panels of the apparatuses, describing the structures of the essential portions thereof. FIG. 2 is a schematic drawing for describing the structure of the knurled belt in the sheet processing apparatus, (*a*) and (*b*) of FIG. 2 being schematic plan view and side view, respectively.

Figure 3:
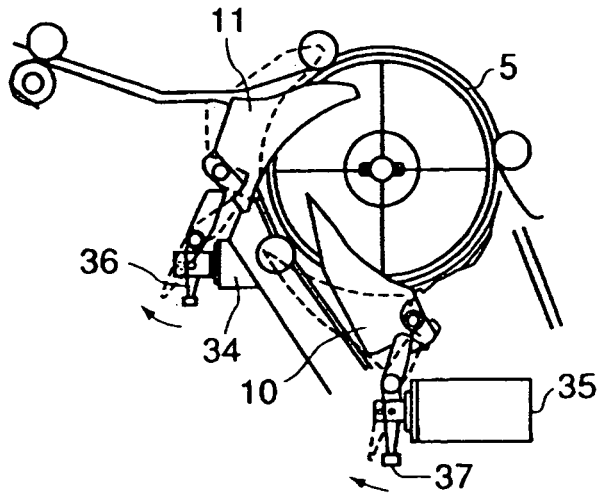
FIG. 3 is a schematic sectional view, parallel to the front panel of the sheet processing apparatus, of the flapper for switching the sheet conveyance path in the sheet processing apparatus.
Figure 4:
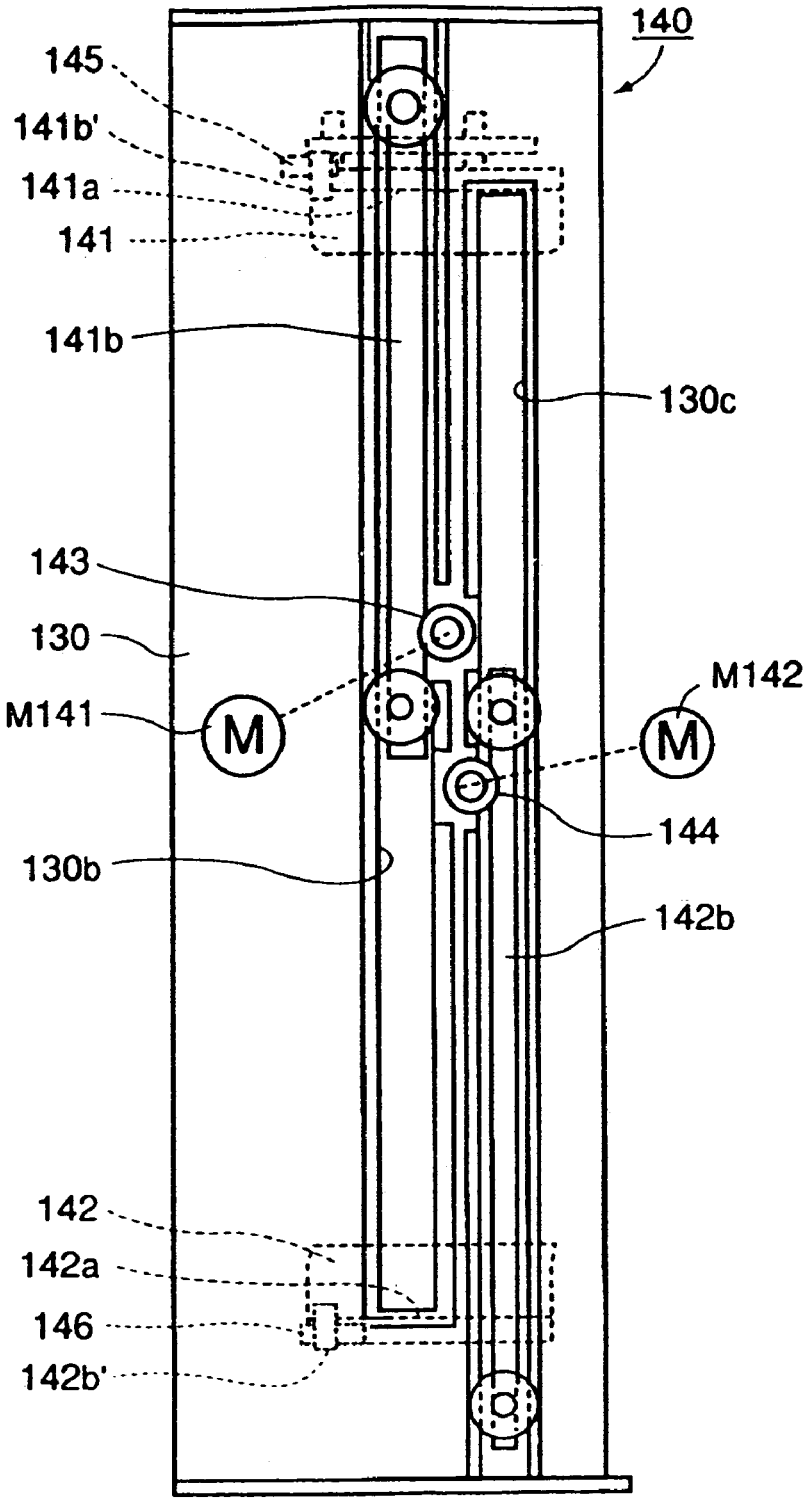
FIG. 4 is a schematic horizontal sectional view of the sheet aligning apparatus of the processing tray in the sheet processing apparatus.
Figure 5:
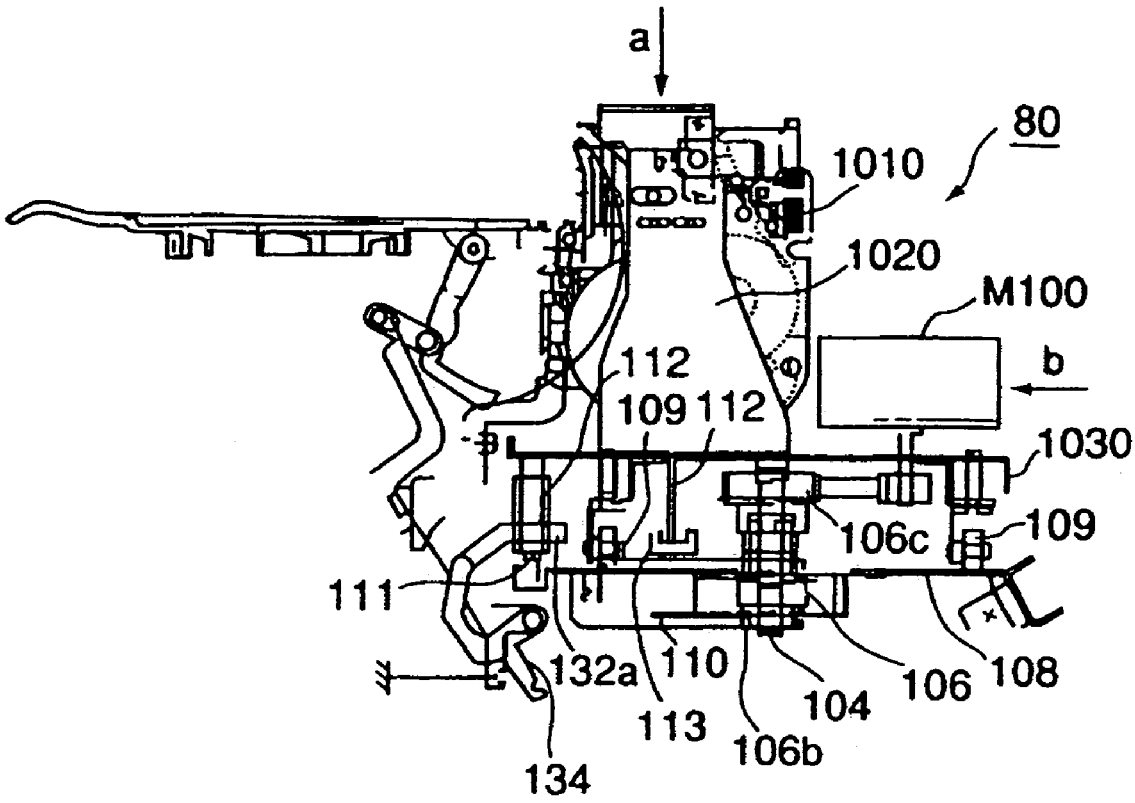
FIG. 5 is a first schematic sectional view, parallel to the front panel of the sheet processing apparatus, of the stapling unit of the processing tray in the sheet processing apparatus.
Figure 6:
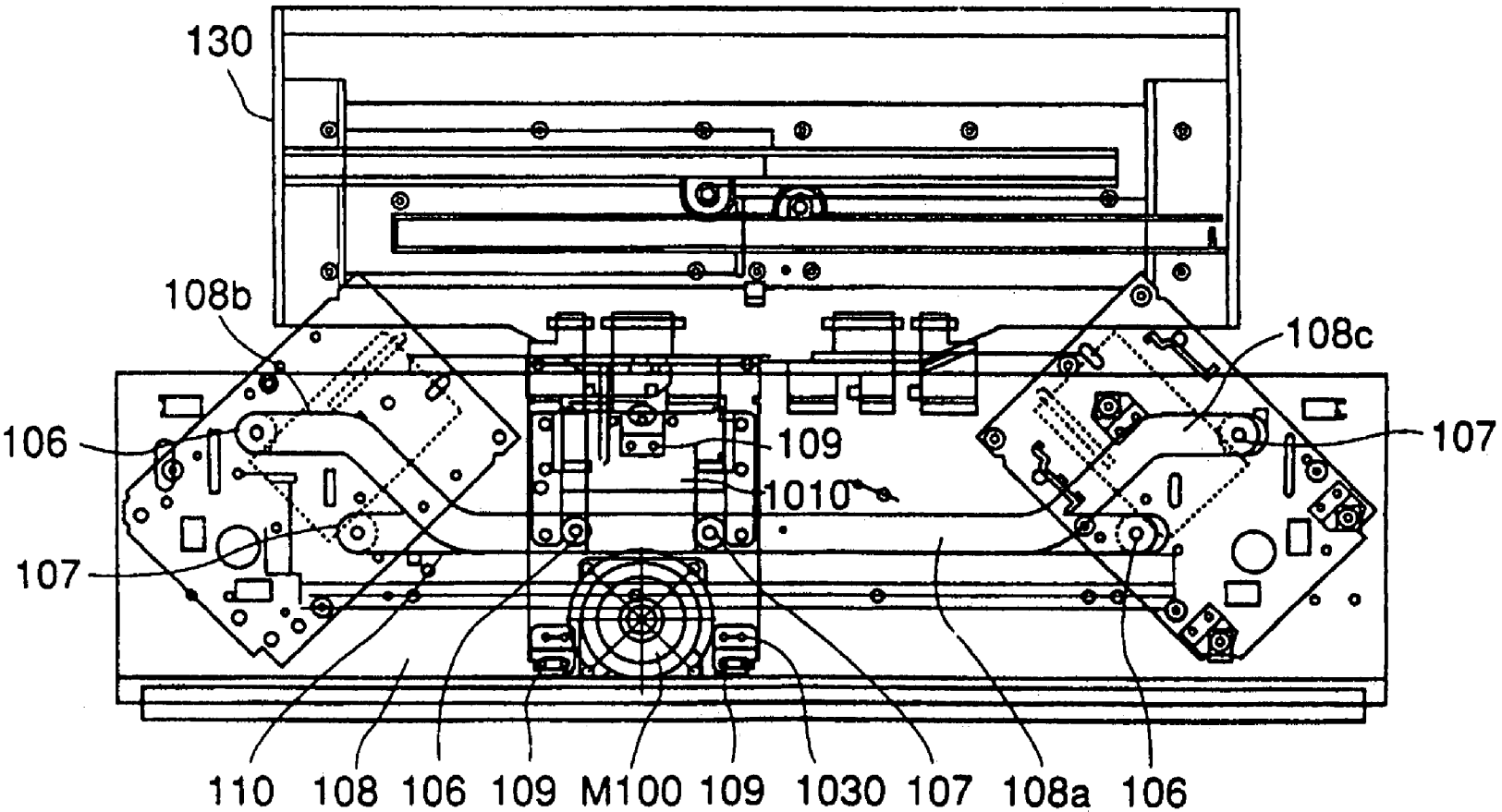
FIG. 6 is a second schematic sectional view, parallel to the front panel of the sheet processing apparatus, of the stapling unit of the processing tray in the sheet processing apparatus.
Figure 7:
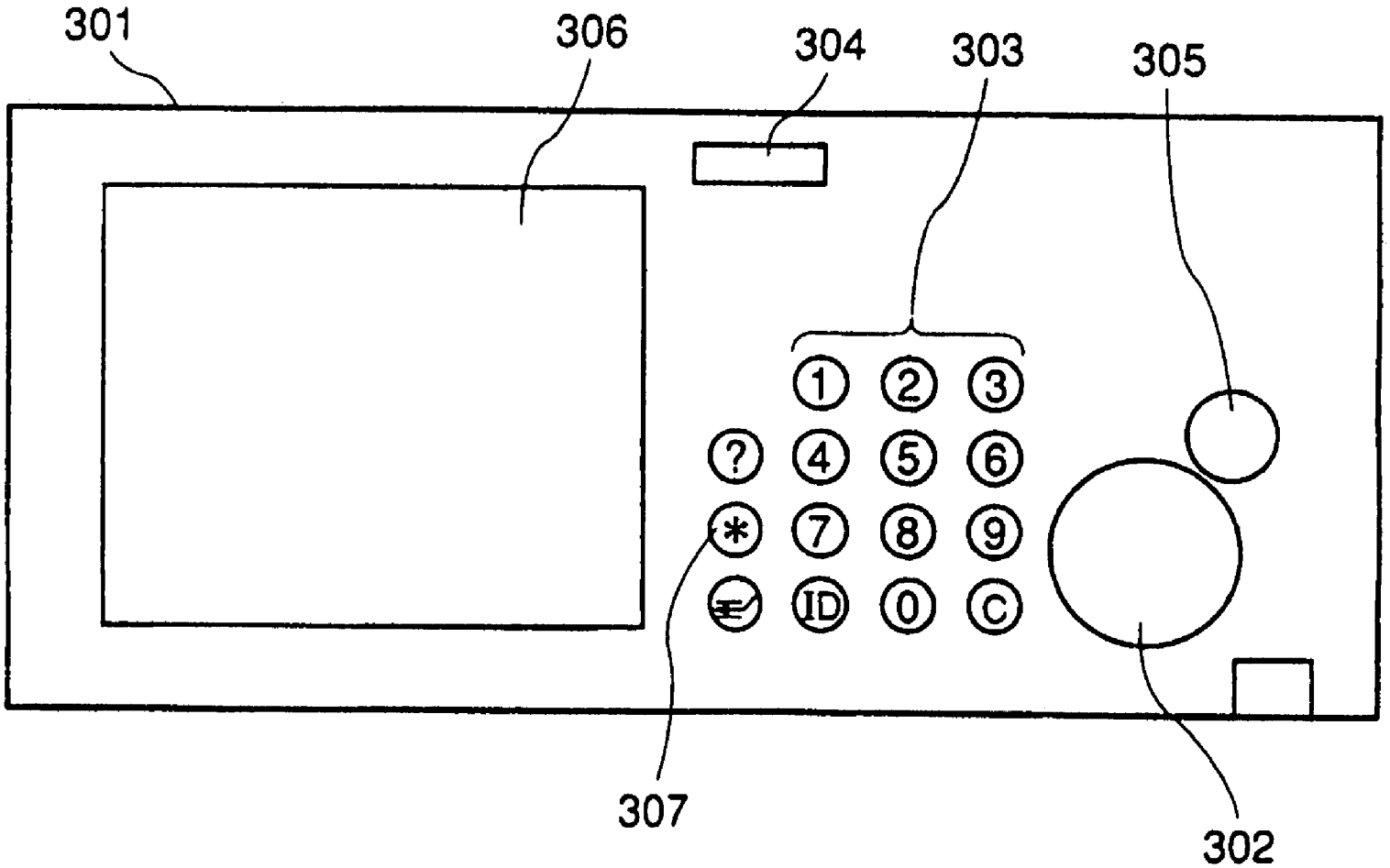
FIG. 7 is a schematic plan view of the control panel of the sheet feeding-reading apparatus.
Figure 8:
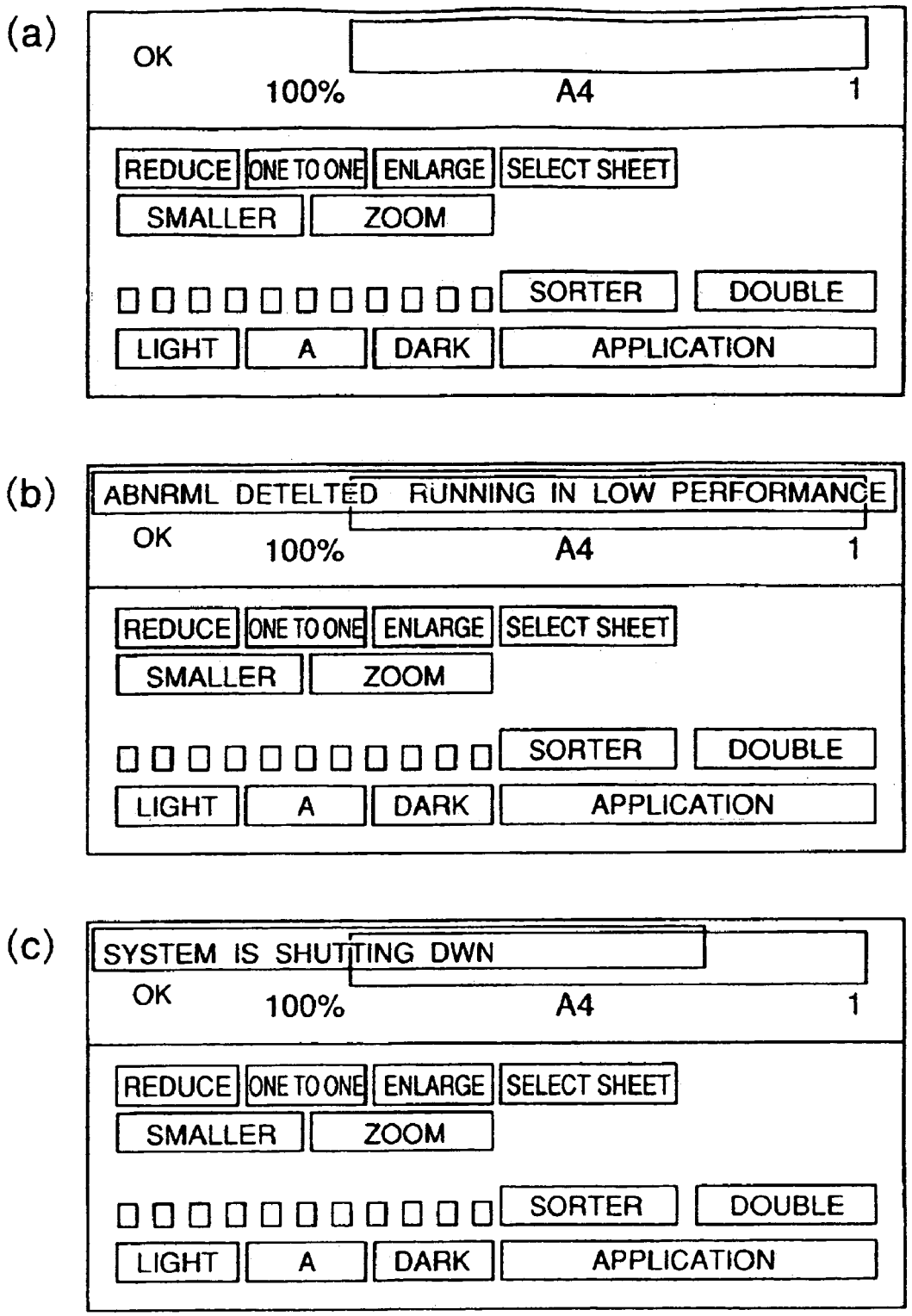
FIG. 8 is an example of the graphics shown on the display device of the control panel.
Figures 9, 10:
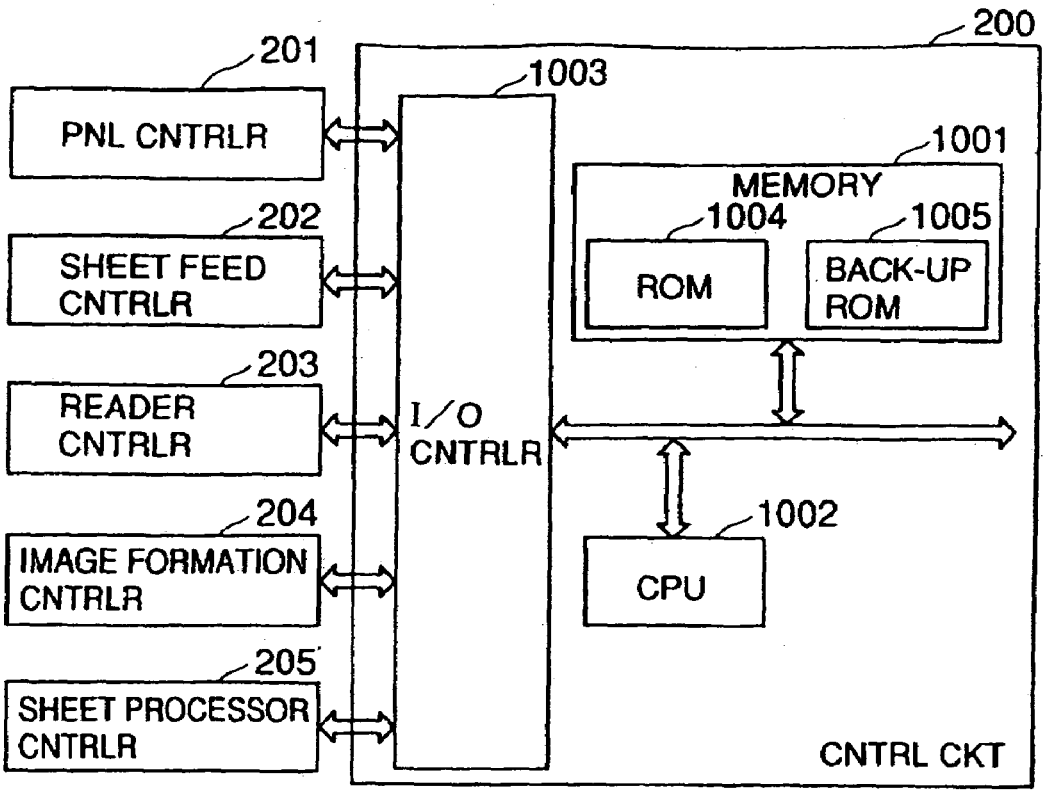
FIG. 9 is a block diagram showing the structure of the essential portions of the control portion of the copying machine in the first or second embodiment.
FIG. 10 is a table showing the categories of the functions of the driving portions of the sheet processing apparatus, and an example of the ranking of the driving portions in each category, in terms of their effect upon the overall performance of the printing system.
Figure 14:
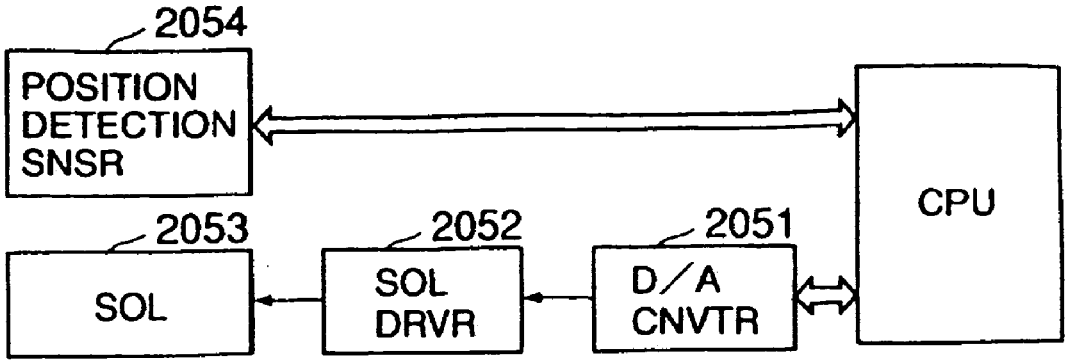
FIG. 14 is a block diagram showing the structure of the control portion for driving the solenoid in the sheet processing apparatus in accordance with the present invention.
Figure 15:
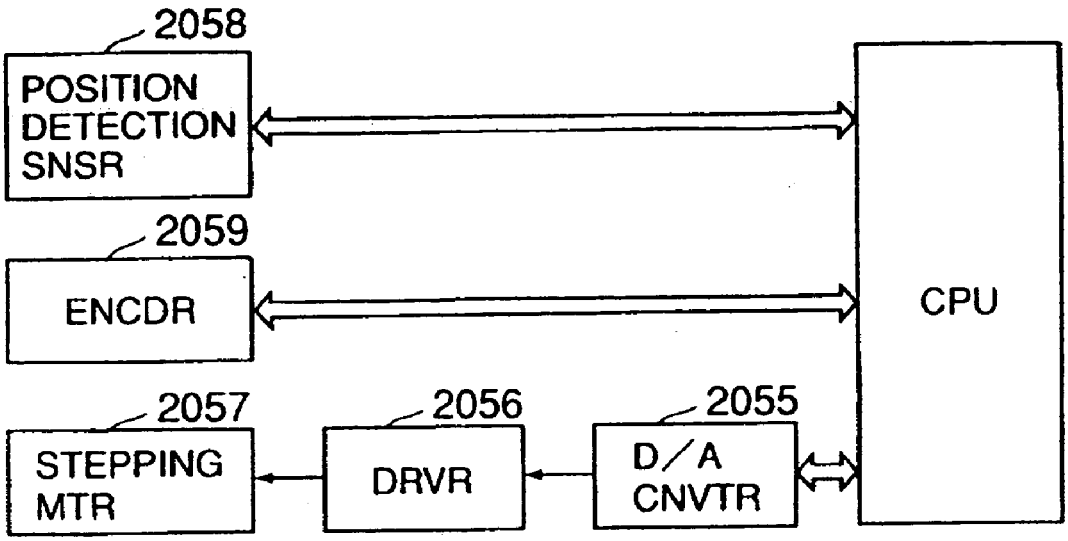
FIG. 15 is a block diagram showing the structure of the control portion for driving the stepping motor in the sheet processing apparatus in the sheet processing apparatus.
Figure 16:
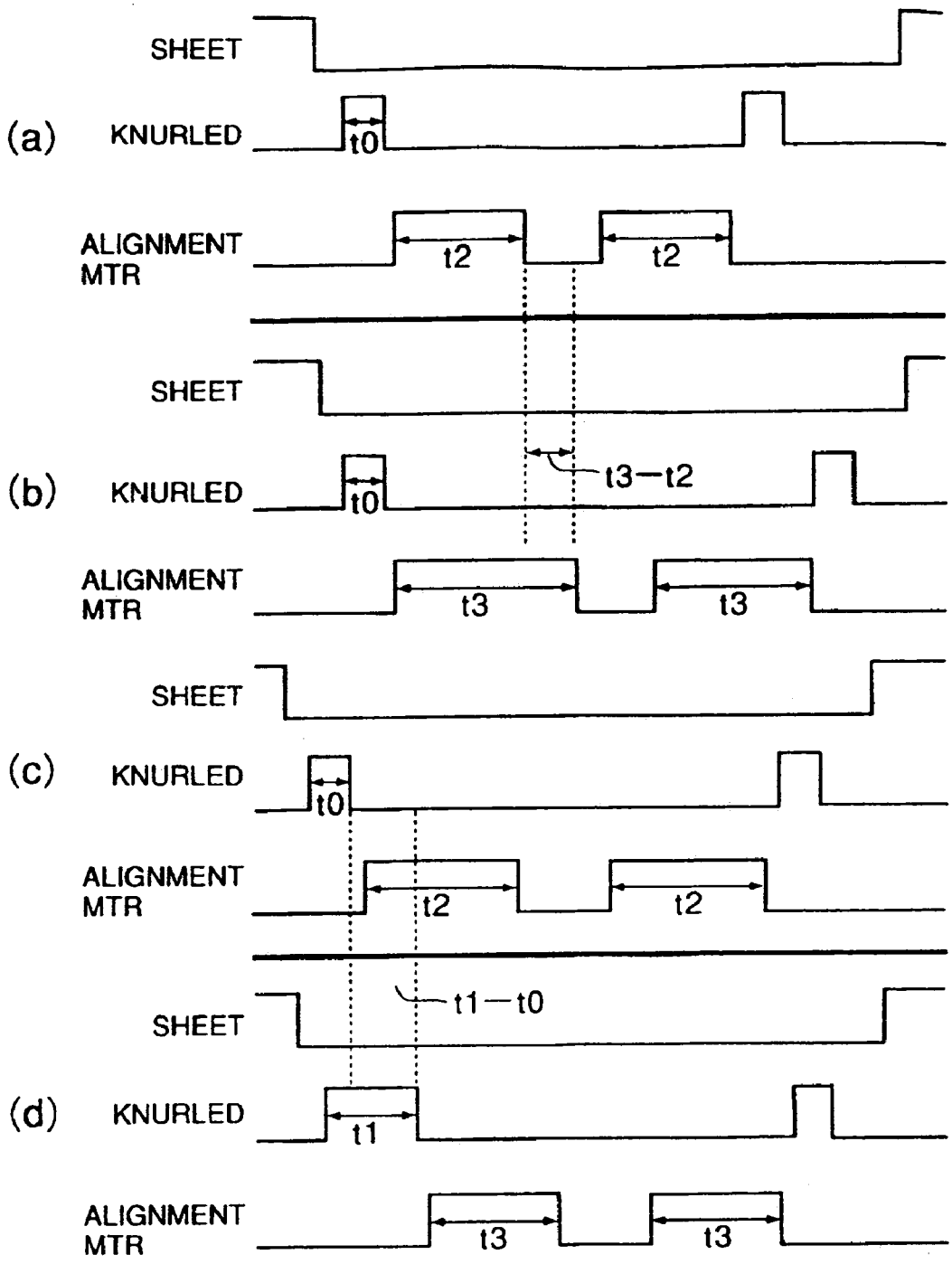
FIG. 16 is a timing chart for showing the operational timings for sheets, a knurled belt solenoid, and an alignment motor, when the sheets are discharged into the sheet processing tray in the sheet processing apparatus in accordance with the present invention.
Figure 17:
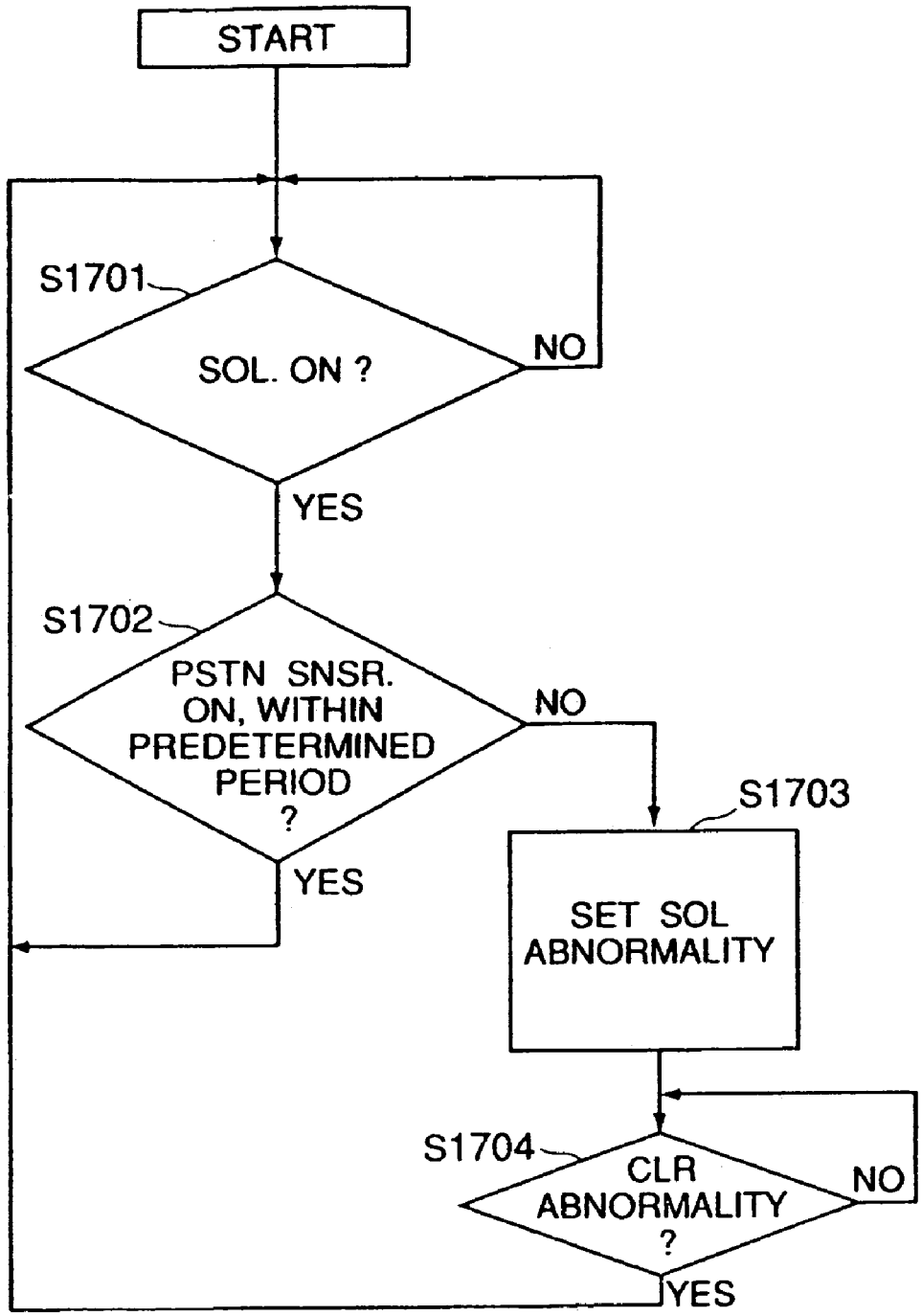
FIG. 17 is a flowchart showing the process of detecting the abnormality of the solenoid in the sheet processing apparatus in accordance with the present invention.
Figure 18:
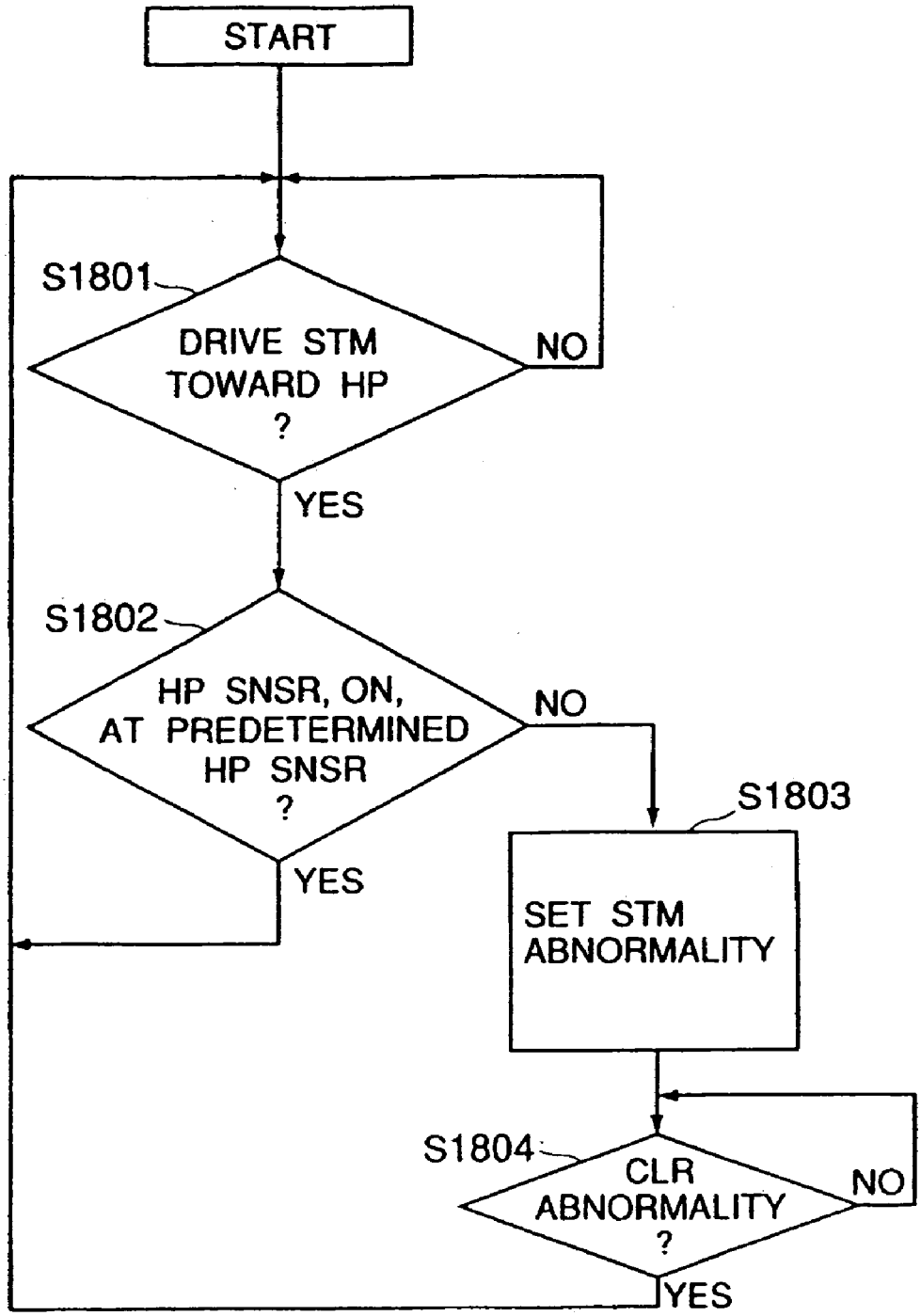
FIG. 18 is a flowchart showing the process of detecting the abnormality of the stepping motor of the sheet processing apparatus in accordance with the present invention.
Figure 19:
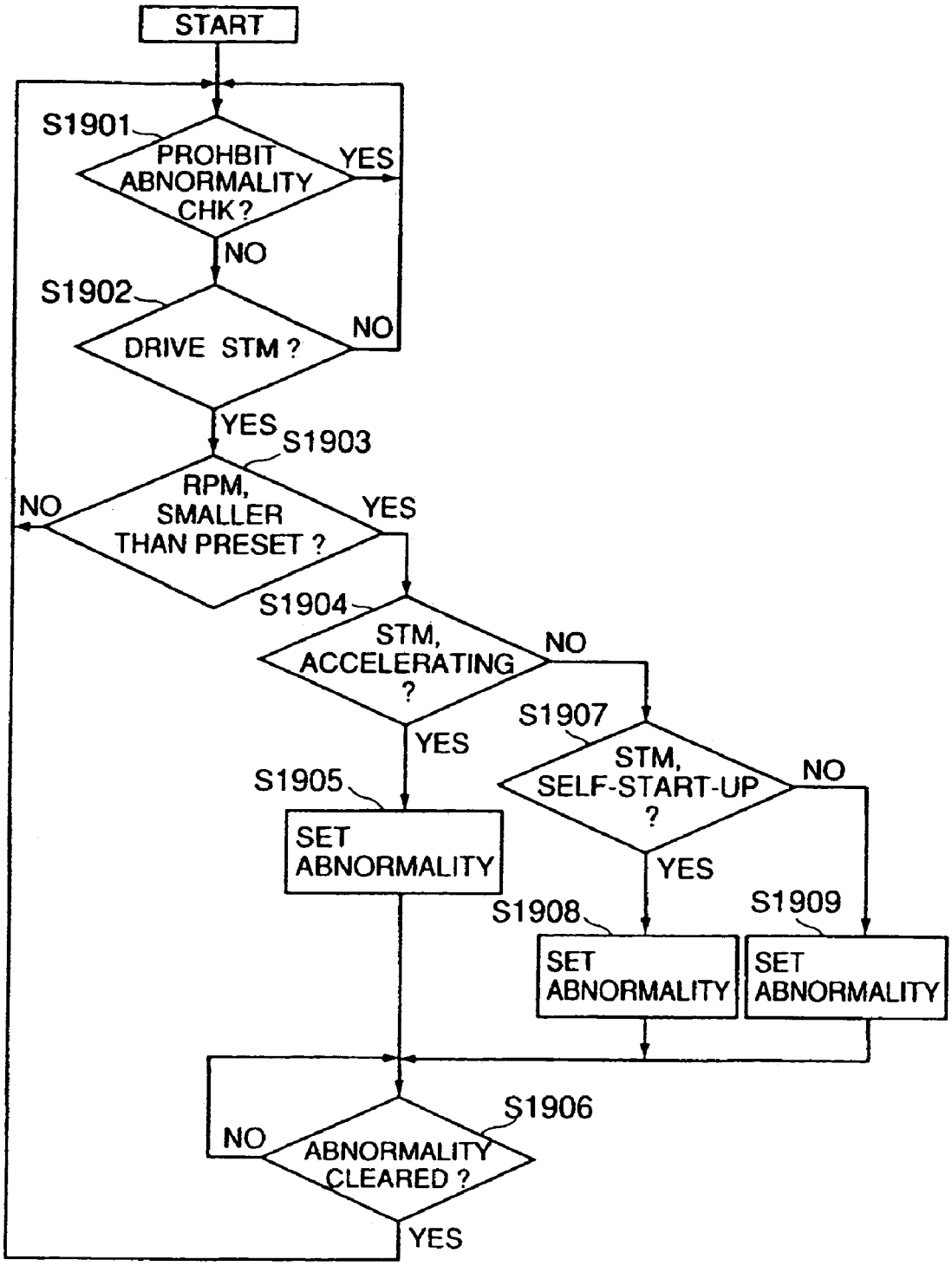
FIG. 19 is a flowchart showing the process of detecting the abnormality of the stepping motor, based on the revolution of the stepping motor detected by the encoder, in the sheet processing apparatus in accordance with the present invention.
Figure 20:
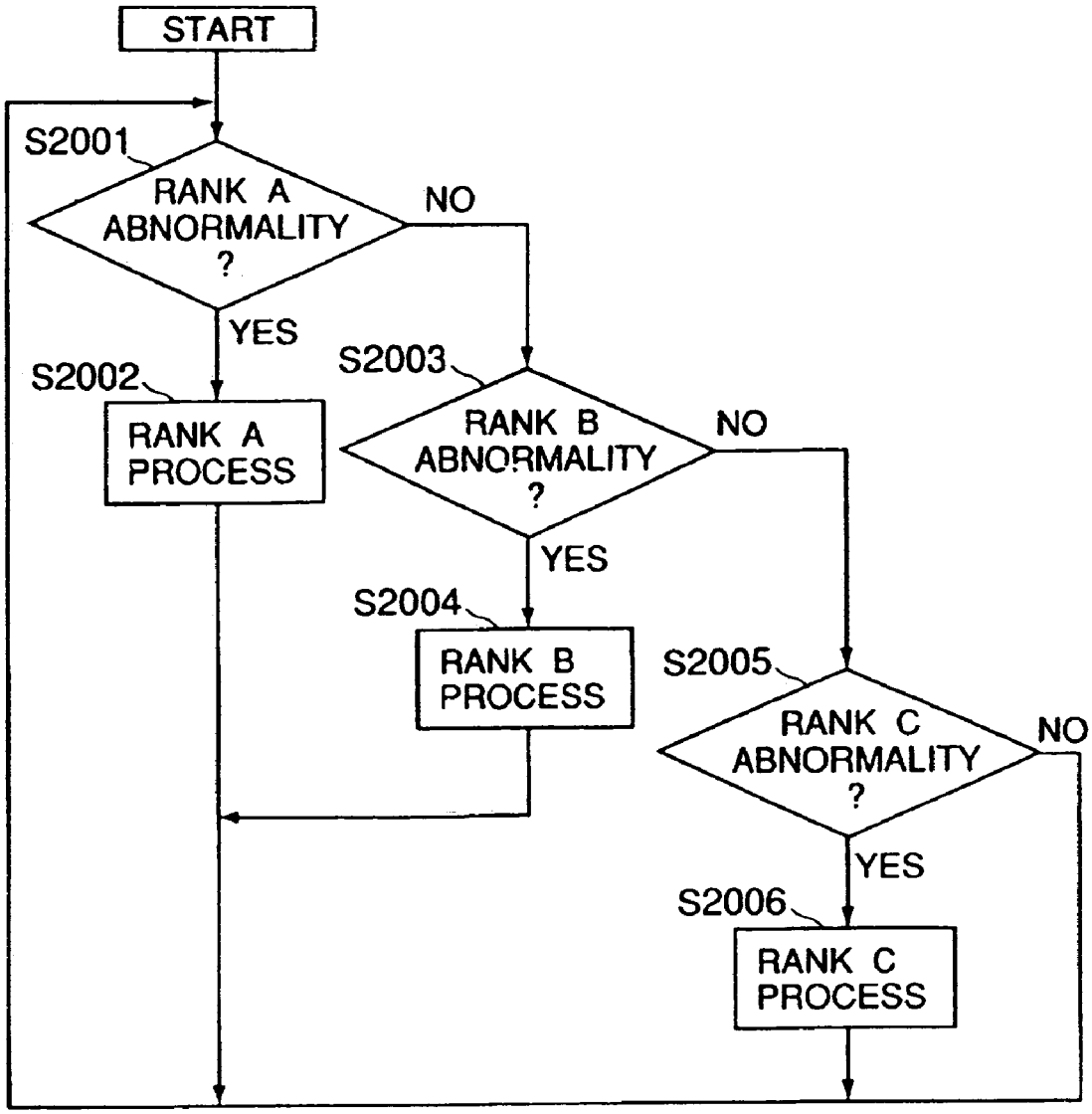
FIG. 20 is a flowchart showing the process of detecting the occurrence of abnormalities in the driving system, and the process of managing the abnormalities, in the sheet processing apparatus in accordance with the present invention.
Figure 21:
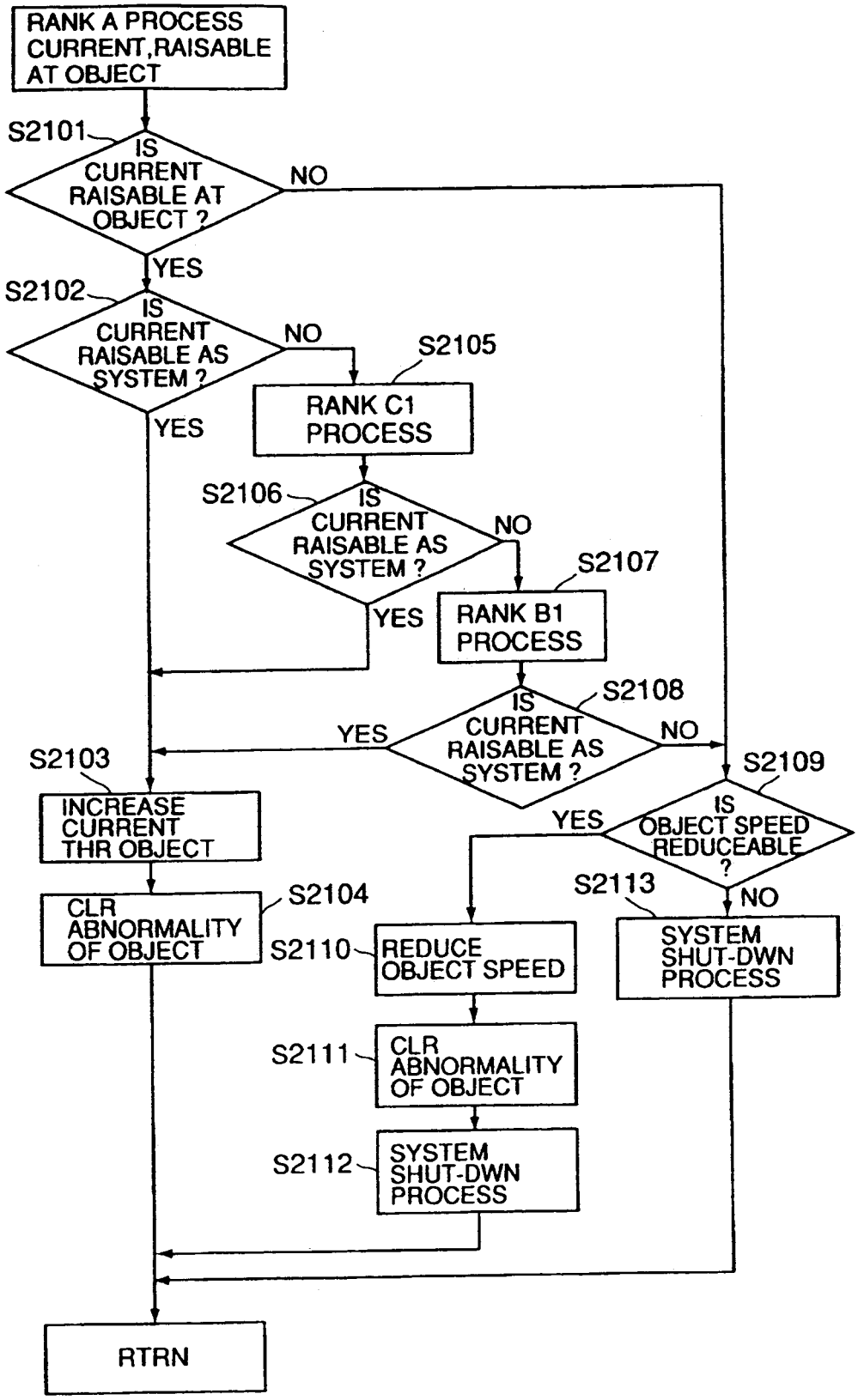
FIG. 21 is a flowchart showing the routine (abnormality management routine A) carried out if an abnormality is detected in the A ranked driving systems in the sheet processing apparatus in accordance with the present invention.
Figures 22, 22A:
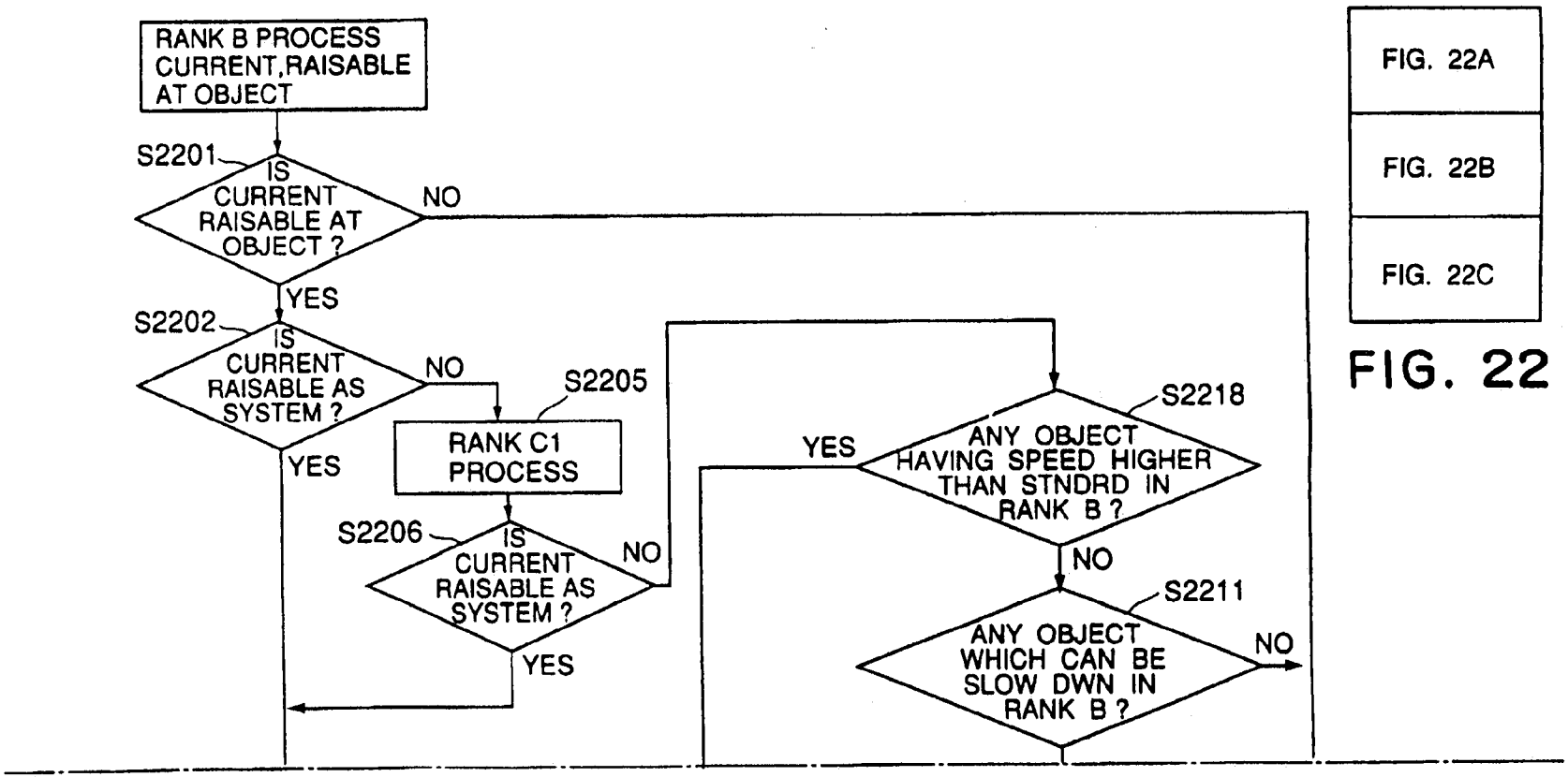
FIG. 22 is comprised of FIGS. 22A, 22B and 22C showing flowcharts for the routine (abnormality management routine B) carried out if an abnormality is detected in the B ranked driving systems in the sheet processing apparatus in accordance with the present invention.
Figure 22B:
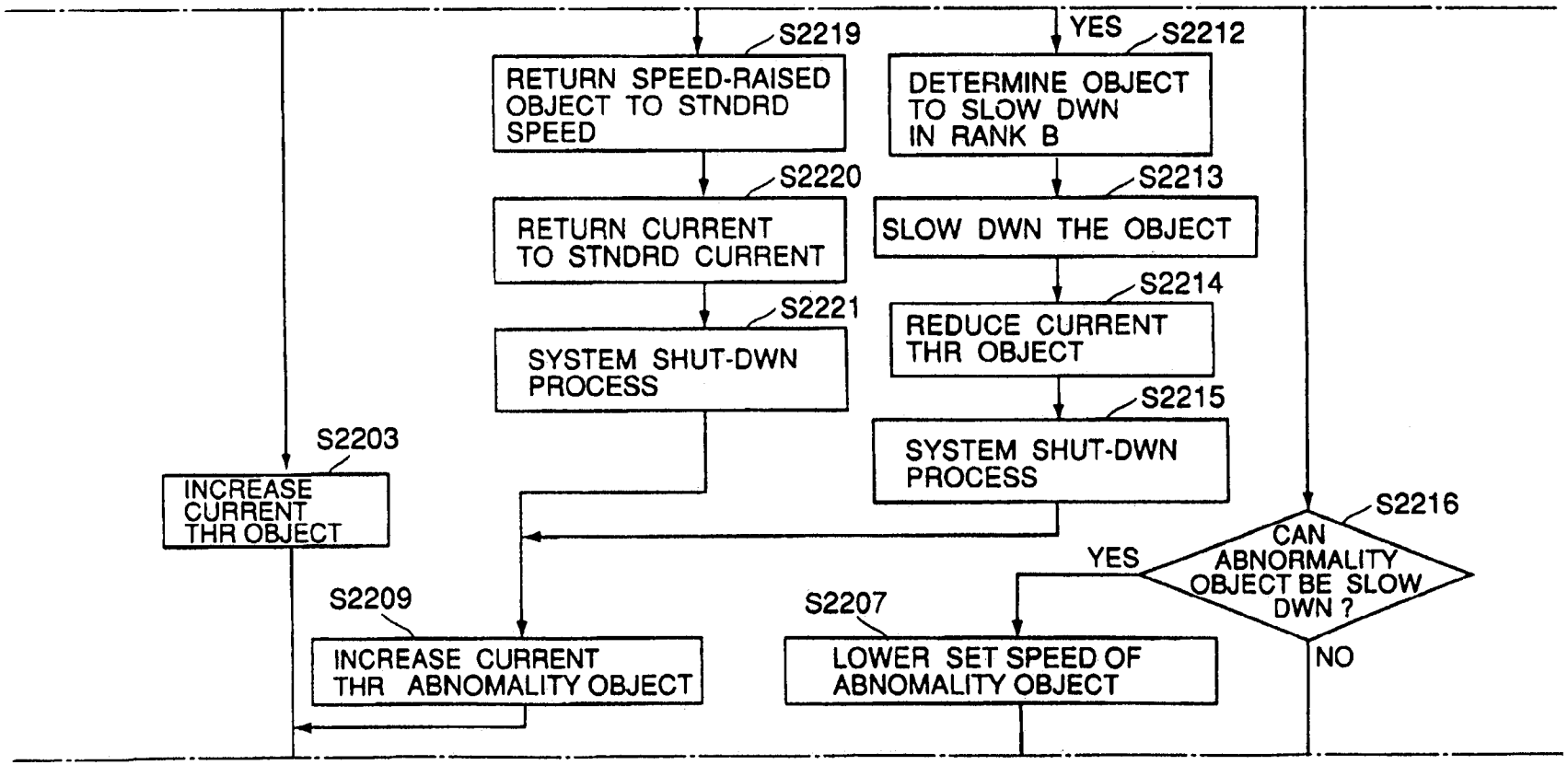
Figure 22C:
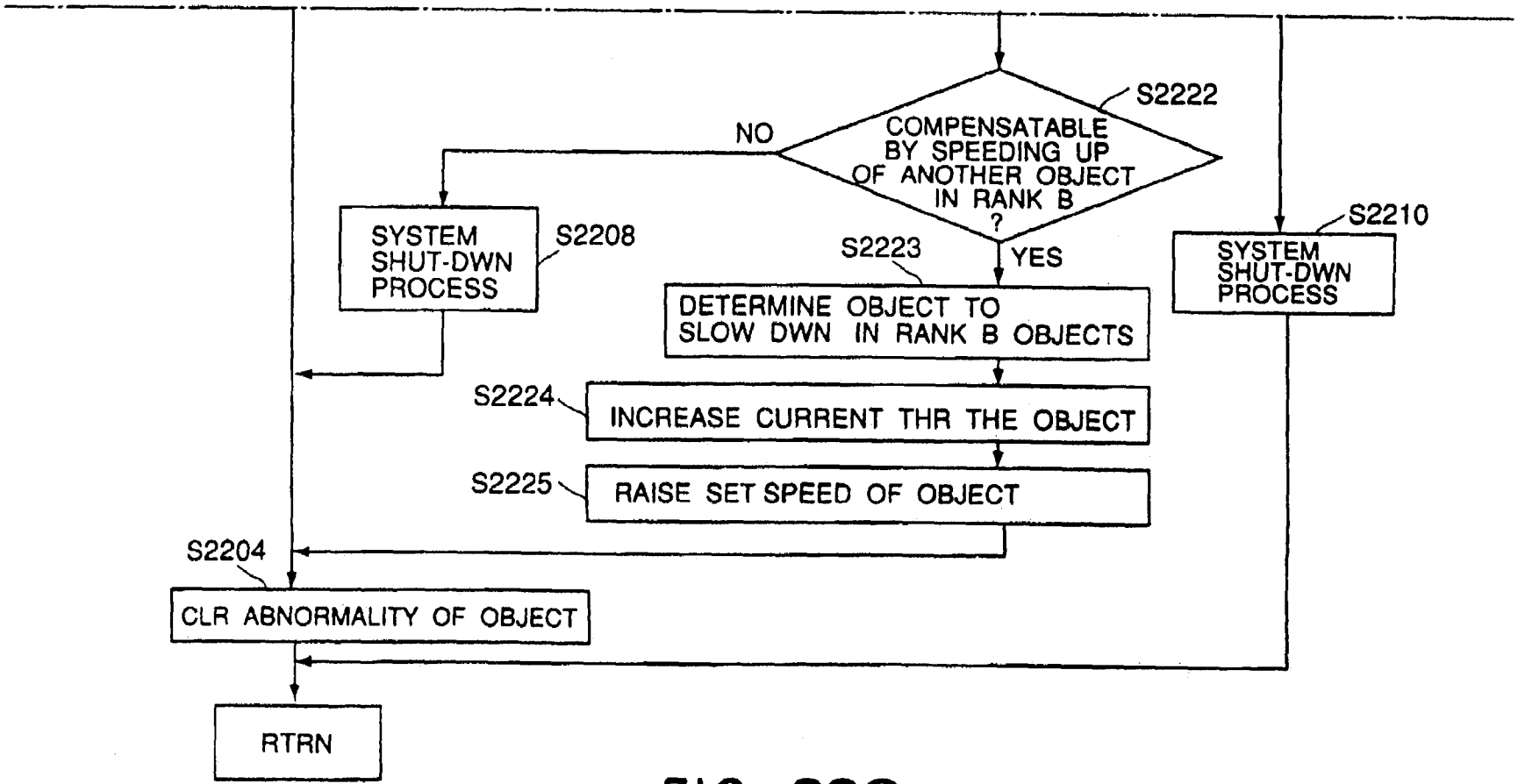
Figures 23, 23A:
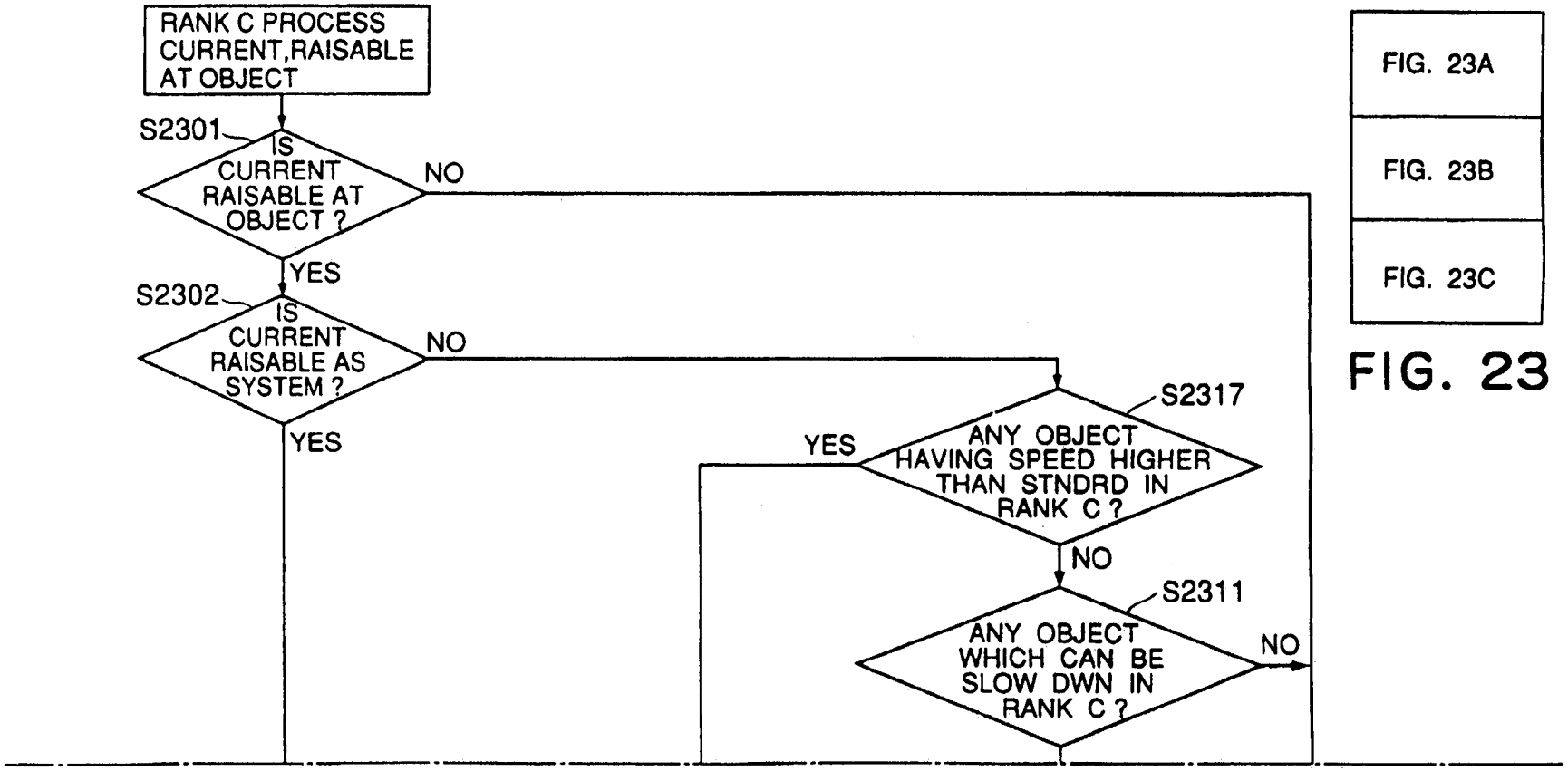
FIG. 23 is comprised of FIGS. 23A, 23B and 23C showing flowcharts for the routine (abnormality management routine C) carried out if an abnormality is detected in the C ranked driving systems in the sheet processing apparatus in accordance with the present invention.
Figure 23B:
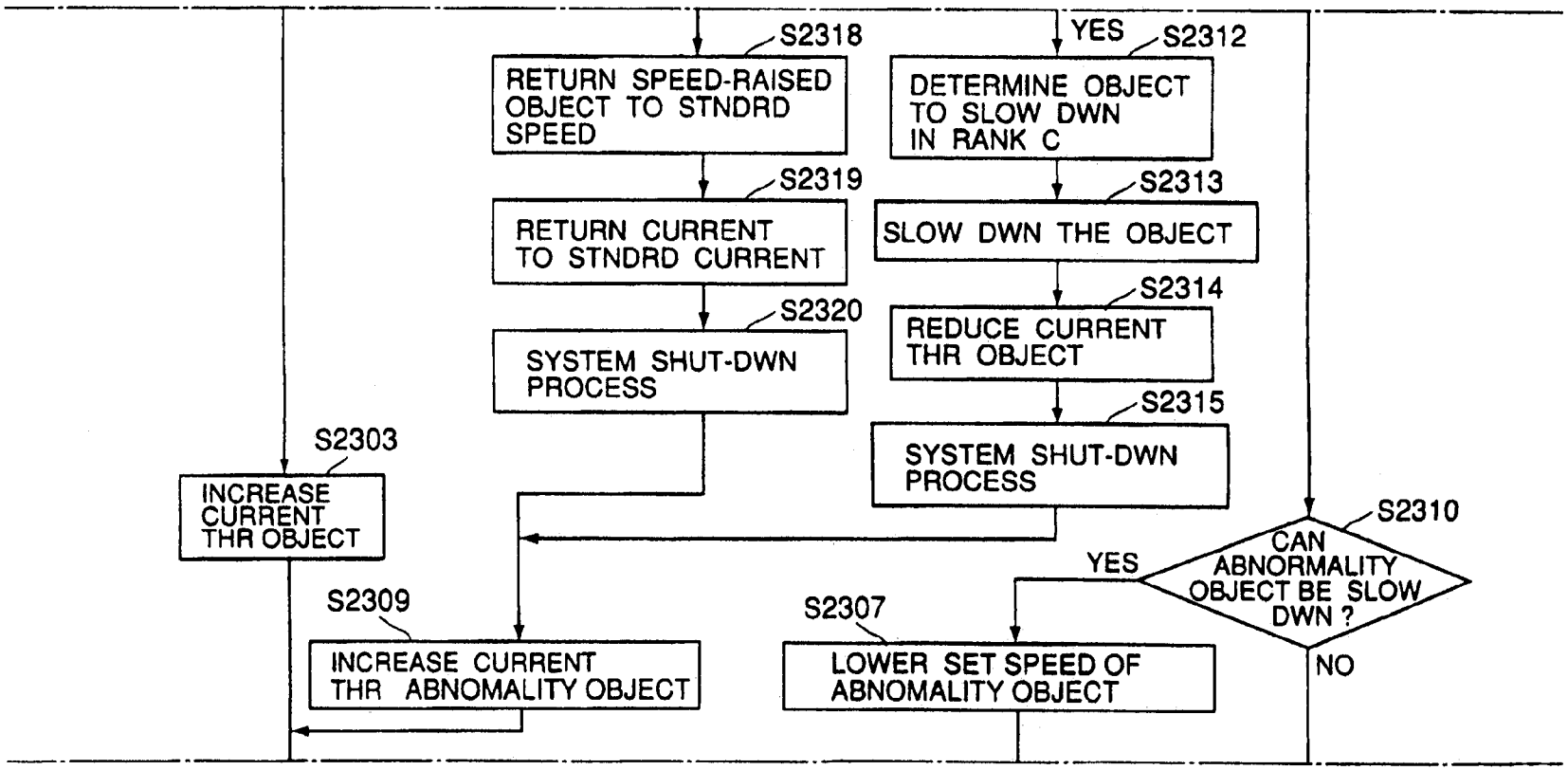
Figure 23C:
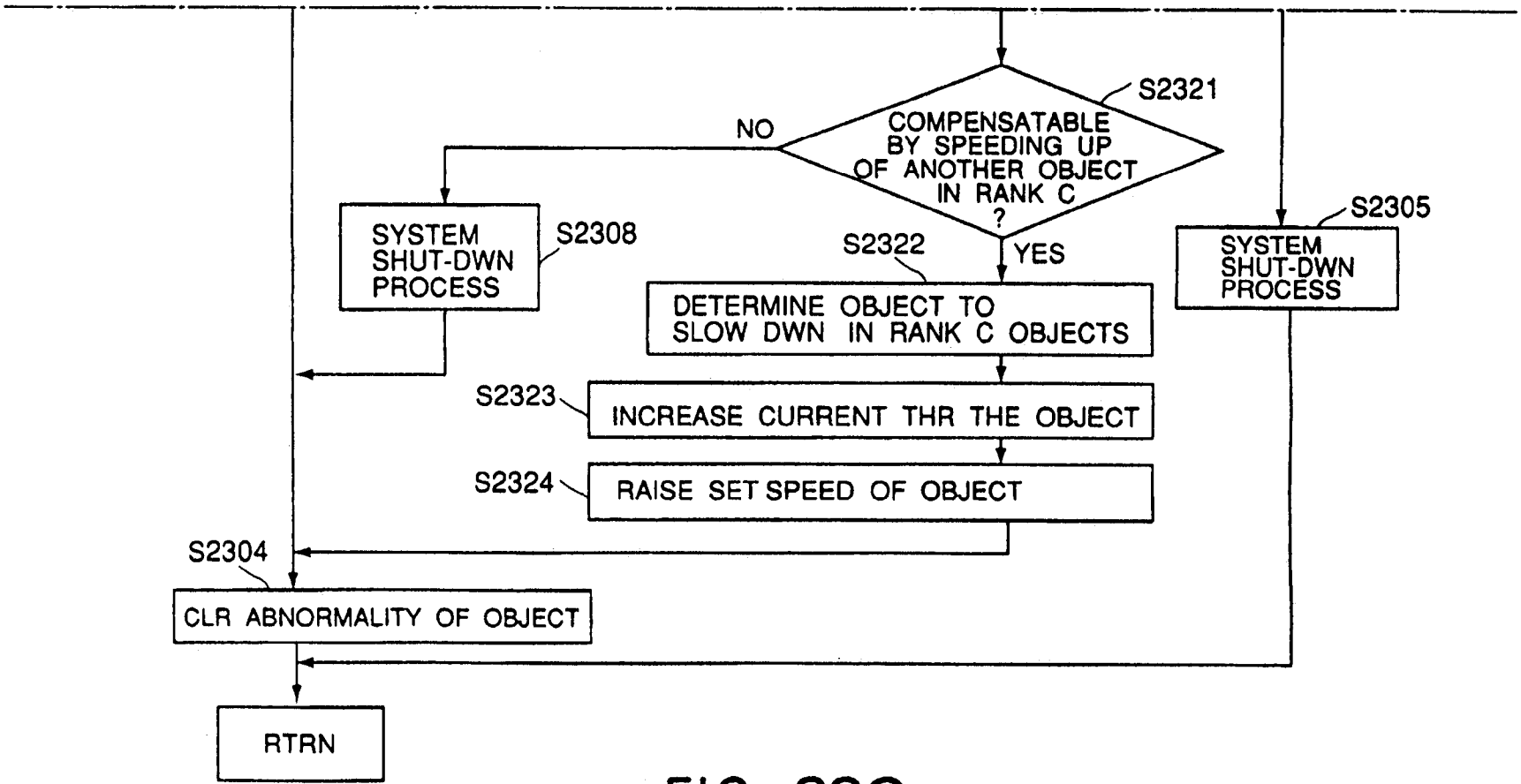
Figure 24:
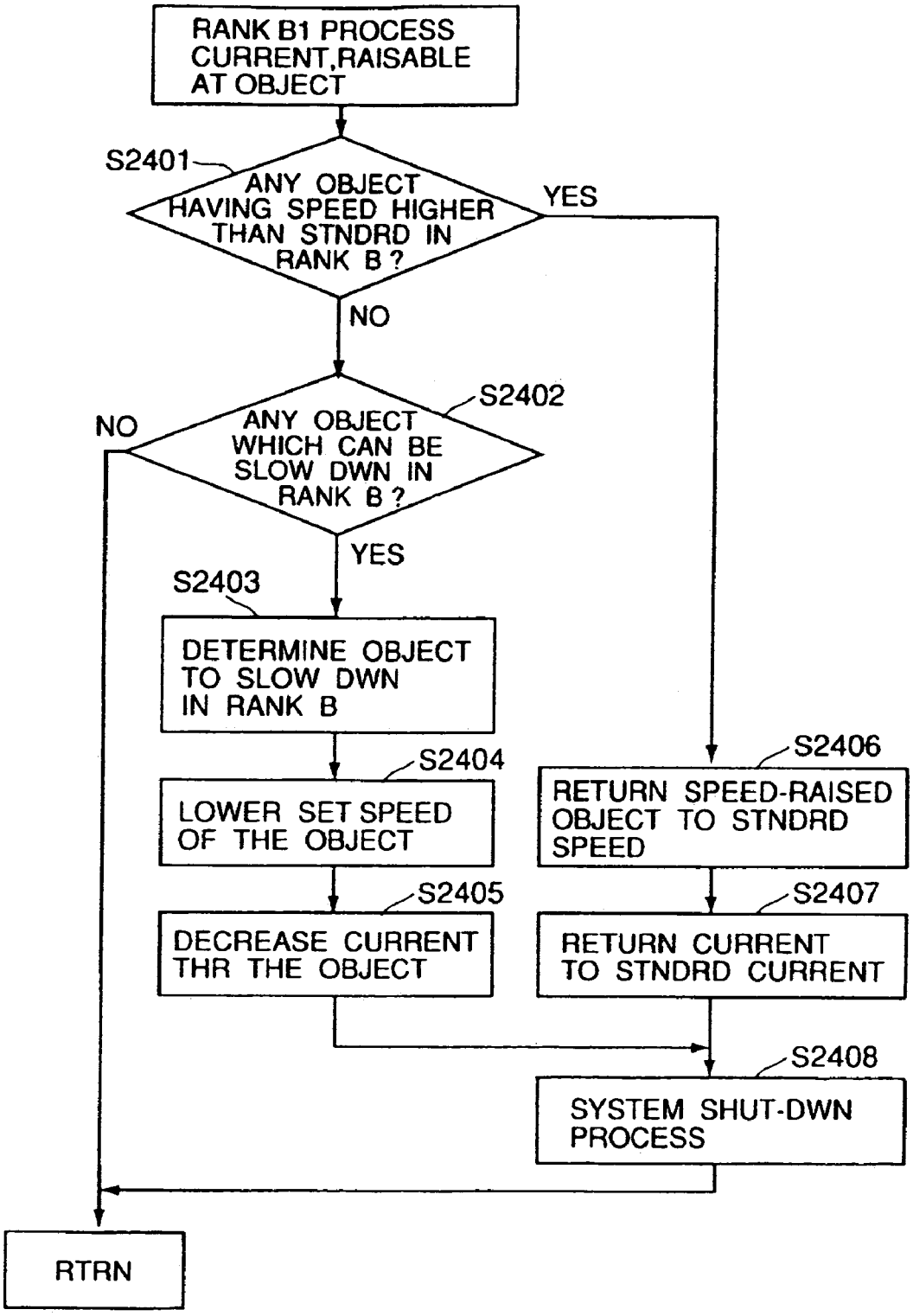
FIG. 24 is a flowchart showing the abnormality management routine B1, which branches from the abnormality management routine A, and which is carried out if an abnormality is detected in the A ranked driving systems in the sheet processing apparatus in accordance with the present invention.
Figure 25:
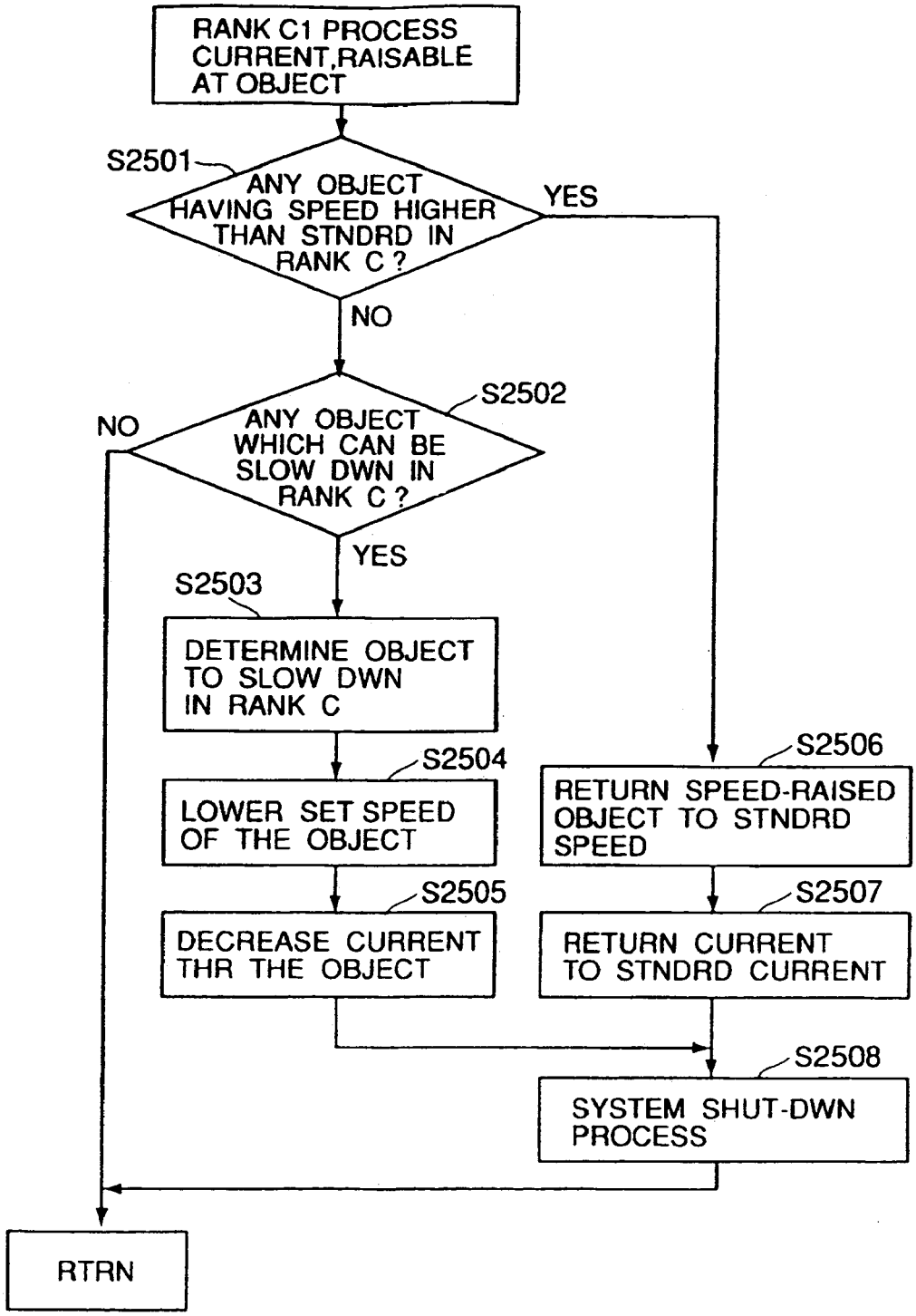
FIG. 25 is a flowchart showing the abnormality management routine C1, which branches from the abnormality management routine A, and which is carried out if an abnormality is detected in the A ranked driving systems in the sheet processing apparatus in accordance with the present invention.
Figure 26:
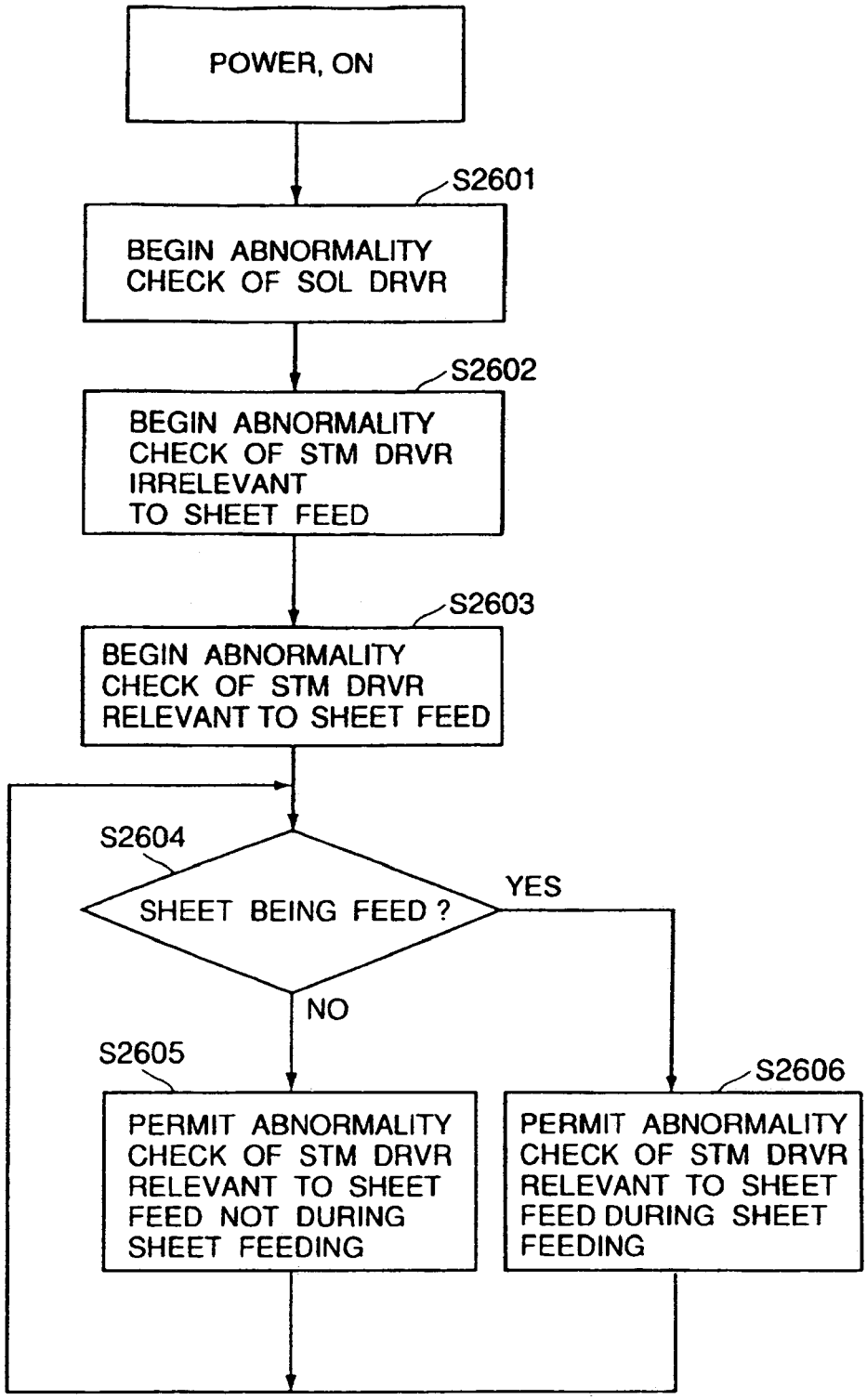
FIG. 26 is a flowchart showing the process of detecting an abnormality in each of the driving portions in the sheet processing apparatus in accordance with the present invention, and the process of controlling the abnormality management process.
Figure 27:
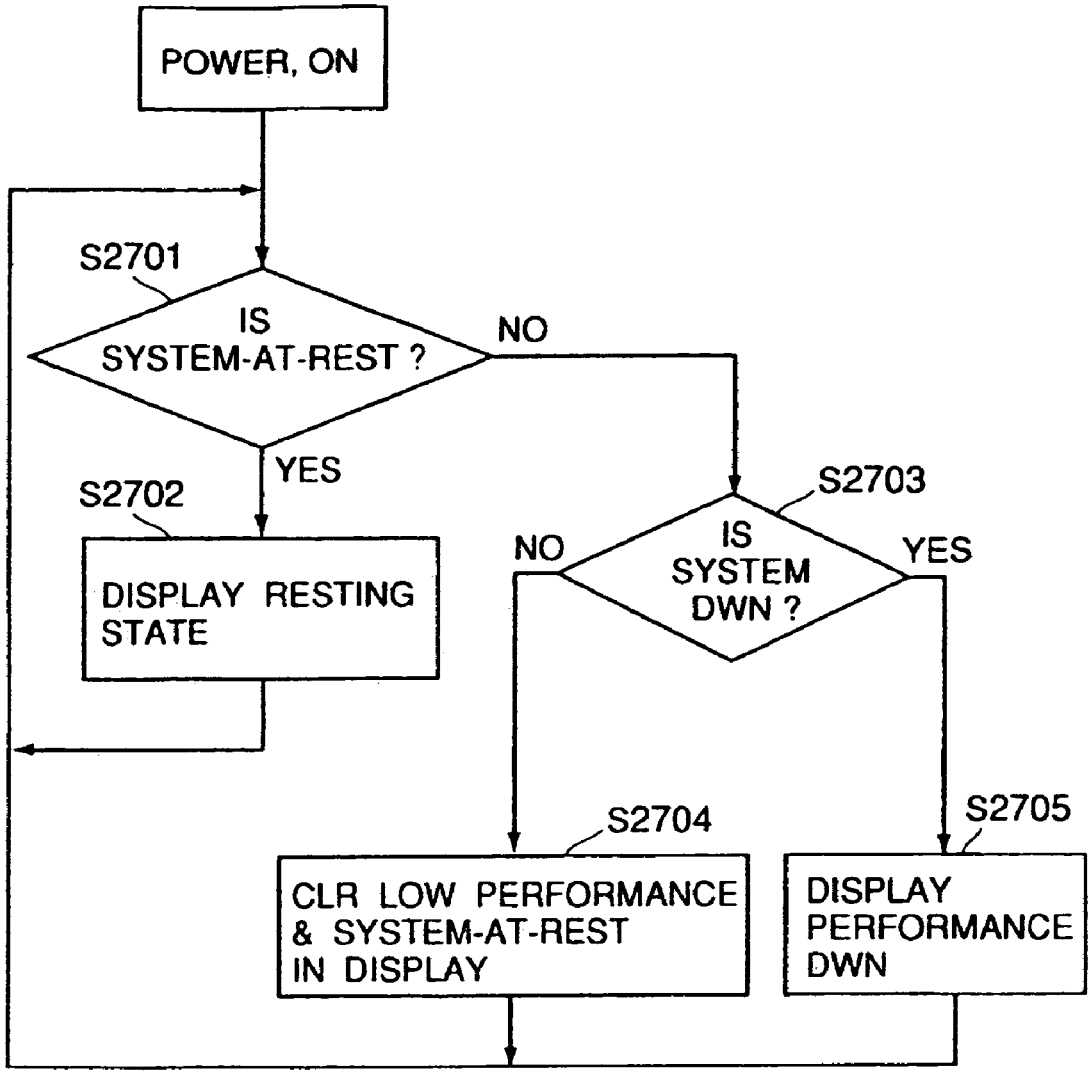
FIG. 27 is a flowchart showing the process of controlling the display which shows the conditions of the systems in the sheet processing apparatus in accordance with the present invention.
Figure 28:
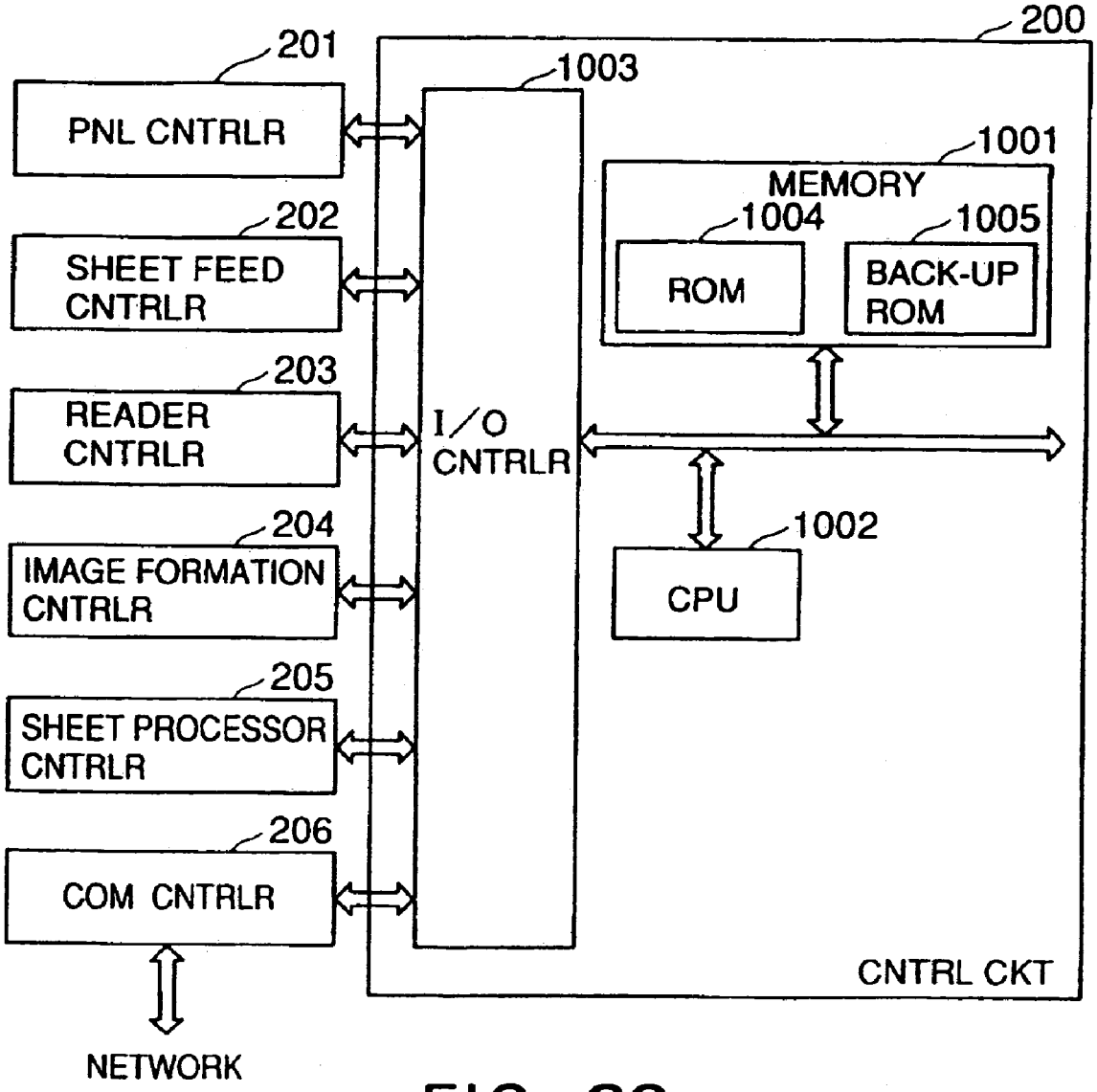
FIG. 28 is a block diagram showing the structure of the essential portion of the control portion of the copying machine in third or fourth embodiment.
Figure 29:
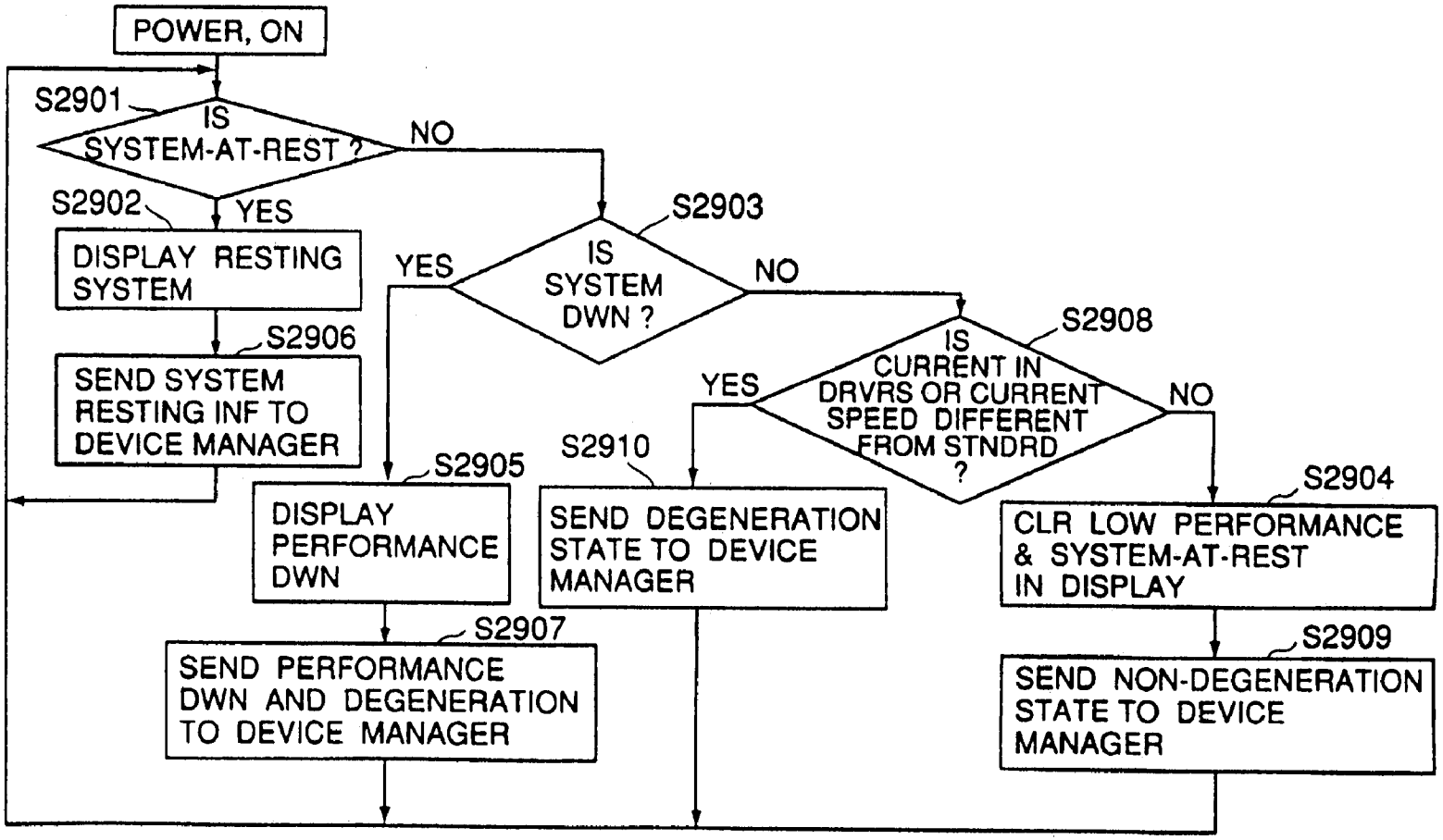
FIG. 29 is a flowchart showing the process of controlling the display which shows the condition of the system in the third embodiment.
Figure 30:
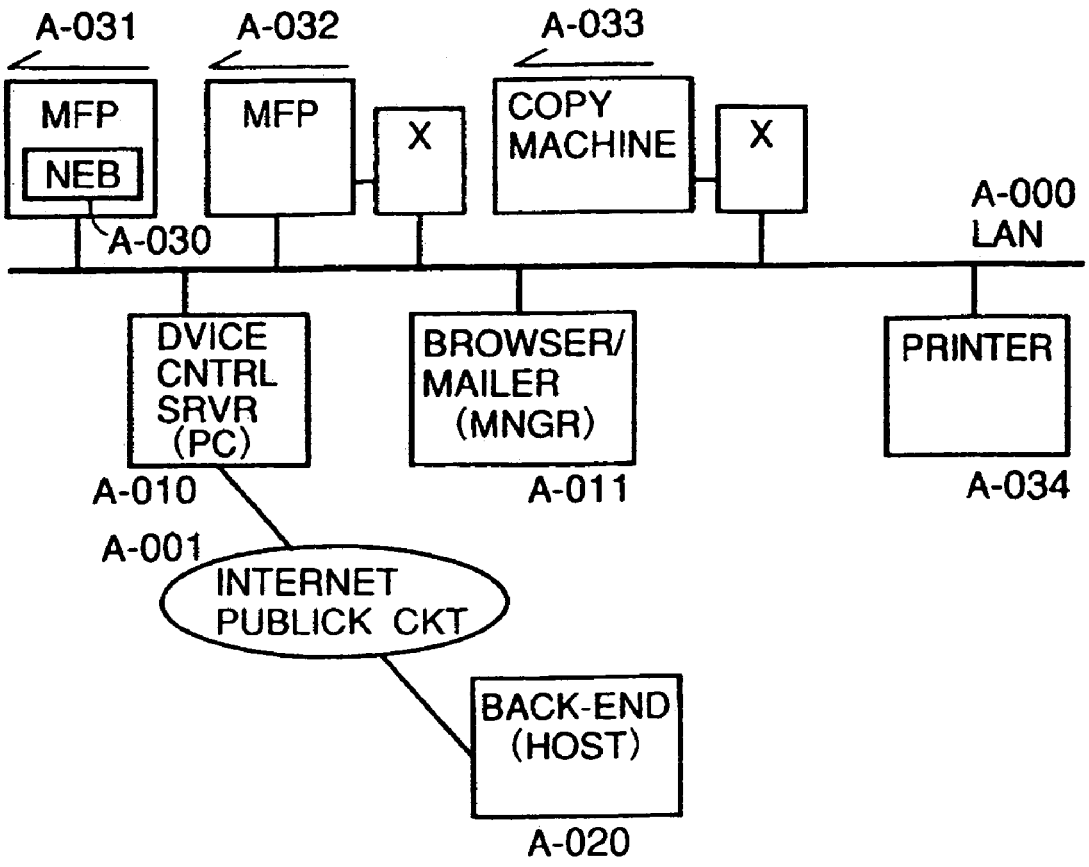
FIG. 30 is a block diagram showing an example of the network system in the third and fourth embodiments.
Figure 32:
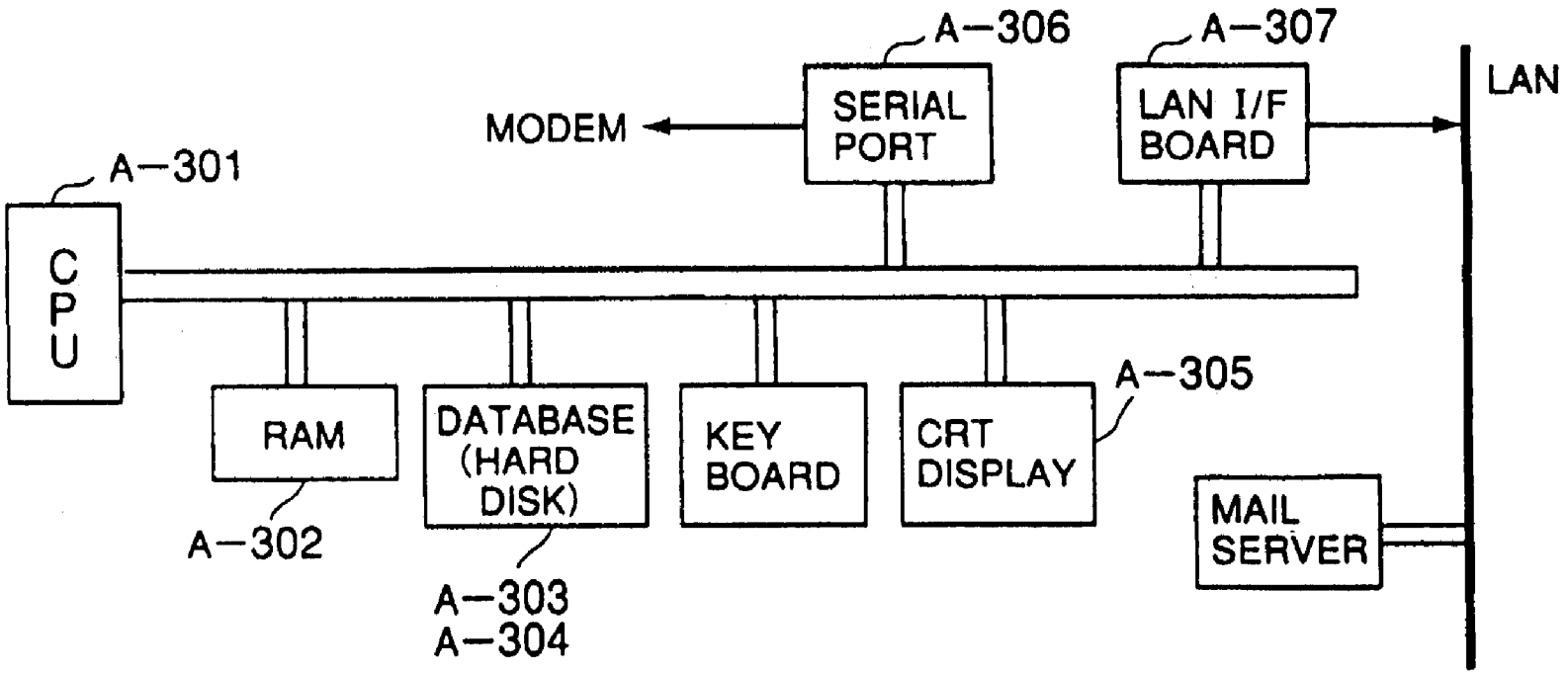
FIG. 32 is a block diagram showing an example of the structure of the device management apparatuses in the third and fourth embodiment.
Figure 33:
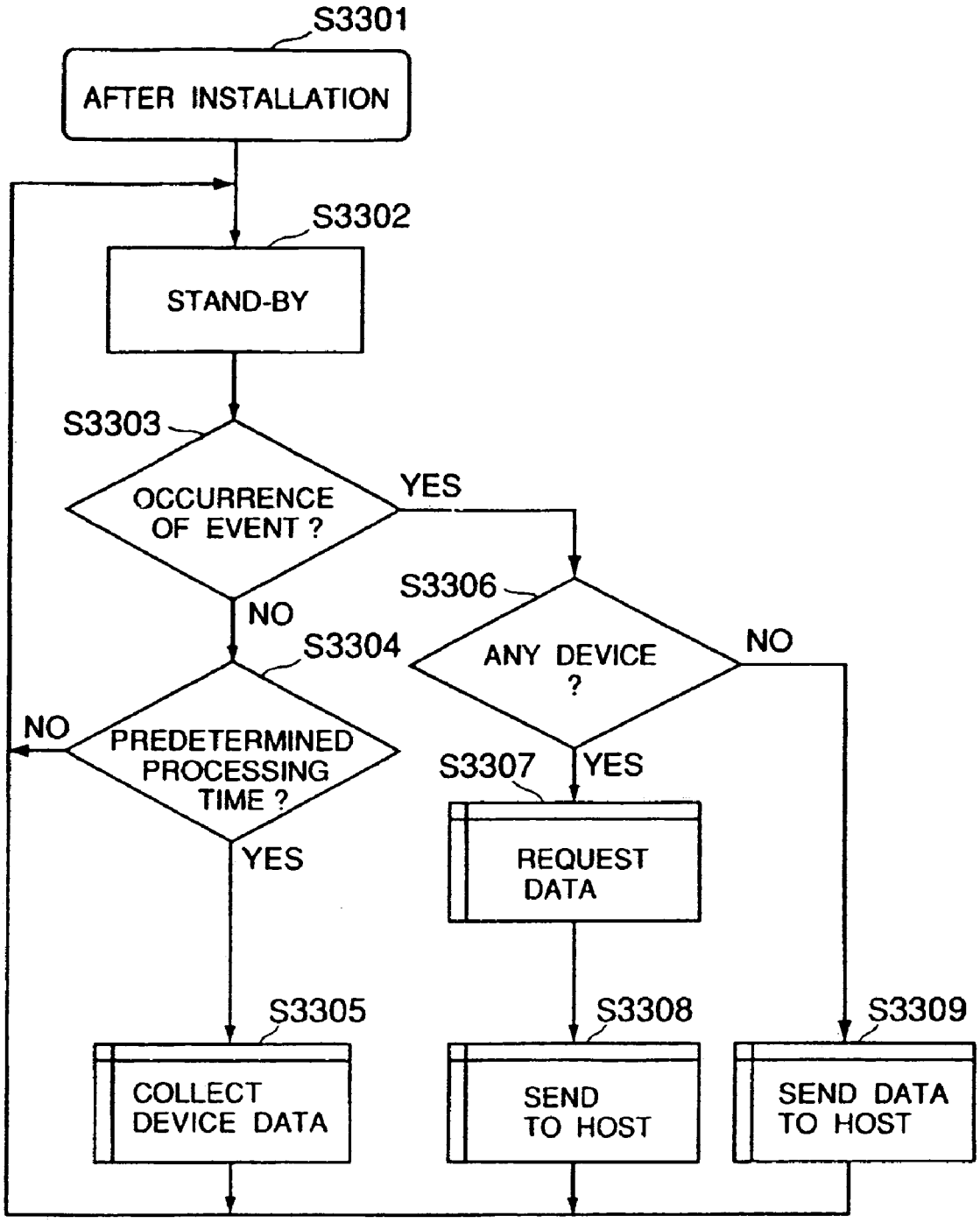
FIG. 33 is a flowchart showing the sequence carried out by the device management apparatuses in the third and fourth embodiments.
Figure 34:
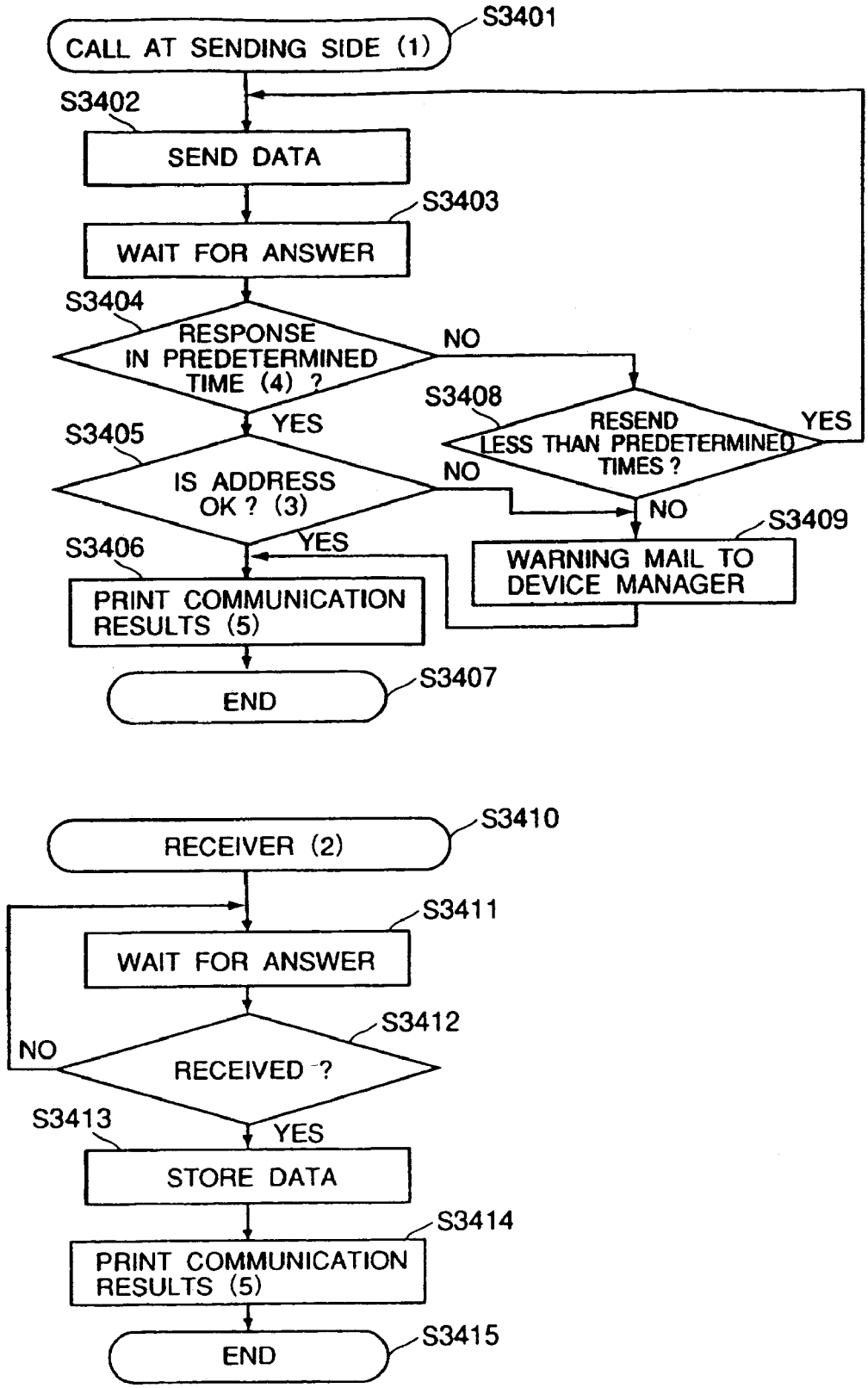
FIG. 34 is flowchart showing the communication between the device management apparatus and host carried out with the use of e-mail, in the third and fourth embodiments.
Figure 35:
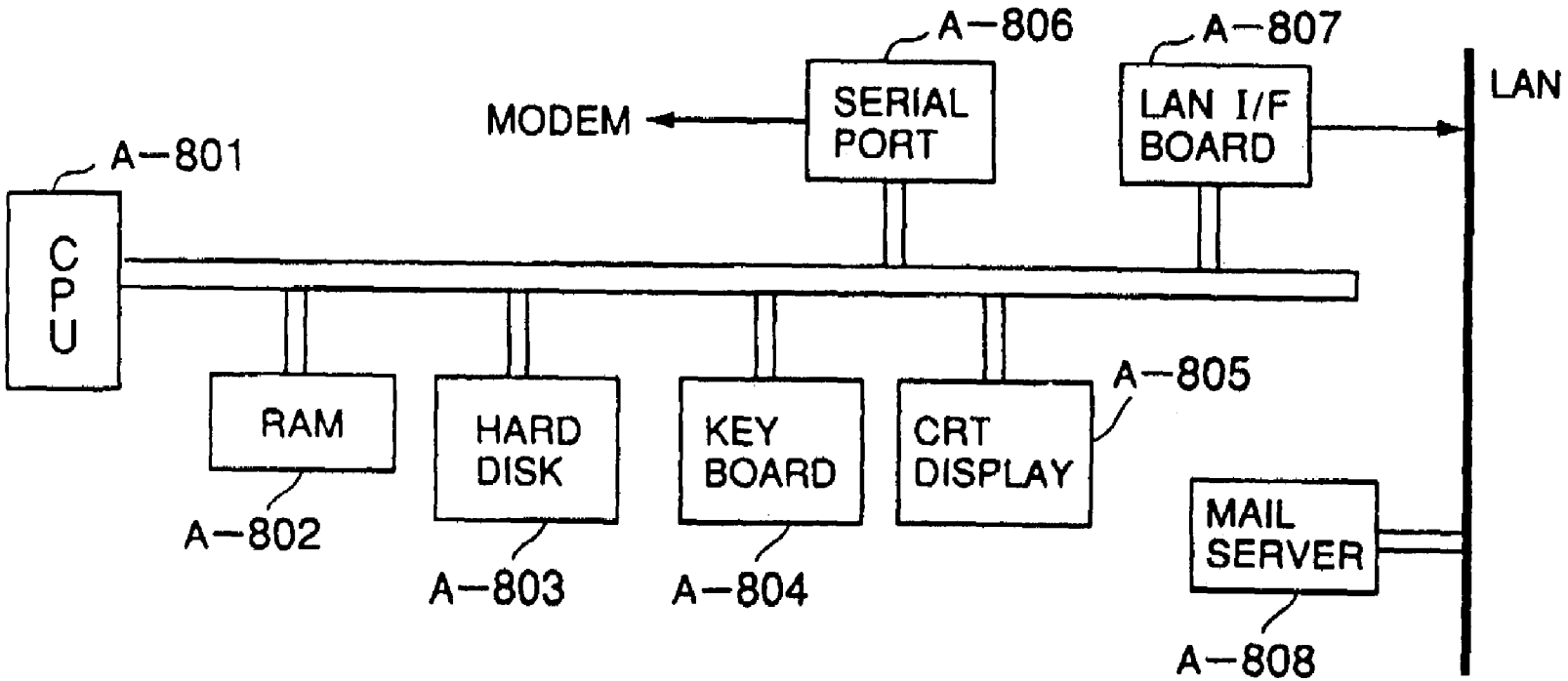
FIG. 35 is a block diagram showing an example of the structure of the host computer in the third and fourth embodiment.
Figure 36:
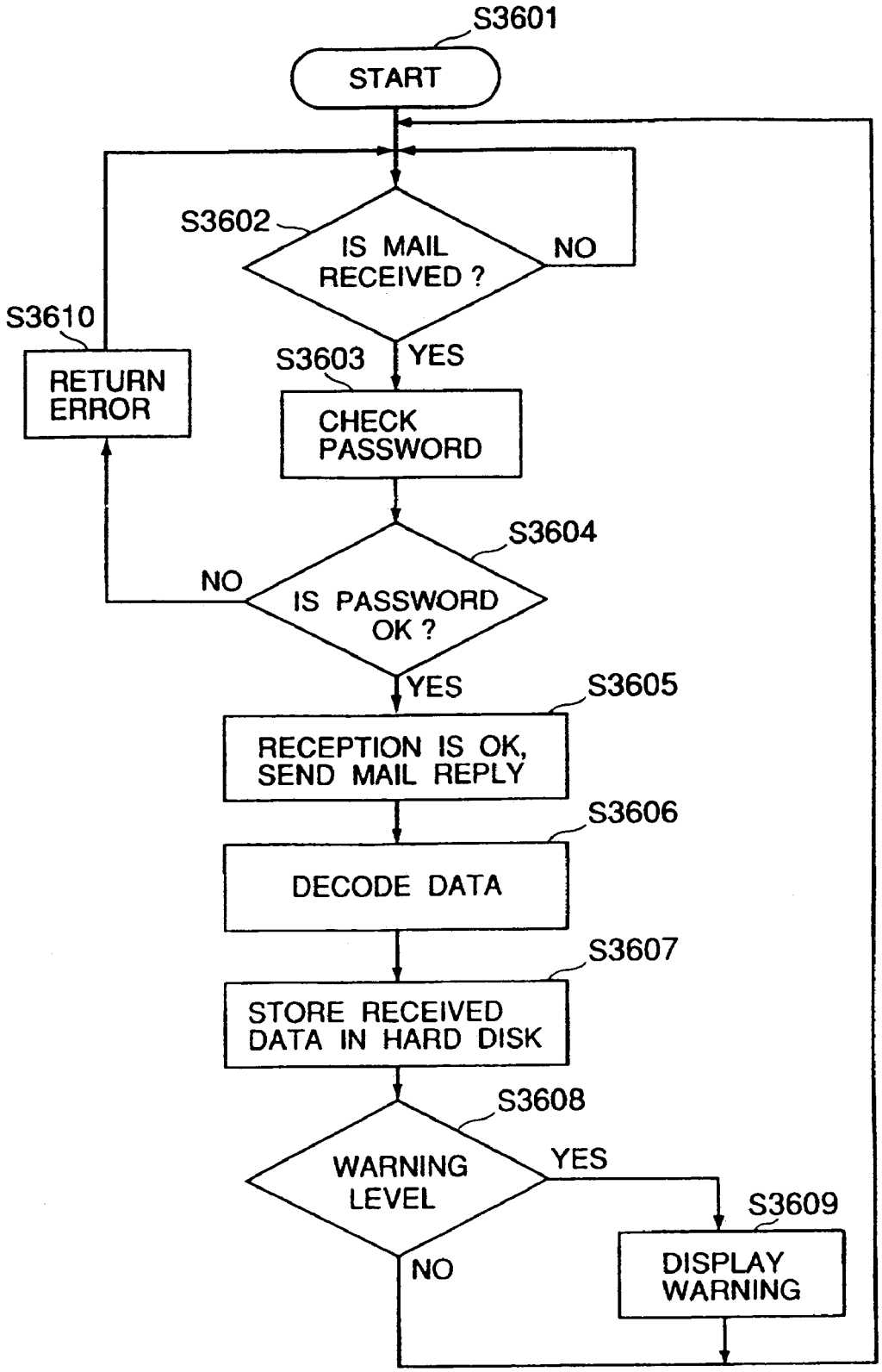
FIG. 36 is a flowchart showing the operational sequence carried out by the host computers in the third and fourth embodiments.
Figure 37:
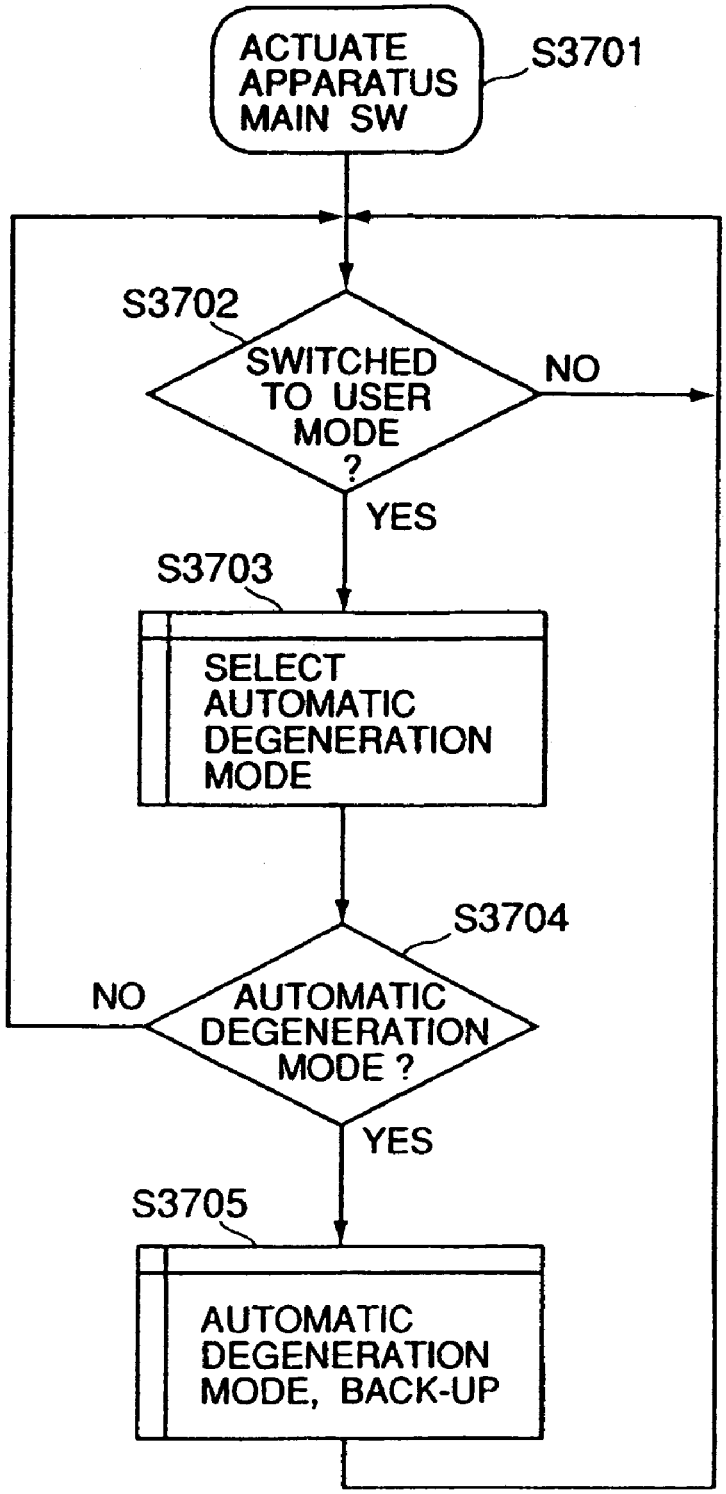
FIG. 37 is a flowchart showing the process of choosing a reduced performance (degeneration) mode through the user mode, in the third and fourth embodiments.
Figure 38:
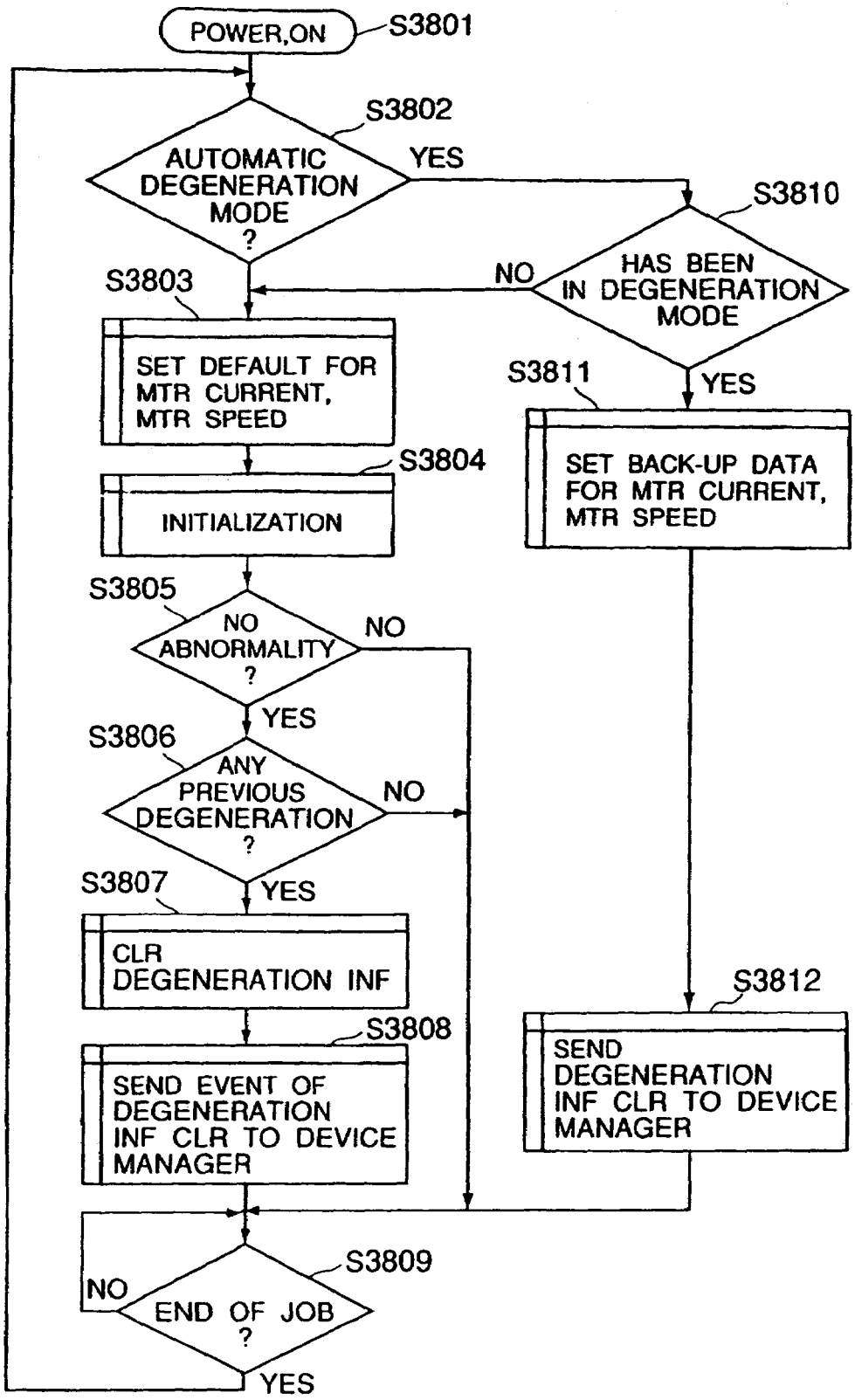
FIG. 38 is a flowchart showing the process of informing the host of the cancellation of the reduced performance mode in the sheet processing apparatus in the third and fourth embodiments.
Figure 39:
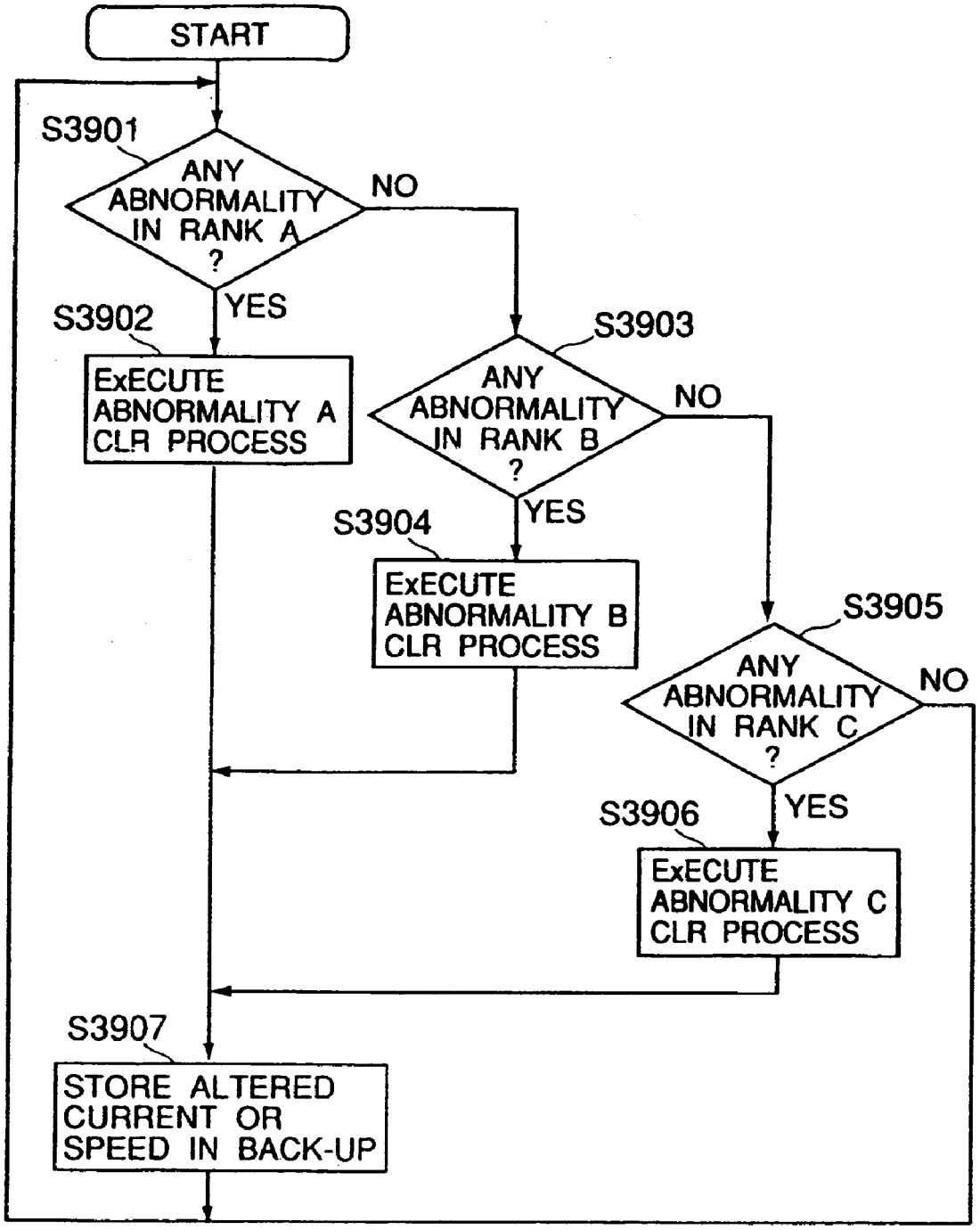
FIG. 39 is a flowchart showing the process of detecting the occurrence of abnormalities in the driving portions of the sheet processing apparatus in the fourth embodiment, and the process of managing the abnormalities.
Figure 40:
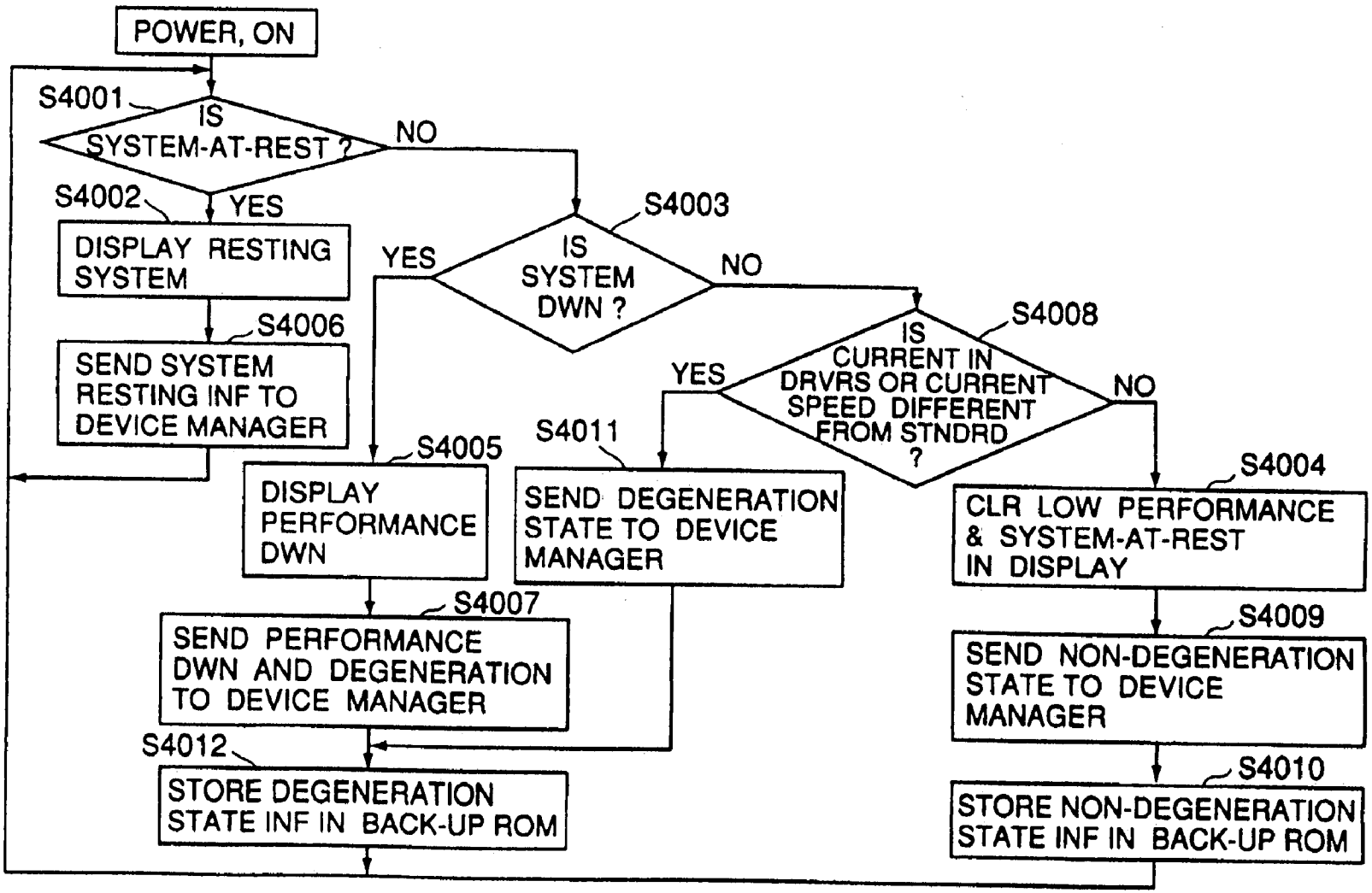
FIG. 40 is a flowchart showing the process of controlling the display which shows the condition of the system of the sheet processing apparatus in the fourth embodiment.
Figures 41, 41A:
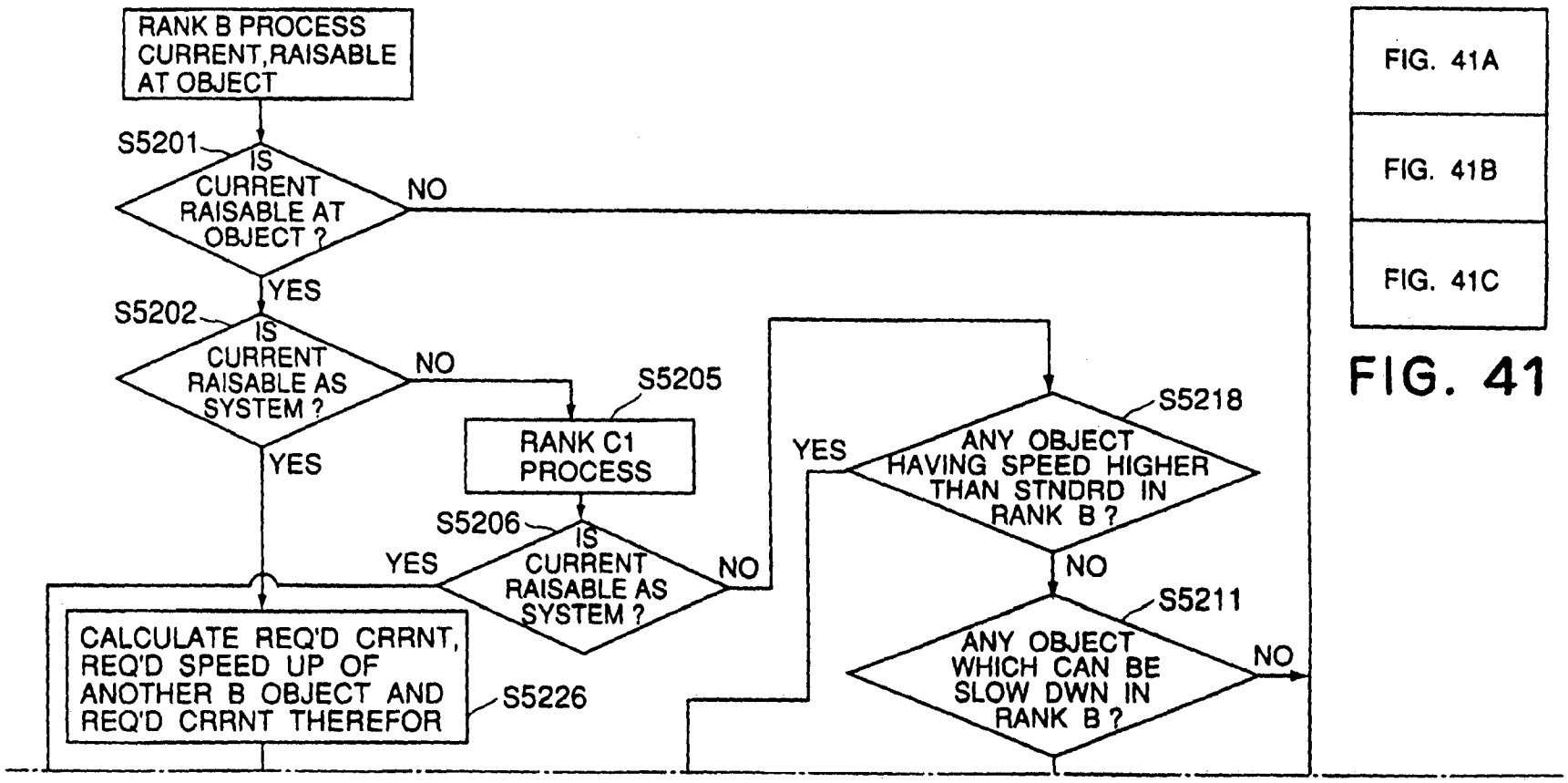
FIG. 41 is comprised of FIGS. 41A, 41B and 41C showing flowcharts for the routine (abnormality management routine B) carried out if an abnormality is detected in the B ranked driving systems in the sheet processing apparatus in accordance with the present invention.
Figure 41B:
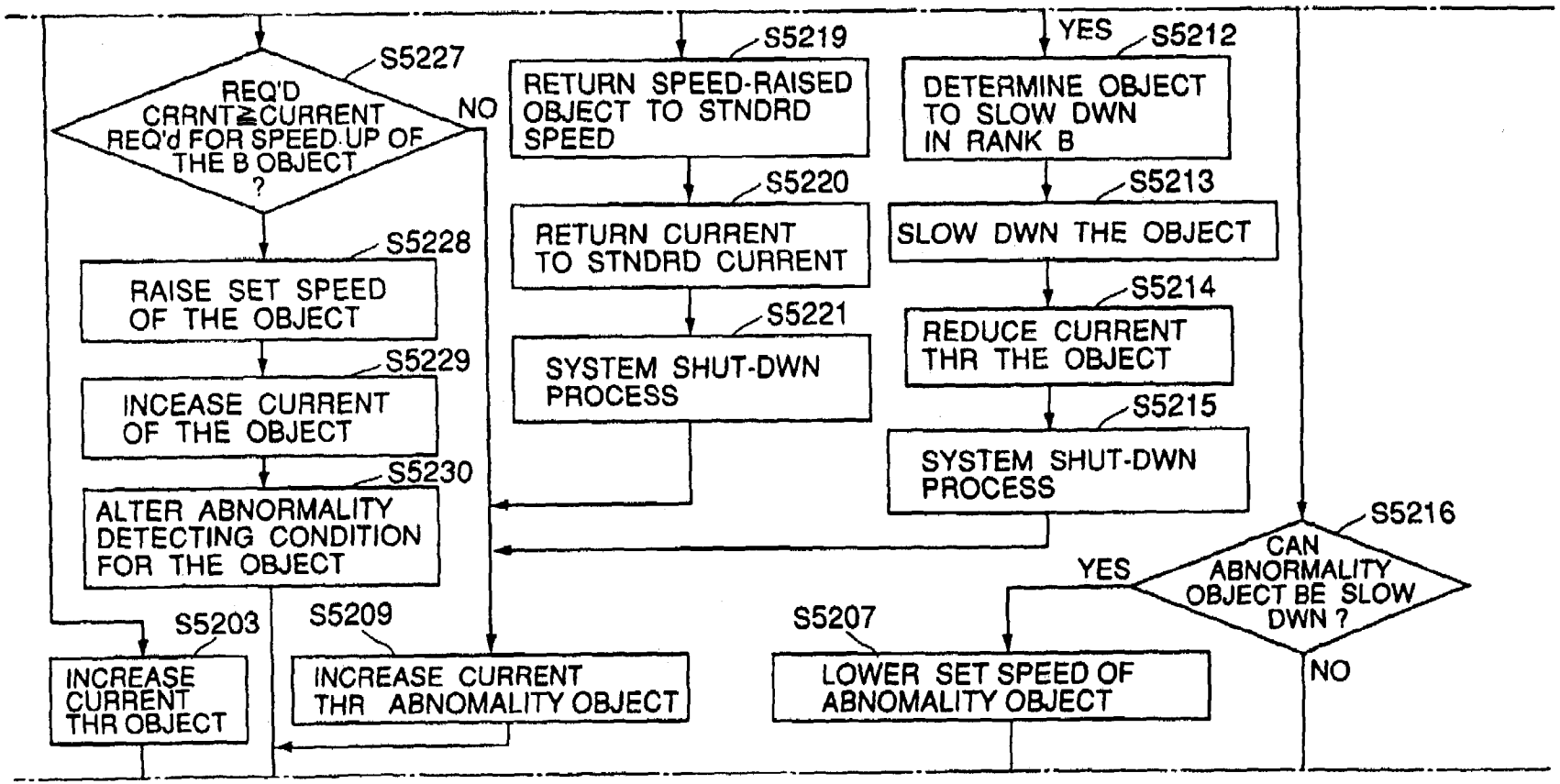
Figure 41C:
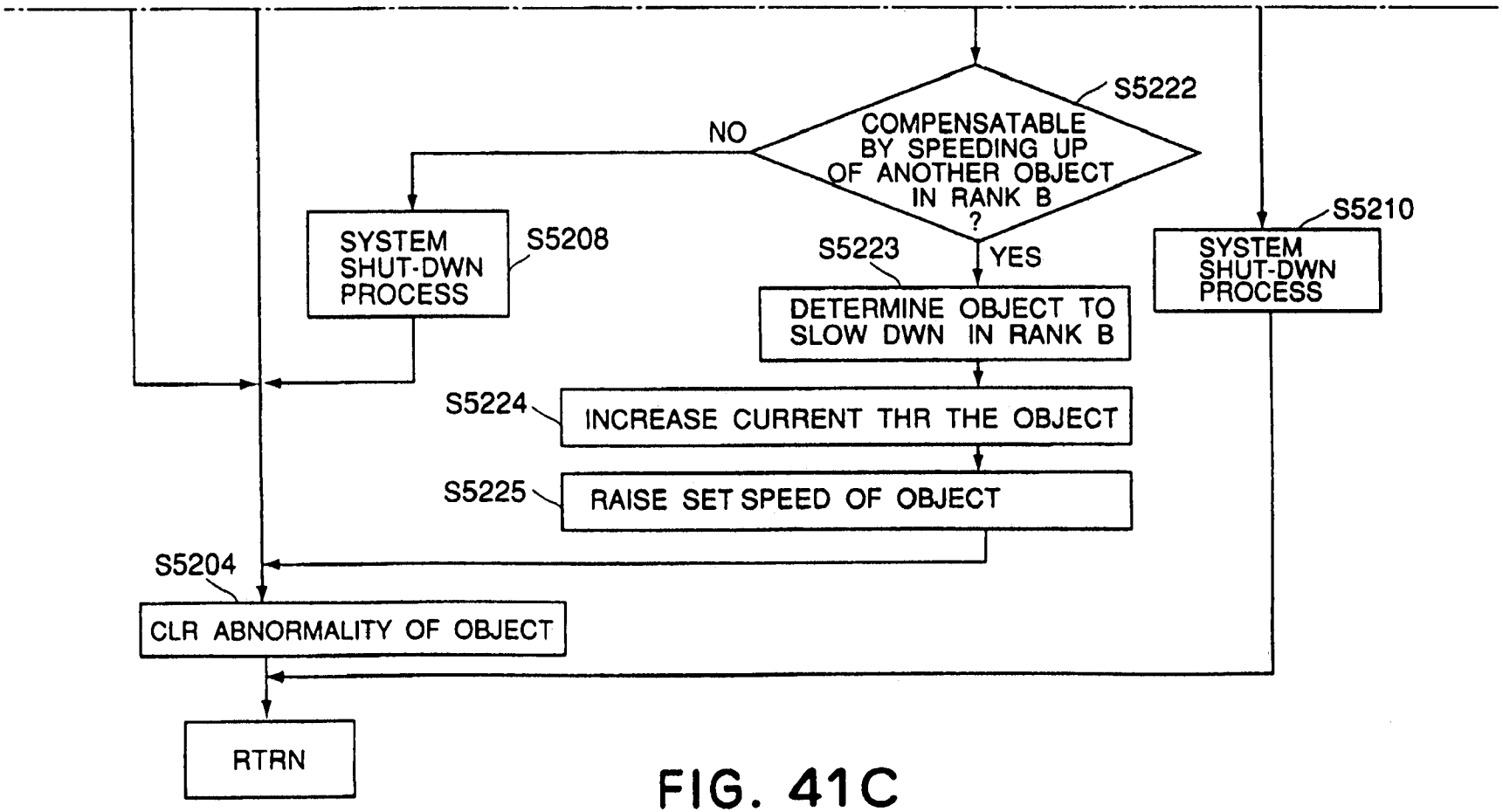
Figures 42, 42A:
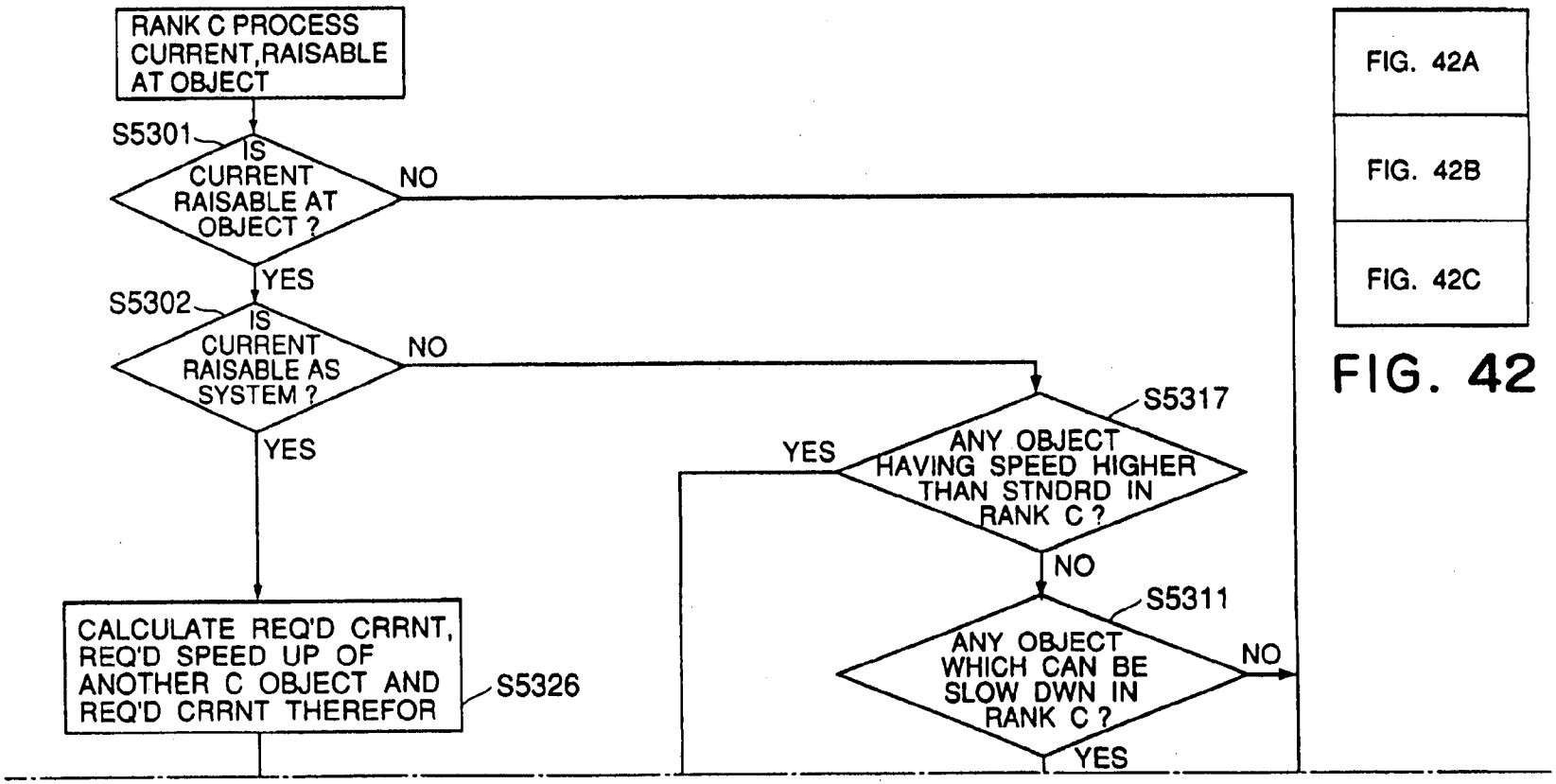
FIG. 42 is comprised FIGS. 42A, 42B and 42C showing flowcharts for the routine (abnormality management routine C) carried out if an abnormality is detected in the C ranked driving systems in the sheet processing apparatus in accordance with the present invention.
Figure 42B:
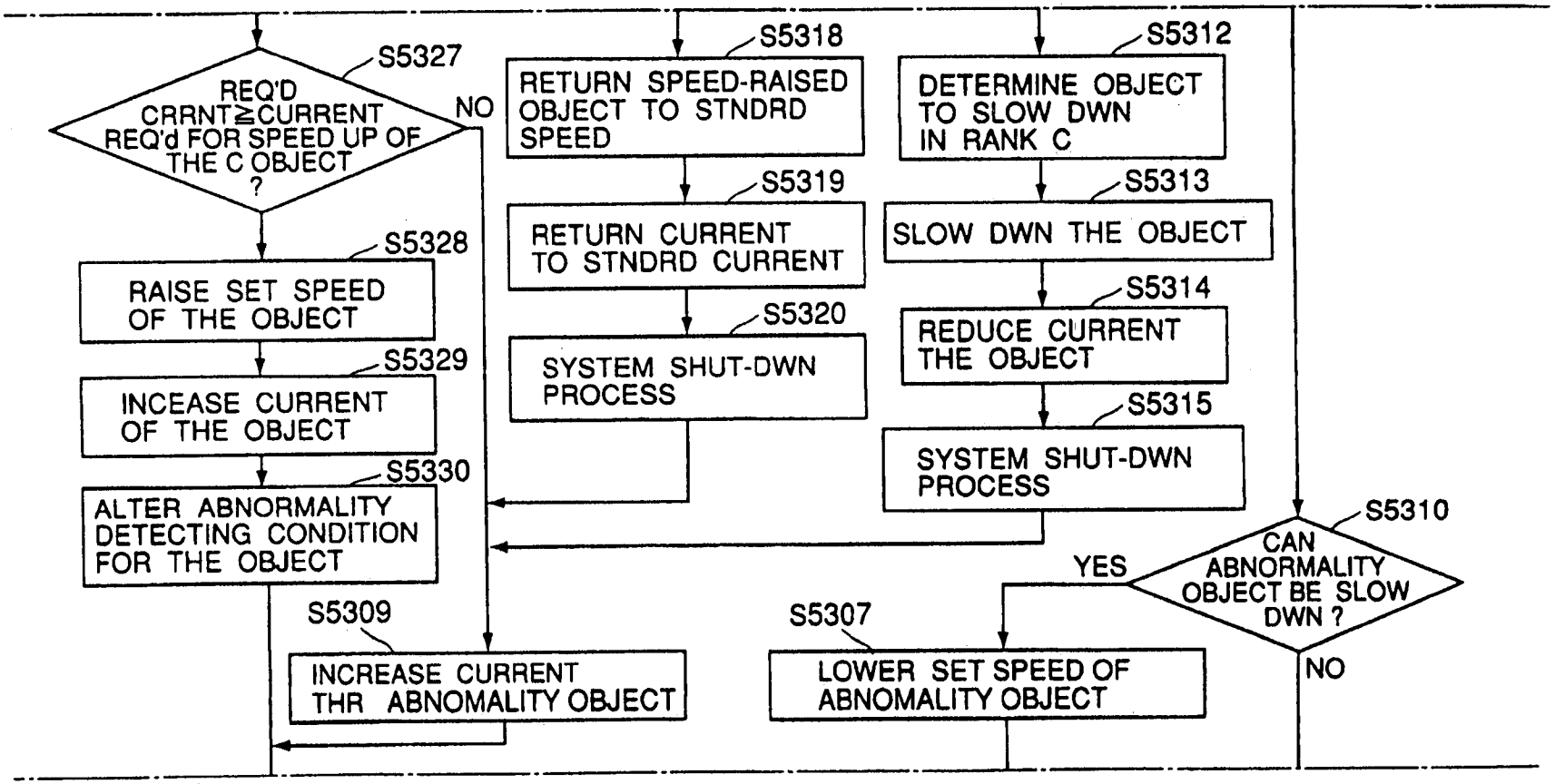
Figure 42C:
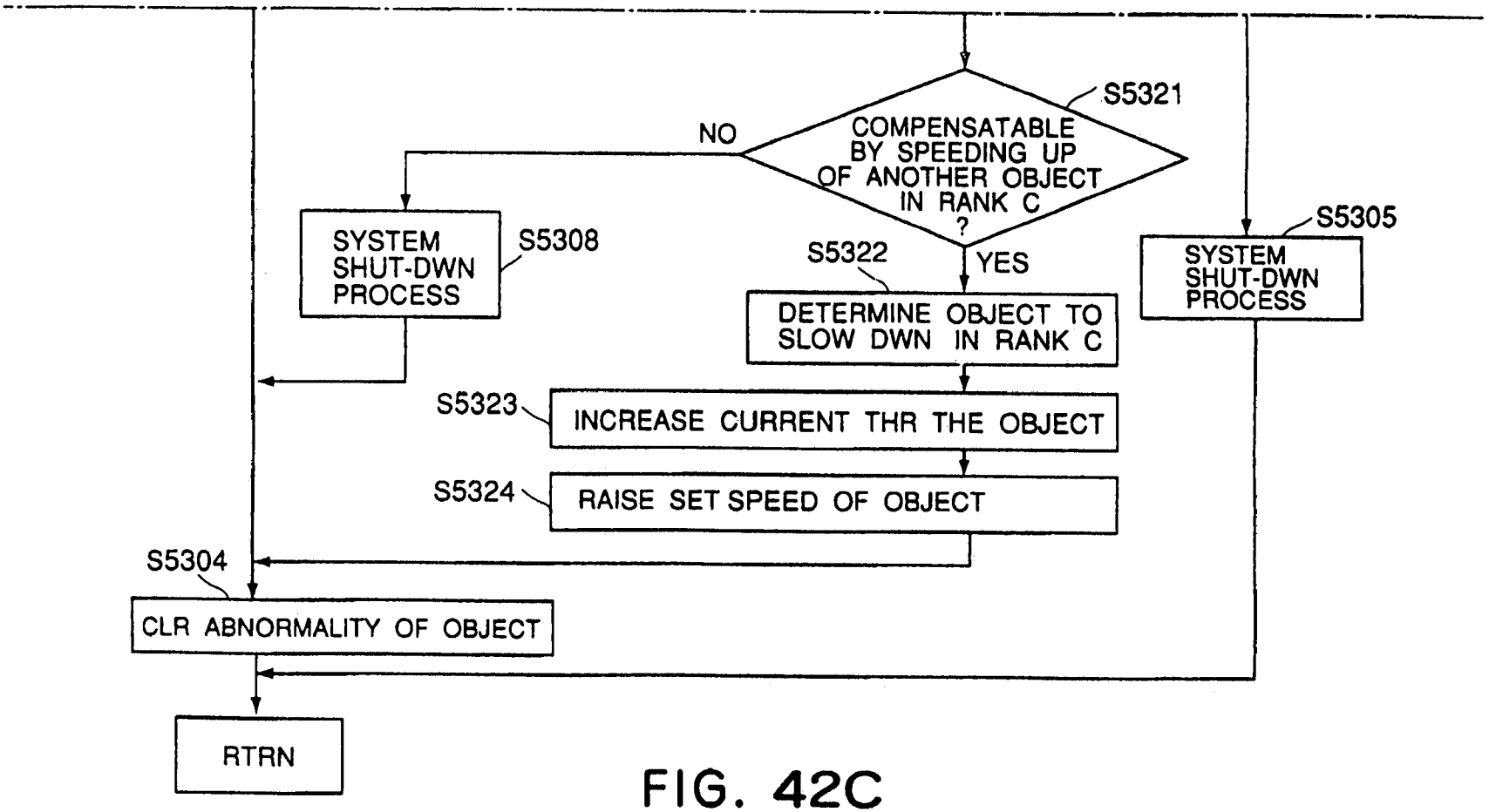

FIG. 3 is a schematic vertical view, parallel to the front panel of the sheet processing apparatus, of a flapper for switching the sheet conveyance path in the sheet processing apparatus. FIG. 4 is a schematic horizontal view of the sheet aligning apparatus of the processing tray in the sheet processing apparatus, which aligns sheets in terms of their widthwise direction. FIG. 5 is a first schematic sectional vertical view, parallel to the front panel of the sheet processing apparatus, of the stapler unit of the processing tray in the sheet processing apparatus, and FIG. 6 is a second schematic sectional vertical view, parallel with the front panel of the sheet processing apparatus, of the stapler unit of the processing tray in the sheet processing apparatus. FIG. 7 is a schematic plan view of the control panel of the reading-conveying apparatus. (*a*), (*b*), and (*c*) of FIG. 8 are drawings showing the examples of the graphic images displayed by the monitor portion of the control panel. FIG. 9 is a block diagram of the control section common to the copying machines in first and second embodiments of the present invention, for showing the structure thereof. FIG. 10 is a table showing the categories of the functions of the driving portions of the sheet processing apparatus, and an example of the ranking of the driving portions in each category, in terms of their effect upon the overall performance of the printing system. FIG. 11 is a table showing an example of the ranking among the driving portions of the sheet processing apparatus in accordance with the present invention, established based on FIG. 10. FIG. 12 is an example of a table for showing the values to which the various driving portions of a sheet processing apparatus in accordance with the present invention are set when creating a system A by connecting the sheet processing apparatus to an image forming apparatus. FIG. 13 is a table showing the values of the normal speed and normal amount of electric current of each of the various driving portions of the sheet processing apparatus in accordance with the present invention, when creating a printing system B by connecting the sheet processing apparatus to an image forming apparatus. FIG. 14 is a block diagram showing the structure of the control portion for driving the solenoid in the sheet processing apparatus in accordance with the present invention. FIG. 15 is a block diagram showing the structure of the control portion for driving the stepping motor in the sheet processing apparatus in the sheet processing apparatus. (*a*), (*b*), (*c*), and (*d*) of FIG. 16 are timing charts for showing the operational timings for sheets, a knurled belt solenoid, and an alignment motor, when the sheets are discharged into the sheet processing tray in the sheet processing apparatus in accordance with the present invention. FIG. 17 is a flowchart showing the process of detecting the abnormality of the solenoid in the sheet processing apparatus in accordance with the present invention. FIG. 18 is a flowchart showing the process of detecting the abnormality of the stepping motor of the sheet processing apparatus in accordance with the present invention. FIG. 19 is a flowchart showing the process of detecting the abnormality of the stepping motor, based on the revolution of the stepping motor detected by the encoder, in the sheet processing apparatus in accordance with the present invention. FIG. 20 is a flowchart showing the process of detecting the occurrence of abnormalities in the driving system, and the process of managing the abnormalities, in the sheet processing apparatus in accordance with the present invention. FIG. 21 is a flowchart showing the routine (abnormality management routine A) carried out if an abnormality is detected in the A ranked driving systems in the sheet processing apparatus in accordance with the present invention. FIGS. 22A, 22B and 22C are flowcharts showing the routine (abnormality management routine B) carried out if an abnormality is detected in the B ranked driving systems in the sheet processing apparatus in accordance with the present invention. FIGS. 23A, 23B and 23C are flowcharts showing the routine (abnormality management routine C) carried out if an abnormality is detected in the C ranked driving systems in the sheet processing apparatus in accordance with the present invention. FIG. 24 is a flowchart showing the abnormality management routine B1, which branches from the abnormality management routine A, and which is carried out if an abnormality is detected in the A ranked driving systems in the sheet processing apparatus in accordance with the present invention. FIG. 25 is a flowchart showing the abnormality management routine C1, which branches from the abnormality management routine A, and which is carried out if an abnormality is detected in the A ranked driving systems in the sheet processing apparatus in accordance with the present invention. FIG. 26 is a flowchart showing the process of detecting an abnormality in each of the driving portions in the sheet processing apparatus in accordance with the present invention, and the process of controlling the abnormality management process. FIG. 27 is a flowchart showing the process of controlling the display which shows the conditions of the systems in the sheet processing apparatus in accordance with the present invention. FIG. 28 is a block diagram showing the structure of the essential portion of the control portion of the copying machine in third or fourth embodiment. FIG. 29 is a flowchart showing the process of, controlling the display which shows the condition of the system in the third embodiment. FIG. 30 is a block diagram showing an example of the network system in the third and fourth embodiments. FIG. 31 is a table showing examples of the data transmitted through the network, and examples of devices to which the data are transmitted. FIG. 32 is a block diagram showing an example of the structure of the device management apparatuses in the third and fourth embodiment. FIG. 33 is a flowchart showing the sequence carried out by the device management apparatuses in the third and fourth embodiments. FIG. 34 is flowchart showing the communication between the device management apparatus and host carried out with the use of e-mail, in the third and fourth embodiments. FIG. 35 is a block diagram showing an example of the structure of the host computer in the third and fourth embodiment. FIG. 36 is a flowchart showing the operational sequence carried out by the host computers in the third and fourth embodiments. FIG. 37 is a flowchart showing the process of choosing a reduced performance (degeneration) mode through the user mode, in the third and fourth embodiments. FIG. 38 is a flowchart showing the process of informing the host of the cancellation of the reduced performance mode in the sheet processing apparatus in the third and fourth embodiments. FIG. 39 is a flowchart showing the process of detecting the occurrence of abnormalities in the driving portions of the sheet processing apparatus in the fourth embodiment, and the process of managing the abnormalities. FIG. 40 is a flowchart showing the process of controlling the display which shows the condition of the system of the sheet processing apparatus in the fourth embodiment. FIGS. 41A, 41B and 41C are flowcharts showing the routine (abnormality management routine B) carried out if an abnormality is detected in the B ranked driving systems in the sheet processing apparatus in accordance with the present invention. FIGS. 42A, 42B and 42C are flowcharts showing the routine (abnormality management routine C) carried out if an abnormality is detected in the C ranked driving systems in the sheet processing apparatus in accordance with the present invention.

(Embodiment 1)

Next, the driving apparatus in accordance with the present invention, the sheet processing apparatus having the driving apparatus, and the copying machine, as an example of an image forming apparatus, having the sheet processing apparatus, will be described with reference to the appended drawings.

The driving apparatus in accordance with the present invention comprises: a plurality of driving means; a plurality of operational abnormality detecting means corresponding one for one to the plurality of driving means; a plurality of electric current controlling means for setting the amount of electric current supplied to the plurality of driving means, one for one; and a controlling means which controls the plurality of driving means, operational abnormality detecting means, electric current controlling means, by setting the normal electric current value, maximum electric current value, normal speed value, minimum rotational velocity value, maximum speed value, for each driving means, and total amount of the electric currents allowed to flow through the plurality of driving means, one for one, and establishing the priority ranking for each driving means based on their effect upon the overall performance of the printing system, wherein (a) as an operational abnormality is detected in a given driving means by the operational abnormality detecting means, the controlling means increases the amount of the electric current supplied to this driving means, within the limit of the aforementioned maximum electric current value and the limit of the total electric current value, and (b) if an operational abnormality is detected in a given driving means by the operational abnormality detecting means, and increasing the amount of the electric current supplied to the driving means in which the abnormality was detected, causes the amount of the electric current supplied thereto, to exceeds the maximum electric current limit therefor, not only does the controlling means sets the driving speed of this driving means to a value, at which the rotational velocity of the driving means remains above its minimum rotational velocity, but also increases the driving speeds of one or more of the driving means, other than the driving means in which the abnormality was detected, selected based on the above described priority ranking, to values no higher than the values of their maximum speed limits, and also, increases the amount of the electric current supplied thereto, in proportion to their newly set driving speeds, so that the productivity of the system does not decline.

The present invention is characterized in that a sheet processing apparatus internally comprising a driving apparatus having the above described functions is connected to an image forming apparatus, for example, a copying machine.

FIG. 1 is a schematic sectional view of the main assembly 102 of a copying machine, equipped with a sheet processing apparatus 103 having a driving apparatus in accordance with the present invention, at a plane parallel with the front panel of the main assembly 102. The sheet processing apparatus 103 is designed so that not only can it be connected to the main assembly of a copying machine, but also it can be connected the main assembly of an image forming apparatus other than a copying machine, for example, a facsimile machine, a printer, and various combinations of the preceding machines, capable of performing two or more of the functions of the preceding machines.

The copying machine main assembly 102 is equipped with an original feeding-reading apparatus 101, which is on top of the copying machine main assembly 102. The original feeding-reading apparatus comprises; an automatic conveying portion 51, which conveys each original P from a tray 67, in which a single or plurality of originals P are placed, to the original reading position of the top surface of an original placement platen 78, and conveys later to the original discharging position; a lamp 79 for projecting light onto the original P on the original reading position of the platen 78; a CCD line sensor 76 for detecting the image of the original P; three mirrors 72, 73, and 74 for guiding the light reflected by the original P to the CCD ling sensor 76; a lens 75 for forming the image of the original P on the CCD line sensor 76; etc.

The copying machine main assembly 102 also comprises: a pair of sheet storage portions 53 and 54 for holding sheets S (S1 and S2, respectively), which are located in the bottom portion of the main assembly 102; and sheet feeding portions 55 and 56 for feeding the sheets S into the main assembly 102. After being fed into the main assembly 102, each sheet S is conveyed to a sheet conveyance path 60 through a sheet conveyance path 57. The laser scanner 61 projects a beam of laser light, while modulating it with the image formation information read by an optical system 52 comprising the above described lamp 79, CCD line sensor 76, three mirrors 72, 73 and 74, lens 75, etc., onto a photoconductive drum 66 in the image forming portion (image forming means) 62, forming a latent image (which will be developed into toner image) on the photoconductive drum 66.

The image forming portion 62 is capable of transferring the toner image formed on the photoconductive drum 66, onto the sheet S. After the transfer of the toner image onto the sheet S by the image forming portion 62, the sheet S is conveyed past the conveying belt 63, a fixing roller 64 for fixing (thermally welding) the unfixed toner image on the sheet S to the sheet S, and then, is conveyed to the conveyance path of the sheet processing apparatus 103 by a pair of rollers 65.

A control portion 301 allows an operator to select the operational modes of each of the various apparatuses in the copying machine main assembly 102, and the operation of the sheet processing apparatus 013, and also to confirm the selected operational modes. Referring to FIG. 7, the control portion 301 has a monitor portion 306 (for displaying graphic images such as those shown in (*a*), (*b*) and (*c*) of FIG. 8) for confirming the details of the selected operational modes, and a touch panel keyboard portion disposed, in the overlapping manner, across the monitor portion to allow the operator to set the details of the selected image forming operation, and the details of the selected sorting operation, etc., and a numerical keyboard 303 for setting numerical values, for example, the number of the copies to be produced, etc.; a stop key 305 for stopping the ongoing image forming operation; a reset key for restoring the settings of the image forming apparatus and sheet processing apparatus to the default setting; and a start key 302 for starting an image forming apparatus. The control portion 301 also comprises a user mode key 307 for allowing the user to set up in detail the operations particular to the user.

The sheet processing apparatus 103 is structured so that as the sheet S is delivered from the copying machine main assembly 102 to the sheet processing apparatus 103, it is received by a pair of conveyance rollers (sheet conveying means) 1. This pair of conveyance rollers (sheet conveying means) 1, a pair of conveyance rollers (sheet conveying means) 2, and a pair of conveyance rollers (sheet conveying means) 3 are driven by an entry conveyance motor 50, which is a stepping motor, in order to convey thereby the sheet S.

A sheet detection sensor (sheet detecting means) 31 detects the presence of the sheet S as it is conveyed past the sensor 31.

Referring to FIG. 1, the sheet processing apparatus 103 comprises a buffer roller (sheet conveying means) 5, which is relatively large in diameter, and which is disposed in the middle of the sheet conveyance path. The buffer roller 5 is rotated by driving a buffer motor 59, which also is a stepping motor. The sheet processing apparatus 103 also comprises a plurality of sheet holding rollers 12, 13, and 14, which are kept pressed on the peripheral surface of the buffer roller 5, so that as the buffer roller 5 is rotated, the sheet S is conveyed while being kept pressed on the peripheral surface of the buffer roller 5 by the sheet holding rollers 12, 13, and 14.

A first switching flapper 11 is driven by a flapper 1 solenoid 34, and is used to make a switch between the non-sorting path 4 and sorting path 8. The second switching flapper 10 is driven by a flapper 2 solenoid 35, and is used to make a switch between a buffer path 23 for temporarily storing the sheet S, and the sorting path 8.

A sheet detection sensor 33 detects the sheet S while the sheet S is in the non-sorting path 4, whereas a sheet sensor 32 detects the sheet S while the sheet S is in the sorting path 8.

The conveyance roller pair 6 is disposed along the sorting path 8. The first discharge roller pair 7 is also disposed along the sorting path 8 to discharge the sheet S onto the processing tray 130. The second discharge roller pair 9 is disposed along the non-sorting path 4 to discharge the sheet S onto the sample tray 85. The conveyance roller pair 6, the first discharge roller pair 7, and the second discharge roller pair 9 are driven by a sheet discharge motor 49, which also is a stepping motor. Around the bottom roller of the first discharge roller pair 7, a plurality of knurled belts 190 are fitted in parallel, with the presence of predetermined intervals in terms of the width direction of the sheet S, and are driven by a/knurled belt solenoid switch 192.

Next, referring to FIGS. 2(*a*) and 2(*b*), the knurled belt 190 will be described.

Each knurled belt 190 is in the endless form, and has a predetermined length. The entirety of its peripheral surface is covered with slip prevention knurls 190*a*. It is elastic, and can be deformed in its diameter direction. Normally, it assumes the shape of a virtual true circle. The knurled belt 190 is rotationally supported by the discharge roller 7*a*, that is, the roller on the process tray 130 side, of the first discharge roller pair 7, by being wrapped around the discharge roller 7*a* in a manner to be pinched by the two rollers of the first discharge roller pair 7. The knurled belt 190 is also wrapped around an idler roller 191 located below the discharge roller 7*a*, with the internal surface of the knurled belt 190 remaining in contact with the idler roller 191. The idler roller 191 is pulled by a solenoid 192 for tensioning the knurled belt 190, before a sheet aligning apparatus 140 is activated to align the sheets in the processing tray, in terms of the width direction of the sheets. The knurled belt 191 is pulled in the downstream direction by the idler roller 191, being deformed as shown in FIG. 2(*a*) so that it does not interfere with the jogging (aligning) of the sheet S.

Referring to FIGS. 2(*a*) and 2(*b*), when the knurled belt 190 is not being pulled by the solenoid 192, the bottom portion of the knurled belt 190 is close to the top surface of the processing tray 130 (protruding position). In the drawings, the gap between the knurled belt 190 and processing tray 130 is exaggerated to clearly show the gap. In reality, however, the gap is much smaller.

Referring to FIG. 2(*a*), as the knurled belt 190 is pulled by the solenoid 192, it deforms into the shape (retracted position) contoured by the dotted line, so that it is prevented from contacting the sheets S on the processing tray 130.

After being discharged by the first discharge roller pair 7, the trailing edge of the sheet S is guided downward by the weight of the sheet S itself and the rotation of the knurled belt 190, and then, it falls onto the processing tray 130.

After being discharged onto the processing tray 130, the sheet S is aligned by the widthwise aligning apparatus 140 so that the edges of the sheet S, perpendicular to the sheet conveyance direction, coincide with the edges of the sheets S in the processing tray 130 with respect to the direction perpendicular to the sheet conveyance direction (widthwise direction alignment). When the sheet S is aligned, the knurled belt 190 is pulled rightward by a predetermined distance by the knurled belt solenoid 192 as shown in FIG. 2(*a*) in order to prevent the knurled belt 190 from interfering with the alignment. In other words, the knurled belt 190 is deformed in order to move the bottom side of the knurled belt 190 in the direction to increase its distance from the processing tray 130 to prevent the knurled belt 190 from contacting the top surface of the stack of sheets S on the processing tray 130. Therefore, it is assured that the sheet S is properly aligned by the widthwise aligning apparatus.

The processing tray unit is tilted so that the downstream end (left side in FIG. 1), in terms of the sheet discharge direction, of the processing tray unit is positioned higher than the upstream end (right side in FIG. 1). It comprises an intermediary tray (which hereinafter will be referred to as processing tray) 130, widthwise aligning apparatus 140, and a stapler unit 80.

The processing tray 130 is provided for temporarily accumulating two or more sheets S, so that the accumulated sheets S can be aligned by the widthwise aligning apparatus 140 by their left and right edges with respect to the widthwise direction (direction perpendicular to sheet conveyance direction), and also so that the aligned sheets S can be stapled by the stapler unit 80.

Next, referring to FIG. 4, the widthwise aligning apparatus 140 will be described.

As shown in FIG. 4, the widthwise aligning apparatus 140 comprises a pair of aligning members, that is, first and second aligning members 141 and 142, which are disposed in parallel on the end portions, one for one, in terms of the direction perpendicular to the sheet direction, of the processing tray 130. The first and second aligning members 141 and 142 have aligning surfaces 141*a* and 142*a*, respectively, which are perpendicular to the top surface of the processing tray 130, and which are pressed on the edges of the sheets S to align the sheets S with respect to the direction perpendicular to the sheet conveyance direction. The first and second aligning members 141 and 142 also have racks 141*b* and 142*b*, respectively, for supporting the sheets S from underneath. The racks 141*b* and 142*b* are fitted in a pair of guiding holes 130*b* and 130*c* of the processing tray 130, which extend in the direction perpendicular to the sheet conveyance direction. The racks 141*b* and 142*b* protrude downward from the bottom surface of the processing tray 130 through the holes 130*b* and 130*c*.

In other words, on the top side of the processing tray 130, the aligning surfaces 141*a* and 142*b* are parallel to each other, and oppose each other, whereas on the bottom side of the processing tray 130, the racks 141*b* and 142*b* are disposed so that they can be moved in the direction perpendicular to the sheet conveyance direction (direction in which sheets S are moved for alignment).

The racks 141*b* and 142*b* are meshed with pinion gears 143 and 144, respectively, attached to the bottom side of the processing tray 130. The pinion gears 143 and 144 can be rotated in the forward or backward direction by motors M141 and M142, respectively. As the pinion gears 143 and 144 are rotated forward or in reverse by the motors M141 and M142, the first and second aligning members 141 and 142 are moved in the corresponding sheet joggling (aligning) direction. The processing tray 130 also comprises first and second aligning member home position sensors (aligning member position detection sensors) 145 and 146, which are located at the home positions of the first and second aligning members 141 and 142, respectively. Normally, the first and second aligning members 141 and 142 are on standby at their home positions, as shown in FIG. 4, at which the distance between the two aligning members 141 and 142 is largest.

Next, referring to FIGS. 5 and 6, the stapler unit 80 will be described.

A stapler (binding means) 1010 is fixed to the top surface of a movable table 1030, with the interposition of a holder 102. The movable table 1030 has a set of stud shafts 104 fixed so that it becomes parallel to the rear edge of the sheet S on the processing tray 130. Each stud shaft 104 has rollers 106 and 107, which are rotationally attached to the stud shaft 104. The rollers 106 and 107 are movably fitted, respectively, in guiding rails 108*a*, 108*b*, and 108*c*, in the form of an elongated hole cut in parallel in an anchoring table 108. The rollers 106 and 107 have flanges 106*a* and 107*a*, respectively, the diameters of which are greater than the widths of the guiding rails (holes) 108*a*, 108*b*, and 108*c*. The movable table 1030 holding the stapler 1010 is provided with rollers 109 attached to the three locations, one for one, on the bottom side of the movable table 1030. The movable table 1030 is moved on the anchoring table 108, being guided by the guiding rails (holes) 108*a*, 108*b*, and 108*c*.

Referring to FIG. 6, the guide rail (hole) 108*a* is the main portion of the guide rail 108. The guide rails (holes) 108*b* and 108*b* are the left and right portions, which diagonally branch from the left and right end portions of the guide rail (hole) 108*a*, or the main portion, as is evident from the drawing. The end portions of the left and right portions 108*b* and 108*c* are parallel to the main portion 108*a*. Thus, when the stapler 1010 is on the loft side, the roller 106 is in the left portion 108*b*, and the roller 107 is in the left end portion 108*a*, so that the stapler 1010 is kept tilted to the right at a predetermined angle. When the stapler 1010 is in the middle range, the rollers 106 and 107 both are in the rail (hole) 108*a*, keeping thereby the stapler 1010 upright. When the stapler 1010 is in the right end portion 108*c*, the roller 107 is in the right end portion of the rail (hole) 108*c*, and the roller 106 is in the right end portion of the rail (hole) 108*a*, so that the stapler 1030 is kept tilted to the left at a predetermined angle. The operation for switching the attitude of the stapler 1010 among the above described attitudes is carried out by a cam (not shown).

The stapler unit 80 is provided with a home position sensor 111 for checking whether or not the stapler 1010 is at the home position; whether or not the stapler is at the stapler home position is checked by detecting a flag provided on the movable table 1030. Normally, the stapler 1010 is on standby at the home position, that is, the leftmost stapler position.

The roller 106 of the movable table 1030 has the pinion gear 106*b*, which is attached to the portion of the table 1030, below the flange portion, and which is integrally formed with the roller 106. The roller 106 also has a belt pulley 106*c*, which is attached to the top end of the pinion gear 106*b*, and which also is integrally formed with the pinion gear 106*b*. The pinion gear 106*b* is connected to the output pulley of the stapler moving motor M100 on the movable table 1030, by the driving belt stretched between the two pulleys. Further, the pinion gear 106*b* is meshed with a rack gear 110 fixed to the anchoring table 108, along the aforementioned rails (hole). Thus, the movable table 1030 can be moved with the stapler 1010 in the direction perpendicular to the sheet conveyance direction by the forward or reverse rotation of the staple movement (slide) motor M100.

Each stud shaft 111 extending downward from the bottom surface of the movable table 1030 is provided with a Stepper retraction roller 112, which plays the role of preventing the trailing end Stepper of the processing tray 130 and stapler 1010 from colliding with each other.

The discharging side of the processing tray 130 is provided with a discharge roller, which constitutes one of the sheet stack discharge roller pair 83. In this case, the discharge roller is the bottom roller 83*b*, which is fixed in position.

The top discharge roller 83*a* is supported by the pivotal guide 81. As the pivotal guide 81 is tilted to the closed position, the top discharge roller 83*a* is pressed on the bottom discharge roller 83*b*. Thus, the stack of sheets S on the processing tray 130 is discharged onto a stack tray 86 as the top and bottom discharge rollers 83*a* and 83*b* are driven by a sheet stack discharging motor 87, which is a stepping motor.

The pivotal guide 81 is pivoted by the rotation of a cam (not shown) by a guide pivoting motor 82, which also is a stepping motor. The closed position of the pivotal guide 81, that is, the pivotal guide position in which the top and bottom discharge rollers 83*a* and 83*b* are in contact with each other, is the home position (HP) of the pivotal guide 81. Whether or not the pivotal guide 81 is at its home position is detected by an HP sensor (not shown). Similarly, whether or not the pivotal guide 81 is in the open position is detected by a pivotal guide open position sensor (not shown).

A sheet accumulation guide 16 is structured so that the trailing end (trailing end in terms of sheet stack discharge direction) is caught by the guide 16 as a sheet stack is discharged onto the stack tray 86 or sample tray 85. It is a part of the external shell of the sheet processing apparatus 103.

The stack tray 86 is vertically movable by a stack tray motor (not shown), which is a stepping motor, whereas the sample tray 8*b* is a stationary tray.

As described above, as a user sets a single or plurality of originals P in the automatic original feeding portion 51 of the original feeding-reading apparatus 101, sets a desired operational mode with the use of the control portion 301, and presses the start key, the copying machine main assembly 102 begins an image forming operation. Then, in the copying machine main assembly 102, while the originals P are read by the original feeding-reading apparatus, a single or plurality of the sheets S begin to be feed into the copying machine main assembly 102 from the sheet storage portion 53 or 54 selected based on the size of the required sheets S, and the sheets S are conveyed to the image forming portion 62 through the sheet conveyance path. The toner image formed on the photoconductive drum 66 in accordance with the image formation information read by the original feeding-reading apparatus 101 is transferred onto the supplied sheet S. The unfixed toner image on the sheet S is fixed to the sheet S while the sheet S is conveyed past the fixing roller 64. Thereafter, the sheets S, to each of which the toner image has been fixed, are sorted by the sheet processing apparatus 103, and are subjected to one or more of book making processes, for example, stapling, by the sheet processing apparatus 103. Then, the processed sheets S are discharged.

Next, the method for detecting the operational abnormality (abnormal load) of each driving member of each driving system will be described.

Each of the entry conveyance motor 50, buffer motor 59, sheet discharge motor 49, sheet stack discharge motor 87, and stack tray motor (not shown), which are stepping motors, is provided with an encoder (not shown) for detecting the revolution of the motor. Whether or not a motor is in an abnormal operational condition can be detected by detecting whether or not the motor is rotating at a revolution lower than a preset revolution.

As for the operational abnormalities of the sheet alignment motors M141 and M142, which are stepping motors, if the HP detection flags (141*b* and 142*b* in FIG. 4) of the sheet aligning plates 141 and 142 are not detected by the sheet aligning member home position sensors 145 and 146, respectively, even though a predetermined number of pulses are applied to the motors M141 and M142 to move the sheet aligning plates 141 and 142 from the aligning positions to their home positions, it is determined that the motors M141 and/or M142 are abnormally operating.

As for the operational abnormalities of the stapler moving (sliding) motor M100, which also is a stepping motor, if the HP detection flags (141*b* and 142*b* in FIG. 4) attached to the movable table 1030 are not detected by the stapler home position sensor 111, even though a predetermined number of pulses are applied to the motor M100 to move the stapler 1010 from the stapling position to its home position, it is determined that the motors M100 is abnormally operating.

As for the operational abnormalities of the pivotal guide motor 82, which also is a stepping motor, if the pivotal guide 81 is not detected by the pivotal guide open position sensor (not shown), even though a predetermined number of pulses are applied to the motor 82 to move the pivotal guide 82 from the closed position to the open position, it is determined that the pivotal guide motor 82 is abnormally operating. Further, if the pivotal guide 81 is not detected by the pivotal guide home position sensor (not shown), even though a predetermined number of pulses are applied to the motor 82 to move the pivotal guide 82 from the open position to the closed position, it is determined that the pivotal guide motor 82 is abnormally operating.

Further, as for the operational abnormalities of the knurled belt solenoid 192, flapper 1 solenoid 34, and flapper 2 solenoid 3*b*, if the completion of the movement of the knurled belt 190, flapper 11, or flapper 10 to a predetermined position is not detected by the corresponding position sensor (193 in FIG. 2, and 36 and 37 in FIG. 3, respectively) within a predetermined length of time after the beginning of the driving of the solenoids, it is determined that the solenoids are abnormally operating.

FIG. 10 is a table showing the categories of the functions of the driving portions of the sheet processing apparatus, and an example of the ranking of the driving portions in each category, in terms of their effect upon the overall performance of the printing system. Here, letters A, B, C, and D are given to the categories in the descending order of priority. A letter A represents the driving system which affects the sheet conveyance performance, that is, the speed at which each sheet S is conveyed. If the performance of an A ranked driving system declines, the conveyance time of each sheet S and the interval time between sequential two sheets S becomes longer. A letter B represents a driving system which affects the sheet processing performance regarding each sheet. If the performance of a B ranked driving system declines, the interval time between the sequential two sheets becomes longer. A letter C represents a driving system which affects the sheet processing performance regarding each stack of sheets. If the performance of a C ranked driving system declines, the interval between the last sheet of the preceding stack of sheets and the first sheet of the following stack of sheets becomes longer. A letter D represents a driving system which does not specifically affect the performance of the sheet processing apparatus.

FIG. 11 is a table showing an example of the ranking of the driving systems based on the ranking method shown in FIG. 10.

The conveyance entry motor 50, buffer motor 59, and sheet discharge motor 49 affect the conveyance of each sheet, and therefore, are given A ranking.

The sheet alignment motors M141 and M142, and knurled belt solenoid 192 affect the production of each copy, and therefore, are given B ranking.

The sheet alignment motors M141 and M142, sheet stack discharge motor 87, stapler movement (slide) motor M100, and pivotal guide motor 82 affect the production of each stack of copies, and therefore, are given C ranking.

The stack tray motor has little effect on the system performance, and therefore, is given D ranking.

The sheet alignment motors M141 and M142 are given both B and C rankings for the following reason. That is, there is a large amount of difference between the torque necessary to move a single sheet and the torque necessary to move a stack of sheets. Therefore, the driving speed and the amount of electric current for driving each driving system need to be set based on whether the object to be moved is a single sheet or a stack of sheets.

FIG. 12 is a table of the normal speed, normal electric current value, maximum electric current value to which electric current can be increased to increase the torque of each driving system, maximum speed (MAX speed) to which the driving speed of each driving system can be increased, and minimum speed (MIN speed) to which the driving speed of each driving system can be reduced, when creating a system A by combining a (post) sheet processing apparatus 103 and a copying apparatus main assembly 102 as an example of an image forming apparatus.

For example, the default amount of electric current and default speed values of the staple movement (slide) motor M100 are 35 and 450, respectively. If the load increases due to the elapse of time or changes in ambience, and the resultant operational abnormality is detected, the driving speed of the staple movement (slide) motor M100 can be maintained by incrementally increasing the amount of the electric current supplied to the staple movement (slide) motor M100 by a predetermined value (for example, 5). However, the amount of the electric current supplied to the staple movement (slide) motor M100 should not be raised beyond an electric current value of 50. Thus, after the amount of the electric current supplied to the stapler movement (slide) motor M100 is increased to a value of 50, the driving speed of the staple movement (slide) motor M100 is incrementally reduced by a predetermined value (for example, 5), so that the stapler unit can be kept in the operational condition, although the driving speed of the stapler movement (slide) motor M100 gradually reduces.

FIG. 13 is a table showing: the values of the normal speed, normal amount of electrical current, maximum amount of electric current to which electric current can be increased to increase the torque of each driving system, maximum speed (MAX speed) to which the driving speed of each driving system can be increased; and minimum speed (MIN speed) to which the driving speed of each driving system can be reduced, when creating a system B, which is lower in performance than the system A, by combining a (post) sheet processing apparatus 103 and a copying apparatus main assembly 102 as an example of an image forming apparatus inferior to the image forming apparatus used to create the system A. The values of the maximum electric current, maximum speed, and minimum driving speed of the driving system of the (post) sheet processing apparatus, remain the same whether the system A is created or the system B is created. Thus, these values in the table in FIG. 13 are the same as the counterparts in the table in FIG. 12.

The value of the total of normal electric currents in the system A is 365, whereas that in the system B is 235. This means that the system B has an electric current surplus of 130 (=365−235) relative to the system A.

Next, the method for adjusting the amount of electric current and/or driving speed of the motor of a given driving system if an operational abnormality is detected in the given driving system, will be described.

(*a*), (*b*), and (*c*) of FIG. 16 are operational timing charts for the knurled belt solenoid 192 and sheet alignment motors M141 and M142, corresponding to the trailing end of the sheet S to be aligned, and the leading end of the following sheet S, when the sheets S are discharged into the processing tray 130.

(*a*) of FIG. 16 represents the case in which the sheet processing apparatus is operated at the normal setting, wherein the length of time the knurled belt solenoid 192 is driven is t0, and the length of time the sheet alignment motor M141 or M142 is driven is t2.

Assuming that it is detected that an A ranked motor, for example, the buffer motor 59 of a given system, is abnormally operating, if the total amount of the electric current being consumed by the given system is below the maximum total electric current value of this system, the abnormality can be dealt with by increasing the amount of the electric current for driving the buffer motor 59 by a predetermined amount. However, if the total amount of the electric current being consumed by this system is equal to the maximum total electric current value of this system, the amount of the electric current for driving the buffer motor 59 cannot be increased. Thus, the speed at which the sheet alignment motor M141 or M142 is driven is set to a lower value, so that the amount of the electric current for driving the sheet alignment motor M141 or M142, respectively, reduces. In the situation represented by (*b*) of FIG. 16, the speed at which the sheet alignment motor M141 or M142 is driven, and the amount of the electric current for driving the sheet alignment motor M141 or M142, respectively, are reduced, and therefore, the length of the time the sheet alignment motor M141 or M142 is driven increases from t2 to t3. However, the amount of the electric current for driving the buffer motor 59 can be increased by an amount proportional to the amount by which the electric current for driving the sheet alignment motor M141 or M142 is reduced.

Next, the method for preventing the performance (productivity) of the printing system from declining will be described.

(*c*) of FIG. 16 is the operational timing chart for the aforementioned system when the system is operating at the normal setting, at which the length of the time the knurled belt solenoid 192 is driven is t0.

(*d*) of FIG. 16 is the operational timing chart for the same system after the occurrence of an abnormality to the knurled belt solenoid 192. In this case, the length of time the knurled belt solenoid 192 needs to be driven is t1, which is longer by (t1−t0) than the length of time the knurled belt solenoid 192 is driven when the knurled belt solenoid 192 is in the normal state as shown in (*a*) of FIG. 16.

In this case, the length of time the knurled belt solenoid 192 is driven is restored from t1 to t0 by increasing the amount of the electric current for driving the knurled belt solenoid 192.

If, however, the value of the amount of the electric current for driving the knurled belt solenoid 192 is already at the maximum value (FIG. 12) to which the amount of the electric current for driving the knurled belt solenoid 192 can be set, the amount of the electric current for driving the knurled belt solenoid 192 cannot be increased. Without increasing the amount of the electric current for driving the knurled belt solenoid 192, the system productivity is affected in terms of the efficiency with which it processes each sheet. Thus, the operation is continued with longer sheet intervals.

Even though the amount of the electric current for driving the knurled belt solenoid 192 cannot be increased, the speed at which the sheet alignment motor M141 or M142 is driven, and the amount of the electric current for driving the sheet alignment motor M141 or M142, can be increased in order to prevent the system from being affected in the efficiency with which each sheet is processed, that is, in order to prevent the sheet intervals from becoming longer. More specifically, referring to (*c*) of FIG. 16, the productivity of the system in terms of the efficiency with which each sheet is processed can be kept the same by increasing the speed at which the sheet alignment motor M141 or M142 is driven, and the amount of the electric current for driving the sheet alignment motor M141 or M142, so that the length of time the sheet alignment motor M141 or M142 is driven is reduced from t2 to t3 as shown in (*d*) of FIG. 16. The timing chart in (*c*) of FIG. 16 and that in (*d*) of FIG. 16 are not different in terms of the system performance in terms of the efficiency with which each sheet is processed.

However, the above described method is possible, that is, the speed at which the sheet alignment motor M141 or M142 is driven, and the amount of the electric current for driving the sheet alignment motor M141 or M142, can be increased, only when they have not reached their maximum values. In other words, when either the speed at which the sheet alignment motor M141 or M142 is driven, or the amount of the electric current for driving the sheet alignment motor M141 or M142, is at its maximum value, it is impossible to increase the driving speed of sheet alignment motor M141 or M142. Consequently, the performance of the system is affected in terms of the efficiency with which each sheet is processed. Thus, the operation is continued with longer sheet intervals.

Up to this point in time, the case in which the amount of the electric current for driving the sheet alignment motor M141 or M142 is reduced, or the case in which in order to prevent the performance of the printing system from declining due to the occurrence of an abnormality to a given driving system of the printing system, the driving systems other than the driving system suffering from the abnormality are increased in speed. However, when the total amount of the electric current being consumed by the printing system when the abnormality is detected is already equal to the maximum value for the printing system, control is executed so that the speed at which a given driving system among the driving systems, lower in ranking than the driving system suffering from the abnormality, is driven, and the amount of the electric current for driving a given driving system, among the driving systems, lower in ranking than the driving system suffering from the abnormality, are reduced in the ascending order (D→C→B).

In other words, if it is detected that a given driving system is abnormally operating, the control is executed so that the amount of the electric current for driving the given driving system, or the driving systems, other than the driving system suffering from the abnormality, is increased in the descending order (A>B>C>D). More specifically, if an abnormality is detected in an A ranked driving system, but the amount of the electric current for driving this driving system cannot be increased, this situation is dealt with by reducing the driving speed of this driving system. Further, if an abnormality is detected in an A ranked driving system while one (or more) of C ranked driving systems are operated at a speed to which the driving speed of this driving system has been increased from the normal speed, the current driving speed of this C ranked driving system is cancelled (reduced to normal speed), reducing thereby the amount of the electric current for driving this driving system by the amount proportional to the value by which the speed is reduced (restoring to the normal value), and then, the amount of the electric current for driving the A ranked driving system suffering from the abnormality is increased. In this case, the productivity of the sheet processing apparatus is affected in terms of the efficiency with which each stack of sheets is processed. As a result, the operation continues with longer sheet stack intervals in time.

Similarly, if one (or more) of B ranked driving systems is being operated at a speed to which the driving speed of this driving system has been increased from the normal speed, the current driving speed of this B ranked driving system is cancelled (reduced to normal speed), reducing thereby the amount of the electric current for driving this driving system by the amount proportional to the value by which the speed is reduced (restoring to the normal value), and then, the amount of the electric current for driving the A ranked driving system suffering from the abnormality is increased. In this case, the productivity of the sheet processing apparatus is affected in terms of the efficiency with which each sheet is processed. As a result, the operation continues with longer sheet intervals in time.

Further, when it is determined that the total amount of the electric current being consumed by the printing system should not be increased, and yet, there is a driving system, the driving speed of which can be reduced to a value below the value of the normal speed, among the C ranked driving systems, the driving speed of this C ranked driving system is reduced from its normal speed, reducing thereby the amount of the electric current for driving this C ranked driving system to a value corresponding to the reduced speed, and then, the amount of the electric current for driving the A ranked driving system is increased. In this case, the productivity of the sheet processing apparatus is affected in terms of the efficiency with which each stack of sheets is processed. As a result, the operation continues with longer sheet stack intervals in time.

As for the priority in terms of the order in which a given driving system among the C ranked driving systems, the driving speed of which can be reduced from the normal value, is reduced in the electric current supplied thereto, such a C ranked driving system that is being supplied with the electric current, the value of which is very close, or equal, to the normal value, is given priority over such a C ranked driving system that is being supplied with the electric current, the value of which has been already reduced. Then, the amount of the electric current for driving the A ranked driving system is increased by the amount proportional to the amount by which the electric current for driving the C ranked driving system is reduced. In other words, this process is repeated until all the electric currents for driving the C ranked driving systems, one for one, are eventually reduced to their proportional values.

As for the priority in terms of the order in which a given driving system among the C ranked driving systems, the driving speed of which can be reduced from the normal value, is reduced in the amount of the electric current supplied thereto, such a C ranked driving system that has less effect upon the productivity of the sheet processing apparatus (that is shorter in driving time) is given priority over such a C ranked driving system that has greater effect upon the productivity of the sheet processing apparatus. Then, the amount of the electric current for driving the A ranked driving system is increased by the amount proportional to the amount by which the electric current for driving the C ranked driving system is reduced. In this case, a specific C ranked driving system, which least affects the productivity of the sheet processing apparatus is simply reduced in the amount of the electric current supplied thereto in the above described order.

Similarly, when there is a driving system, the driving speed of which can be reduced to a value below the value of the normal speed, among the B ranked driving systems, the driving speed of this B ranked driving system is reduced from its normal speed, reducing thereby the amount of the electric current for driving this B ranked driving system to a value corresponding to the reduced speed, and then, the electric current for driving the A ranked driving system is increased by the amount proportional to the amount by which the electric current for driving this B ranked driving system is reduced. In this case, the productivity of the sheet processing apparatus is affected in terms of the efficiency with which each of sheet is processed. As a result, the operation continues with longer sheet intervals in time.

As for the priority in terms of the order in which a given driving system among the B ranked driving systems, the driving speed of which can be reduced from the normal value, is reduced in the electric current supplied thereto, such a B ranked driving system that is being supplied with the electric current, the value of which is very close, or equal, to the normal value, is given priority over such a B ranked driving system that is being supplied with the electric current, the value of which has been already reduced. Then, the electric current for driving the A ranked driving system is increased by the amount proportional to the amount by which the electric current for driving the B ranked driving system is reduced. This process makes it possible to eventually reduce all the electric currents for driving the B ranked driving systems, one for one, to their proportional values.

As for the order in which a given driving system among the B ranked driving systems, the driving speed of which can be reduced from the normal value, is reduced in the amount of the electric current supplied thereto, such a B ranked driving system that has less effect upon the productivity of the sheet processing apparatus (such a driving system that is shorter in driving time) is given priority over such a B ranked driving system that has greater effect upon the productivity of the sheet processing apparatus. Then, the amount of the electric current for driving the A ranked driving system is increased by the amount proportional to the amount by which the electric current for driving the C ranked driving system is reduced. In this case, a specific C ranked driving system, which least affects the productivity of the sheet processing apparatus is simply reduced in the amount of the electric current supplied thereto in the above described order.

Further, if an abnormality is detected in one of the C ranked driving systems, but the amount of the electric current for driving this C ranked driving system cannot be increased, this situation is dealt with by reducing the driving speed of this C ranked driving system. In this case, if any of the rest of the C ranked driving systems can be increased in the amount of the electric current being currently supplied thereto, the performance of the sheet processing apparatus can sometimes be prevented from declining, by increasing the driving speed of this C ranked driving system. In such a case, the driving speed of this C ranked driving system is increased from the value at which it is currently driven, and the amount of the electric current for driving this C ranked driving system is increased by the amount proportional to the value by which the speed is increased, so that the performance of the sheet processing apparatus is increased by the amount proportional to the amount by which the performance of the sheet processing apparatus is reduced because the C ranked driving system suffering from the operational abnormality is reduced. In this case, the productivity of the sheet processing apparatus is not affected in terms of the efficiency with which each stack of sheets is processed. Therefore, the sheet processing apparatus can continue the operation at the same performance level as that prior to the detection of the abnormality.

Further, regarding the order in which a given driving system among the C ranked driving systems, the driving speed of which can be increased from the normal value, is increased from the normal value, a C ranked driving system, the driving speed of which is very close, or equal, to the normal speed, is given priority over a C ranked driving system the driving speed of which has been already increased from the normal speed. This process makes it possible to eventually increase all the speeds of the C ranked driving systems, one for one, to their proportional values.

The amount of the performance reduced due to the detection of the abnormality in one of the C ranked driving systems can be efficiently compensated for by sequentially increasing the driving speed of the rest of the C ranked driving systems in such a manner that such a C ranked driving system that has the most effect upon the productivity of the sheet processing apparatus (such a driving system that is longest in driving time) is given priority over such a C ranked driving system that has less effect upon the productivity of the sheet processing apparatus. In such a case, the driving speed of a specific C ranked driving system is simply reduced in the above described order. However, the effect of the speed reduction upon the productivity of the sheet processing apparatus can be more effectively reduced.

Further, if an abnormality is detected in one of the B ranked driving systems, and it is determined that the amount of the electric current for driving the driving system suffering from the abnormality should not be increased, this situation is dealt with by reducing the driving speed of this driving system. More specifically, if any of the rest of the B ranked driving systems can be increased in speed from the value at which it is being driven, the performance of this apparatus can sometimes be prevented from reducing, by increasing the driving speed of this driving system. In such a case, the driving speed of this B ranked driving system is increased from the value at which it is being driven, and the amount of the electric current for driving this driving system is also increased in proportion to the value by which the driving speed of this driving system is increased, so that the performance of the apparatus is increased by the value proportional to the value by which the apparatus performance is reduced by the B ranked driving system in which the abnormality is detected. In this case, the productivity of the apparatus is not affected in terms of the efficiency with which each stack of sheets is processed, and the apparatus continues the operation at the same performance level as the performance level at which it was operating prior to the detection of the abnormality.

Further, when some of the B ranked driving systems can be increased in speed from the normal value, their speeds are increased in such an order that a driving system, the driving speed of which is close, or equal, to the normal value is given priority over a driving system, the driving speed of which has already been increased from the normal value. With the employment of this method, the speeds of the B ranked driving systems are increased to the values proportional thereto, in an orderly manner.

Further, when some of the B ranked driving systems can be increased in speed from the normal value, their speeds are increased in such an order that a driving system which most affects the productivity of the sheet processing apparatus (driving system longest in driving time) is given priority. With the employment of this method, it is possible to efficiently compensate for the performance loss caused by the B ranked driving system in which the abnormality was detected. In this case, the effect of the occurrence of the abnormality is more efficiently reduced by simply increasing the driving speed of a specific B ranked driving system in the above described order.

FIG. 9 is a block diagram showing the structure of the control portion of the copying machine main assembly 102. A controller circuit 200 comprises a central processing unit (which hereinafter will be referred to as CPU) 1002, a memory 1001, I/O control portion 1003, etc. The CPU 1002 is controlled by a program, and controls the entirety of the combination of the copying machine main assembly 102 and sheet processing apparatus 103. The memory 1001 includes: RAMs or ROMs 1004 for storing programs and predetermined data; re-writable non-volatile ROMs; flash ROMs, IC cards, floppy disks (R), etc., and is used for reading or writing programs and data. The I/O control portion 1003 controls the transmission of the input and output signals.

Connected to the I/O control portion 1003 are a control panel control portion 201, a sheet supply control portion 202, a sheet feeding-reading control portion 203, an image formation control portion 204, and a sheet processing apparatus control portion 205.

The memory 1001 and I/O control portion 1003 are controlled by the control signals from the CPU 1002. The controller circuit portion 200 controls the operations of the I/O control portion 201, sheet supply control portion 202, sheet feeding-reading control portion 203, image formation control portion 204, and sheet processing apparatus control portion 205, through the I/O control portion 1003.

As a user sets a single or plurality of originals P in the automatic original feeding portion 51 of the original feeding-reading apparatus 101, sets a desired operational mode with the use of the control panel portion 301, and presses the start key, the automatic original feeding portion 51 of the copying machine main assembly 102 structured as described above begins to convey the originals P, one by one, to the reading position of the original placement glass platen 78, and the optical system 52 of the copying machine main assembly 102 begins to read the original P.

The optical system 52 reads the original P; it illuminates the original P and the light reflected by the original P is transduced into image formation signals by the CCD line sensor 76. The obtained image formation signals are subjected to various processes in accordance with the instructions given by the user through the control panel portion 301. Then, the image formation signals are converted into light signals for exposing the photoconductive drum 66.

Then, an image is formed on the sheet S through the ordinary electrophotographic processes, that is, charging, exposing, latent image formation, developing, transferring, separating, and fixing processes. After the formation of the image on the sheet S, the sheet S is conveyed to the sheet processing apparatus 103 by the conveyance belt 63 and conveyance roller pair 65, and then, is conveyed to the conveyance path of the sheet processing apparatus 103 by the entry conveyance roller pair 1. The sheet processing apparatus 103 is controlled by the controller circuit 200 in accordance with the instructions set through the control panel portion 301.

The controller circuit portion 200 switches the sheet conveyance path by moving the first conveyance path switching flapper 11 by driving the flapper 1 solenoid through the sheet processing apparatus control portion 205. When a sheet S is to be placed in the sample tray 85, the sheet S is discharged into the sample tray 85 by way of the discharge roller pair 9, whereas when sheets S are to be stacked in the stack tray 86, the sheets S are conveyed by way of the conveyance roller pair 6, and then, are discharged by the first discharge roller pair 7 into the processing tray 130 to be stacked therein.

As a given stapling mode is selected through the control panel portion 301, the controller circuit portion 200 activates the stapling unit 80 through the sheet processing apparatus control portion 205. The stapling unit 80 staples the stack of sheets in the processing tray 130. Further, the controller circuit portion 200 activates the widthwise sheet aligning apparatus 140 through the sheet processing apparatus control portion 205. The widthwise sheet aligning apparatus 140 vertically aligns the stack of sheets accumulated in the processing tray, and controls the sorting direction in which the stacks of sheets are discharged into the stack tray 86, and stacked thereon.

Further, the controller circuit portion 200 closes the pivotal guide 81 by driving the pivotal guide motor 82 through the sheet processing apparatus control portion 205. Then, it drives the sheet stack discharge roller pair 83 (top and bottom discharge rollers 83*a* and 83*b*) through the sheet processing apparatus control portion 205 after moving the pivotal guide 81 to the closed position. The sheet stack discharge roller pair 83 (top and bottom rollers 83*a* and 83*b*) discharges the stack of sheets in the processing tray 130, into the stack tray 86 so that the stack of sheets is stacked in the stack tray 86.

Next, the driving control portion disposed in the sheet processing apparatus control portion 205 to drive the aforementioned solenoids and stepping motors will be described.

Referring to FIG. 14, the drive control portion for controlling the solenoids comprises: a D/A converter 2051 for converting the data selected by the controller circuit portion 200 into analog data; a solenoid 2053; and a solenoid driver 2052 for driving the solenoid 2053 by controlling, in accordance with the voltage supplied to the aforementioned referential voltage terminal, the amount of the electric current supplied to the solenoid 2053.

In this embodiment, the sheet processing apparatus control portion 205 is provided with three solenoid drive control portions for driving the knurled belt solenoid 192, flapper 1 solenoid 34, and flapper 2 solenoid 35, one for one.

Referring to FIG. 15, the stepping motor drive control portion comprises: a D/A converter 2055 for converting the data selected by the controller circuit portion 200 into analog data; a solenoid 2057; and a stepping motor driver 2056 for driving the stepping motor 2057 by controlling, in accordance with the voltage supplied to the aforementioned referential voltage terminal, the amount of the electric current supplied to the stepping motor 2057, and also, by supplying the stepping motor 2057 with pulse electric current in synchronism with the clock supplied to the operational clock terminal. In this embodiment, the sheet processing apparatus control portion 205 is provided with nine stepping motor drive control portions for driving the entry conveyance motor 50, buffer motor 59, sheet discharge motor 49, sheet stack discharge motor 87, stack tray motor, sheet alignment motor M141 and M142, stapler movement (slide) motor M100, and pivotal guide motor 82, one for one.

FIGS. 17, 18, and 19 are flowcharts of the abnormality detection and management routines for detecting the abnormal state of each driving system. These routines are controlled by the abnormality management routine, given in FIG. 26, carried out as the power source is turned on. FIGS. 20, 21, 22, 23, 24, and 25 are flowcharts showing the sequences to be followed to deal with the abnormality detected in any of the driving systems. FIG. 27 is a flowchart of the display control routine for controlling the display which shows the system conditions. This routine is carried out also as the power source is turned on. These programs are stored in a ROM 2004 in the memory 1001, and are carried out by the CPU 1002.

FIG. 17 is a flowchart of the routine for detecting solenoid abnormality. The knurled belt solenoid 192, flapper 1 solenoid 34, and flapper 2 solenoid 35 are individually checked for abnormalities. The CPU 1002 determines whether or not a solenoid is being driven (Step S1701). If it is determined in Step S1701 that the solenoid is not being driven, the CPU 1002 repeats Step 1701. If it is determined in Step S1701 that the solenoid is being driven, the CPU 1002 monitors whether or not the position detection sensor is turned on within a predetermined length of time (Step S1702). If it is determined in Step S1702 that the position detection sensor is turned on and the driving of the solenoid is completed within the predetermined length of time, the CPU 1002 carries out Step S1701. If it is determined in Step S1702 that the position detection sensor is not turned on and the driving of the solenoid is not completed within the predetermined length of time, the CPU 1002 carries out Step S1703. In Step S1703, the CPU sets a flag to indicate the abnormal condition of the solenoid in which the abnormality was detected, and waits (Step S1704) until the flag indicating the abnormal condition of the solenoid in which the abnormality was detected is cleared. If it is determined in Step S1704 that the abnormal condition has been cleared, the CPU 1002 carries out Step S1701.

FIG. 18 shows the routine for detecting stepping motor abnormality. The sheet alignment motor M141 and M142, stapler movement motor M100, and pivotal guide motor 82 are individually checked for abnormalities. The CPU 1002 determines whether or not a stepping motor is being driven (Step 1801). If it is determined in Step S1801 that the stepping motor is not being driven, the CPU 1002 repeats Step 1801. If it is determined in Step S1801 that the stepping motor is being driven, the CPU 1002 monitors whether or not the position detection sensor is turned on within a predetermined length of time (Step S1802). If it is determined in Step S1802 that the position detection sensor is turned on and the driving of the stepping motor is completed within the predetermined length of time, the CPU 1002 carries out Step S1801. If it is determined in Step S1802 that the position detection sensor is not turned on and the driving of the stepping motor is not completed within the predetermined length of time, the CPU 1002 carries out Step S1803. In Step S1803, the CPU sets a flag to indicate the abnormal condition of the stepping motor in which the abnormality was detected, and waits until the flag indicating the abnormal condition of the stepping motor in which the abnormality was detected is cleared (Step S1804). If it is determined in Step S1804 that the abnormal condition has been cleared, the CPU 1002 carries out Step S1801.

FIG. 19 shows the routine for detecting the abnormality of the stepping motor, based on the stepping motor revolution detected by an encoder. The entry conveyance motor 50, buffer motor 59, sheet discharge motor 49, sheet stack discharge motor 87, and stack tray motor are individually checked for abnormality. The CPU 1002 determines whether or not the stepping motor abnormality detection operation is prohibited (Step S1901). If it is determined in Step 1901 that the abnormality detection operation is prohibited, the CPU repeats Step S1901. Then, the CPU 1002 determines whether or not the stepping motor is being driven (Step S1902). If it is determined in Step S1901 that the stepping motor is not being driven, the CPU1002 repeats Step 1901. If it is determined in Step 1902 that the stepping motor is being driven, the CPU 1002 monitors, by comparing the revolution of the stepping motor detected by the encoder to the preset revolution of the stepping motor, whether or not the revolution detected by the encoder is lower than the preset revolution (Step S1903). If it is determined in Step 1903 that the revolution detected by the encoder is not lower than the preset revolution, the CPU 1002 carries out Step S1901. If it is determined in Step 1903 that the revolution detected by the encoder is lower than the preset revolution, the CPU 1002 carries out Step 1904. In Step 1904, the CPU 1002 checks whether or not the stepping motor is accelerating. If it is determined in Step 1904 that the stepping motor is accelerating, the CPU sets a flag to indicate that the stepping motor in which the abnormality is detected is accelerating (Step 1905). If it is determined in Step 1904 that the stepping motor is not accelerating, the CPU determines whether or not the stepping motor is being driven by self activation (Step S1907). If it is determined in Step 1907 that the stepping motor is being driven by self activation, the CPU 1002 sets a flag to indicate the abnormality that the stepping motor is being driving by the self activation (Step S1908). If it is determined in Step 1907 that the stepping motor is not being driven by the self activation, the CPU 1002 sets a flag indicating that the stepping motor in which the abnormality was detected is being driving at a constant speed (Step 1909), and waits until the abnormal condition of the stepping motor, the condition of which was flagged as abnormal, is cleared (Step 1906). If it is determined in Step 1906 that the abnormal condition is cleared, the CPU 1002 carries out Step 1901.

FIG. 20 is a flowchart of the routine for monitoring the abnormality occurrence in the driving systems. In this case, the driving systems are ranked as shown in FIG. 11, and are checked for the abnormalities in the descending order in terms of the ranking. More specifically, first, the CPU 1002 checks the A ranked driving systems for abnormalities (Step S2001). If it is determined in Step S2001 that a given A ranked driving system is in the abnormal condition, the CPU 1002 carries out an abnormality management process A (Step S2002). Concretely, the CPU 1002 carries out the abnormality management routine A (FIG. 21). If it is determined in Step S2001 that no A ranked driving system is in the abnormal condition, the B ranked driving systems are checked for abnormalities (Step S2002). If it is determined in Step S2002 that a given B ranked driving system is in the abnormal condition, the CPU 1002 carries out an abnormality management process B (Step S2004) Concretely, the CPU 1002 carries out abnormality management routine B shown in FIGS. 22A, 22B and 22C. Incidentally, instead of the abnormality management routine B shown in FIGS. 22A, 22B and 22C, an abnormality management routine shown in FIGS. 41A, 41B and 41C may be carried out. If it is determined in Step 2003 that no B ranked driving system is in the abnormal condition, the C ranked driving systems are checked for abnormalities (Step S2005). If it is determined in Step S2005 that a given C ranked driving system is in the abnormal condition, the CPU 1002 carries out an abnormality management process C (Step S2006). Concretely, the CPU 1002 carries out abnormality cleaning routine C shown in FIGS. 23A, 23B and 23C. Incidentally, instead of the abnormality management routine shown C in FIGS. 23A, 23B and 23C, an abnormality management routine shown in FIGS. 42A, 42B and 42C may be carried out. If it is determined in Step S2005 that no C ranked driving system is in the abnormal condition, the CPU again carries out Step S2001.

FIG. 21 shows the routine carried out if it is detected that a given A ranked driving system is in the abnormal condition. The CPU 1002 checks whether or not the value of the electric current being supplied to the A ranked driving system in which the abnormality was detected is no more than the preset maximum electric current value, that is, whether or not the amount of the electric current for driving the A ranked driving system in which the abnormality was detected can be increased, by comparing the value of the electric current being supplied to this A ranked driving system in which the abnormality was detected to the preset maximum electric current value therefor (Step S2101). If it is determined in Step 2101 that the amount of the electric current being supplied to the A ranked driving system in which the abnormality was detected cannot be increased, the CPU carries out Step S2109. If it is determined in Step S2101 that the amount of the electric current being supplied to the A ranked driving system in which the abnormality was detected can be increased, the CPU 1002 compares the preset maximum total electric current value for the system to the sum of the values of the electric currents being supplied to the A ranked driving systems, and determines whether or not the latter is no more than the former, that is, whether or not the sum of the values of the electric currents being supplied to the entirety of the driving systems of the sheet processing apparatus can be increased (Step S2102). If it is determined in Step S2102 that the total electric current of the printing system can be increased, the CPU 1002 increases the amount of the electric current being supplied to the driving system in which the abnormality was detected by a predetermined value (Step S2103), and clears the flag indicating the abnormal condition of the driving system in which the abnormality was detected (Step S2104). Then, the CPU 1002 ends the abnormality management process A. On the other hand, if it is determined in Step S2102 that the total amount of the electric current being supplied to the printing system cannot be increased, the CPU 1002 carries out an abnormality management process C1 (Step S2105). More specifically, it carries out the routine given in FIG. 25. After carrying out the routine (C1) in FIG. 25, the CPU 1002 compares the preset maximum electric current limit for the entirety of the printing system to the sum of the values of the electric currents being supplied to the driving systems, and determines whether or not the latter is no more than the former; in other words, it determines whether or not it is possible to increase the total amount of the electric current being supplied to the printing system can be increased (Step S2106). If it is determined in Step S2106 that the total amount of the electric current being supplied to the printing system can be increased, the CPU 1002 carries out Step 2103. If it is determined in Step S2106 that the total amount of the electric current being supplied to the printing system cannot be increased, the CPU 1002 carries out an abnormality management process B1. (Step S2107). Concretely, the CPU carries out the abnormality management routine (B1) given in FIG. 24. After the completion of the abnormality management routine (B1), the CPU 1002 compares the preset maximum limit for the total amount of the electric current supplied to the printing system to the sum of the values of the electric current settings for the driving systems, and checks whether or not the latter is not more than the former. In other words, it checks whether or not it is possible to increase the total amount of the electric current being supplied to the printing system (Step S2108). If it is determined in Step S2108 that it is possible to increase the total amount of the electric current being supplied to the printing system, the CPU 1002 carries out Step S2103. If it is determined in Step S2108 that it is impossible to increase the total amount of the electric current being supplied to the printing system, the CPU compares the current speed setting of the driving system in which the abnormality was detected, to the minimum speed limit of thereof, and checks whether or not it is possible to reduce the driving speed of the driving system in which the abnormality was detected (Step S2109). If it is determined in Step S2109 that the driving speed of the driving system in which the abnormality was detected can be reduced, the CPU 1002 reduces the setting of the driving system in which the abnormality was detected, by a predetermined value (Step S2110). Then, the CPU 1002 clears the flag indicating the abnormal condition of the driving system in which the abnormality was detected (Step S2111). Then, the CPU 1002 switches the performance setting of the printing system to a lower level; it reduces the productivity of the printing system (Step S2112). Then, it ends the abnormality management process A. If it is determined in Step S2109 that it is impossible to reduce the driving speed of the driving system in which the abnormality was detected, the CPU 1002 carries out the step for pausing the printing system (Step S2113), and ends the abnormality management process A.

FIGS. 22A, 22B and 22C show the routine carried out when an abnormality is detected in a given B ranked driving system. The CPU 1002 compares the preset maximum electric current limit for the driving system in which the abnormality was detected, to the current electric current setting thereof, and checks whether or not the latter is no more than the former; in other words, it checks whether or not it is possible to increase the amount of the electric current for driving the driving system in which the abnormality was detected (Step S2201). If it is determined in Step S2201 that it is possible to increase the amount of the electric current for driving the driving system in which the abnormality was detected, the CPU 1002 carries out Step 2202, whereas if it is detected in Step S2210 that it is impossible to increase the amount of the electric current for driving the driving system in which the abnormality was detected, the CPU 1002 carries out Step S22 16. Then, the CPU 1002 compares the preset maximum electric current limit for the total amount of the electric current supplied to the printing system, to the sum of the values of the present electric current settings of the driving systems, and checks whether or not the latter is not more than the former. In other words, the CPU checks whether or not it is possible to increase the total amount of the electric current being supplied to the printing system (Step S2202). If it is determined in Step S2202 that the total amount of the electric current being supplied to the sheet processing apparatus can be increased, the CPU 1002 increases the amount of the electric current for driving the driving system in which the abnormality was detected, by a predetermined value (Step S2203), and clears the flag indicating the abnormal condition of the driving system in which the abnormality was detected (Step S2204).

Further, if it is determined in Step S2202 that it is impossible to increase the total amount of the electric current for the printing system, the CPU 1002 carries out an abnormality management process C1 (Step S2205). Concretely, the CPU carries out the abnormality management routine (C1) given in FIG. 25. After the completion of the abnormality management routine (C1), the CPU 1002 compares the preset maximum electric current limit for the printing system to the sum of the values of the electric current settings for the driving systems, and checks whether or not the latter is no more than the former. In other words, it checks whether or not it is possible to increase the total amount of the electric current being supplied to the printing system (Step S2206).

If it is determined in Step S2206 that it is possible to increase the total amount of the electric current being supplied to the printing system, the CPU 1002 carries out Step S2203.

On the other hand, if it is determined in Step S2206 that it is impossible to increase the total amount of the electric current being supplied to the printing system, the CPU checks if the driving speed of any of the B ranked driving systems has already been increased from the normal speed in order to prevent the performance of the printing system from declining (Step S2218). If it is determined in Step S2218) that none of the B ranked driving systems has been increased from the normal speed, the CPU 1002 carries out Step 2211.

On the other hand, if it is determined in Step S2218 that any of the B ranked driving systems have been increased in speed from their normal speeds, the CPU 1002 restores the speed of the B ranked driving system, the speed of which is higher than its normal speed, to the normal speed (Step S2219), and resets the electric current value of this B ranked driving system to a lower value as it restores the speed of this B ranked driving system to the normal speed (Step S2220). Then, the CPU 1002 switches the performance setting of the printing system to a lower level; it reduces the productivity of the printing system (Step S2221), and increases, by a predetermined value, the electric current supply to the B ranked driving system in which the abnormality was detected (Step S2209).

In Step S2211, the CPU 1002 compares the minimum driving speed limits for the B ranked driving systems other than the B ranked system in which the abnormality was detected, to their current speed settings, one for one, and checks whether or not the current speed setting of any of them is higher than the present minimum speed limit. In other words, the CPU 1002 checks if it is possible to reduce the speed of the any of the B ranked driving systems other than the B ranked driving system in which the abnormality was detected. Then, it selects one of the B ranked driving systems, the speed of which can be reduced from its normal values (Step S2212). In this step, the selection is made so that the B ranked driving system, the speed of which is closest to its normal setting is given priority. However, the selection may be made in such a manner that the B ranked driving system, which least affects the productivity of the printing system (shortest in driving time) is given priority. It is also possible to prepare a detailed ranking for the B ranked driving systems, and uses this detailed ranking to select the B ranked driving system, the speed of which is to be reduced. Then, the CPU 1002 lowers, by a predetermined value, the current speed setting of the B ranked driving system selected in Step S2212 (Step S2213). Then, the CPU 1002 lowers, by a predetermined value, the present electric current setting of the this B ranked driving system selected in Step S2212, to the value corresponding to the speed value set in Step S2213 (Step S2214). Then, the CPU 1002 resets the performance of the printing system to a lower level (Step S2215), and increases by a predetermined value the amount of the electric current for driving the B ranked driving system in which the abnormality was detected (Step S2209).

In Step S2216, the CPU 1002 compares the current driving speed setting of the B ranked driving system in which the abnormality was detected, to the preset minimum driving speed limit therefor, and checks whether or not the current driving speed setting of the B ranked driving system in which the abnormality was detected is higher than the preset minimum driving speed setting therefor. In other words, the CPU checks if it is possible to reduce the driving speed of the B ranked driving system in which the abnormality was detected. If it is determined in Step S2216 that the driving speed of the B ranked driving system can be reduced, the CPU 1002 lowers (slows), by a predetermined value, the current speed setting of the B ranked driving system in which the abnormality was detected (Step S2207).

Then, the CPU 1002 checks if it is possible to prevent the performance (productivity) of the printing system from changing, by increasing the driving speeds of the B ranked driving systems, other than the B ranked driving system in which the abnormality was detected, the driving speed of which can be increased, in order to compensate for the performance loss caused by the B ranked driving system in which the abnormality was detected (Step S2222). If it is determined in Step S2222 by the CPU 1002 that it is possible to compensate for the performance loss of the printing system by increasing the driving speeds of the B ranked driving system other than the B ranked driving system in which the abnormality was detected, the CPU 1002 selects one or more of the B ranked driving systems, the driving speeds of which can be increased (Step S2223). In this step, selection is made in such an order that the B ranked driving system, the current driving speed setting of which is closest, or equal, to the normal driving speed setting therefor is given priority. However, it is possible to rank the B ranked driving systems in terms of productivity, and makes a selection based on the descending order, that is, in such a manner that the B ranked driving system, which has the largest effect on the productivity of the printing system (longest in driving time) is given priority. It is also possible to prepare a detailed ranking for the B ranked driving systems, and uses this detailed ranking to select the B ranked driving system, the speed of which is to be increased. Then, the CPU 1002 raises (increases), by a predetermined value, the current speed setting of the B ranked driving system selected in Step S2223 (Step S2224). Then, the CPU 1002 raises, by a predetermined value, the current electric current setting of the this B ranked driving system selected in Step S2223, to the value corresponding to the speed value set in Step S2224

(Step S2225). Further, if it is determined in Step S2222 by the CPU 1002 that it is impossible to compensate for the performance loss of the printing system, by increasing the speeds of the B ranked driving systems other than the B ranked driving system in which the abnormality was detected, the CPU 1002 resets the performance (productivity) of the printing system to a lower level (Step S2208), and carries out Step S2204. Further, if it is determined in Step S2216 that the driving speed of the B ranked driving system in which the abnormality was detected cannot be reduced, the CPU 1002 sets the printing system in the pause mode, in which it is impossible for the printing system to be operated (Step S2210), ending the abnormality management process B.

FIGS. 23A, 23B and 23C are flowcharts of the routine carried out if an abnormality is detected in any of the C ranked driving systems. In this routine, the CPU checks whether or not the value of the present electric current setting of this C ranked driving system in which the abnormality was detected is no more than the preset maximum electric current value thereof, by comparing the preset maximum electric current value for this C ranked driving system in which the abnormality was detected, to the value of the present electric current setting thereof. In other words, it checks whether or not the amount of the electric current for driving the C ranked driving system in which the abnormality was detected can be increased (Step S2301). If it is determined in Step S2301 that the amount of the electric current being supplied to the C ranked driving system in which the abnormality was detected can be increased, the CPU carries out Step S2302. If it is determined in Step S2301 that the amount of the electric current being supplied to the C ranked driving system in which the abnormality was detected cannot be increased, the CPU 1002 carries out Step S2310. In Step S2302, the CPU 1002 compares the value of the preset maximum total electric current setting for the printing system to the sum of the values the present electric current setting of the C ranked driving systems, and checks whether or not the sum of the values of the present electric current settings of the C ranked driving systems is no more than the value of the preset maximum electric current setting of the printing system. In other words, the CPU 1002 checks whether or not the total amount of the electric current for driving the printing system can be increased (Step S2302). If it is determined in Step S2302 that the total amount of the electric current for driving the printing system can be increased, the CPU 1002 increases the amount of the electric current for driving the C ranked driving system in which the abnormality was detected by a predetermined value (Step S2303), and clears the flag indicating the abnormal condition of the C driving system in which the abnormality was detected (Step S2304).

On the other hand, if it is determined in Step S2302 that the total amount of the electric current for driving the printing system cannot be increased, the CPU 1002 checks whether or not the driving speed of any of the B ranked driving systems can be increased from the normal value in order to prevent the overall performance of the printing system from declining (Step S2317). If it is determined in Step S2317 that none of the B ranked driving systems can be increased in speed from the normal value, the CPU 1002 carries out Step S2311.

If it is determined in Step S2317 by the CPU 1002 that one or more of the C ranked driving systems have been increased in driving speed from the normal speed, the CPU 1002 restores the speed of these C ranked driving systems to the normal speeds (Step S2318). Then, the CPU lowers the electric current settings of the C ranked driving systems, the speeds of which were reduced to the normal speed, to values corresponding to the reduced speeds of the C ranked driving systems (Step S2320). Then, the CPU 1002 switches the performance (productivity) setting of the printing system to a lower level (Step S2320), and increases, by a predetermined value, the amount of the electric current supply to the C ranked driving system in which the abnormality was detected (Step S2309).

In Step S2317, the CPU 1002 compares the current driving speed settings of the C ranked driving systems other than the C ranked driving system in which the abnormality was detected, to their preset minimum driving speeds, one for one, thereby checking if the current driving speed settings of the C ranked driving systems other than the C ranked driving system in which the abnormality was detected are higher than their preset minimum driving speed settings, one for one. In other words, the CPU 1002 checks if it is possible to lower their current speeds. In Step S2317, the CPU 1002 selects a C ranked driving system, the speed of which is to be lowered, from among the C ranked driving systems, the driving speeds of which can be lowered (Step S2312). In this step, the selection is made in such an order that the C ranked driving system, the current driving speed setting of which is closest to its preset normal value, is given priority. However, it is acceptable to rank the C ranked driving systems, in terms of their effects upon the overall productivity, and select the C ranked driving system which has the smallest effect (shortest in driving time) on the overall performance of the printing system, based on the resultant ranking. Further, it is also possible to prepare detailed definitions of the ranking of the C ranked driving system, and lower the driving speed of a given C ranked driving system, based on the detailed ranking. Then, the CPU 1002 lowers (slows) the driving speed of the C ranked driving system selected in Step S2312, by a predetermined value, from its current driving speed setting (Step S2313). Then, the CPU 1002 lowers, by a predetermined value, the electric current setting of the C ranked driving system selected in Step S2312, from its present electric current setting to a level proportional to the driving speed set in Step S2213 (Step S2314). Then, the CPU 1002 switches the performance (productivity) of the printing system to a lower level (Step S2315), and increases, by a predetermined value, the amount of the electric current for driving the C ranked driving system in which the abnormality was detected (Step S2309).

In Step S2310, the CPU 1002 compares the current driving speed setting of the C ranked driving system in which the abnormality was detected, to its preset minimum driving speed limit, thereby checking if the current driving speed setting the C ranked driving system in which the abnormality was detected is higher than its preset minimum driving speed limit. In other words, the CPU 1002 checks if it is possible to lower the current driving speed of the C ranked driving system in which the abnormality was detected. If it is determined in Step S2310 that the driving speed of the C ranked driving system in which the abnormality was detected can be lowered, the CPU 1002 lowers (slows) the driving speed of the C ranked driving system in which the abnormality was detected, by a predetermined value from its current driving speed setting (Step S2307).

Then, the CPU checks if it is possible to prevent the overall performance (productivity) of the printing system from declining, by compensating for the performance loss of the C ranked driving system in which the abnormality was detected, by increasing the driving speeds of the C ranked driving systems other than the C ranked driving system in which the abnormality was detected (Step S2321). If it is determined in Step S2321 that the performance loss of the C ranked driving system in which the abnormality was detected can be compensated for by increasing the speeds of the C ranked driving systems other than the C ranked driving system in which the abnormality was detected, the CPU 1002 selects a C ranked driving system, the speed of which is to be increased to compensate for the performance loss (Step S2322). In Step S2322, selection is made in such a manner that the C ranked driving system, the value of the current speed setting of which is closest, or equal, to the value of its normal speed setting, is given priority. However, a selecting method in which the C ranked driving systems are ranked in the descending order in terms of their effects upon the overall productivity of the printing system, and the C ranked driving system which has the highest effect upon the productivity (longest in driving time) is given priority, may be used. It is also possible to rank in advance the C ranked driving systems in terms of their influence upon the overall productivity of the printing system, based on detailed definitions, and select a C ranked driving system, the speed of which is to be increased based on the ranking established based on the detailed definitions. Then, the CPU 1002 raises (speeds) the driving speed of the C ranked driving system selected in Step S2322 by a predetermined value from the current driving speed setting thereof (Step S2323). Then, the CPU 1002 increases the driving speed of the C ranked driving system selected in-Step S2323 from the present electric current setting, by a predetermined amount, to a level corresponding to the driving speed set in Step S2323 (Step S2324). Further, if it is determined in Step S2321 that the overall performance loss of the printing system can be compensated for by increasing the driving speeds of the C ranked driving systems other than the C ranked driving system in which the abnormality was detected, the CPU 1002 switches the performance (productivity) setting of the printing system to a lower level (Step S2308), and carries out Step S2301.

If it is determined in Step S2310 that the driving speed of the C ranked driving system in which the abnormality was detected cannot be reduced, the CPU 1002 switches the operation of the printing system to the pause mode, in which the printing system is not operable (Step S2305), ending the abnormality management process C.

FIG. 24 is a flowchart of the abnormality management routine (B1) branching from the abnormality management routine (A) carried out when an abnormality is detected in one or more of the A ranked driving systems.

The CPU 1002 checks if the driving speed of any of the B ranked driving systems has been raised from the normal speed in order to prevent the overall performance of the printing system from declining (Step S2401). If it is determined in Step S2401 that there is no B ranked driving system, the driving speed of which has been increased from the normal one, the CPU 2042 carries out Step S2402.

If it is determined in Step S2402 that there are B ranked driving systems, the speeds of which have been increased from their normal speeds, the CPU 1002 restores the speeds of the B ranked driving systems, the speeds of which have been increased, to their normal speeds (Step S2406). Then, the CPU 1002 lowers the amounts of the electric currents for driving these B ranked driving systems from their present electric current settings, to levels proportional to their reduced driving speeds, one for one (Step S2407). Then, the CPU 1002 switches the operation of the sheet process system to the low performance (low productivity) mode (Step S2408).

In Step 52402, the CPU 1002 compares the current driving, speed settings of the B ranked driving systems to their present minimum driving speed limits, and checks whether or not their current driving speed settings are higher than their preset minimum driving speed limits, one for one. In other words, the CPU checks if there are B ranked driving systems, the speeds of which can be reduced. If it is determined in Step S2402 that there is no B ranked driving system, the speed of which can be reduced, the CPU 1002 ends the abnormality management routine (B1), and returns to the abnormality management routine (A).

The CPU 1002 selects a driving system, the driving speed of which is to be reduced, from among the B ranked driving systems, the speeds of which were judged to be reducible in Step S2402 (Step S2403). In this step, selection is made in such a manner that the B ranked driving system, the current driving speed setting of which is closest to the preset normal speed thereof, is given priority however, a selecting method which ranks the B ranked driving systems in ascending order (driving system with shortest driving time being first) in terms of their influence upon the overall performance of the sheet processing, and selects one of the B ranked driving systems based on the result of the ranking, may be employed. It is also possible to rank in advance the B ranked driving systems in terms of detailed definitions of their various aspects, and select one of the B ranked driving systems, based on the results of the ranking based on the detailed definitions. Then, the CPU 1002 lowers (slows) the driving speed of the B ranked driving system selected in Step S2403, by a predetermined value, from its current driving speed setting (Step S2404). Then, the CPU 1002 lowers the amount of the electric current for driving the B ranked driving system selected in Step S2403 by a predetermined value from the present electric current setting thereof, to a level corresponding to the driving speed set in Step S2404 (Step S2405). Then, the CPU 1002 switches the operation of the printing system to the low performance mode (low productivity mode (Step S2408), ending the abnormality management routine (B1). Then, the CPU 1002 returns to the abnormality management routine (A).

FIG. 25 is a flowchart of the abnormality management routine (C1) which branches from the abnormality management routine (A) carried out if an abnormality is detected in one or more of the A ranked driving systems.

The CPU 1002 checks if the driving speed of any of the C ranked driving systems has been raised from the normal speeds in order to prevent the overall performance of the printing system from declining (Step S2501). If it is determined in Step S2501 that there is no C ranked driving system, the driving speed of which has been increased from the normal one, the CPU 1002 carries out Step S2502.

If it is determined in Step S2502 that there are C ranked driving systems, the speeds of which have been increased from their normal speeds, the CPU 1002 restores the speeds of the C ranked driving systems, the speeds of which have been increased, to their normal speeds (Step S2506). Then, the CPU 1002 lowers the amounts of the electric currents for driving these C ranked driving systems from their present electric current settings, to levels proportional to their reduced driving speeds, one for one (Step S2507). Then, the CPU 1002 switches the operation of the printing process system to the low performance (low productivity) mode (Step S2508).

In Step S2502, the CPU 1002 compares the current driving speed settings of the C ranked driving systems to their present minimum driving speed limits, and checks whether or not their current driving speed settings are higher than their preset minimum driving speed limits, one for one. In other words, the CPU checks if there are C ranked driving systems, the speeds of which can be reduced. If it is determined in Step S2502 that there is no C ranked driving system, the speed of which can be reduced, the CPU 1002 ends the abnormality management routine (C1), and returns to the abnormality management routine (A).

The CPU 1002 selects a driving system, the driving speed of which is to be reduced, from among the C ranked driving systems, the speeds of which were judged to be reducible in Step S2502 (Step S2503). In this step, selection is made in such a manner that the C ranked driving system, the current driving speed setting of which is closest to the preset normal speed thereof, is given priority. However, a selecting method which ranks the C ranked driving systems in ascending order (driving system with shortest driving time being first) in terms of their influence upon the overall performance of the printing system, and selects one of the C ranked driving systems, based on the result of the ranking, may be used. It is also possible to rank in advance the C ranked driving systems in terms of their various aspects defined in detail, and select one of the C ranked driving systems, based on the results of the ranking in terms of their various aspects defined in detail. Then, the CPU 1002 lowers (slows) the driving speed of the C ranked driving system selected in Step S2503, by a predetermined value, from its current driving speed setting (Step S2504). Then, the CPU 1002 lowers the amount of the electric current for driving the C ranked driving system selected in Step S2503, by a predetermined value, from the present electric current setting thereof, to a level corresponding to the driving speed set in Step S2504 (Step S2505). Then, the CPU 1002 switches the operation of the printing system to the low performance mode (low productivity mode) (step S2508), ending the abnormality management routine (C1). Then, the CPU 1002 returns to the abnormality management routine (A).

(Embodiment 2)

The second embodiment of the present invention is inclusive of the first embodiment of the present invention, and is characterized in that the operation for detecting the abnormalities of the driving means related to sheet conveyance is prohibited during the sheet conveyance in the sheet processing apparatus. More concretely, the second embodiment corresponds to the Steps 2604 and 2606 in FIG. 26, which will be described next.

The portions of the second embodiment, which are the duplications of certain portions of the first embodiment, will not be described.

FIG. 26 is a flowchart of the routine carried out to control the abnormality management routines, that is, the routine in FIG. 17 for detecting solenoid abnormality, the routine in FIG. 18 for stepping motor abnormality, the routine in FIG. 19 for detecting stepping motor abnormality, based on stepping motor revolution, and the like.

The CPU 1002 starts up the solenoid abnormality detection routine (Step S2601). Then, the CPU 1002 starts up the routine for detecting the abnormalities of the stepping motors which are not related to sheet conveyance (Step S2602). Then, the CPU 1002 starts up the routine for detecting the abnormality of the stepping motors related to sheet conveyance (Step S2602). Next, the CPU 1002 checks if any of the stepping motors related to sheet conveyance is currently conveying a sheet or sheets (Step S2604). Then, the CPU 1002 prohibits the execution of the abnormality detecting operation of the stepping motor abnormality monitoring routine upon the stepping motor or motors, which were found currently involved in sheet conveyance in Step S2604 (Step 52606), and permits the execution of the abnormality detecting operation of the stepping motor abnormality monitoring routine upon the stepping motor or motors, which were found not currently involved in sheet conveyance (Step S2605).

FIG. 27 is a flowchart of the display control routine carried out for controlling the monitor for displaying the condition of the printing system. The CPU 1002 checks whether or not the system is in the pause mode (Step S2701). If it is determined in Step S2701 by the CPU 1002 that the system is in the pause mode, the CPU 1002 displays on the monitor of the control panel 301 that the system is in the pause mode (FIG. 8(*c*)) (Step S2702). If it is determined in Step S2701 by the CPU 1002 that the system is not in the pause mode, the CPU 1 checks whether or not the system is being operated in the low performance mode (Step S2703).

If it is determined in Step S2703 by the CPU 1002 that the system is being operated in the low performance mode, the CPU 1002 displays on the monitor of the control panel 301 that the system is being operated in the low performance mode (Step S2705). If it is determined in Step S2703 by the CPU that the system is not operated in the low performance mode, the CPU displays on the monitor of the control panel 301 that the system is in the normal condition (FIG. 8(*a*)) (Step S2704).

(Embodiment 3)

Next, the third embodiment of the present invention will be described with reference to the appended drawings. However, the portions of the third embodiment, which are the duplicates of certain portions of the first and second embodiments, will not be described. In other words, only the portions which are not found in the first and second embodiments will be described.

FIG. 28 is a block diagram showing the structure of the control portion of the copying machine main assembly 102 in this embodiment.

This embodiment is different from the first and second embodiments in that the combination of an image forming apparatus, and a sheet processing apparatus, controllable through a remote control system comprising: a network to which a plurality of image forming apparatuses are connectible; a minimum of one device management apparatus for collecting data from the plurality of image forming apparatuses connected to the network; and a host apparatus capable of collecting, through the network, the data accumulated in the device controlling apparatus, further comprises a reduced image forming apparatus performance information transmitting means for recognizing whether or not the controlling means of the sheet processing apparatus is in the reduced performance (degeneration) mode, and transmitting to the device management apparatus, the information regarding the performance reduction information, and the device management apparatus comprises a performance reduction information collecting and storing means for collecting and storing the information regarding the reduced performance of the image forming apparatus, a data transmitting means for transmitting data through the information transmission network, and a means for transmitting to the host apparatus, the performance reduction information collected from the image forming apparatus through the data transmitting means of the device management apparatus.

A controller circuit 200 has a central processing unit (CPU) 1002, a memory 1001, an I/O control portion 1003, etc., as do the controller circuits 200 in the first and second embodiments. The CPU 1002 is controlled by predetermined programs, and controls both the copying machine main assembly 102 and sheet processing apparatus 103.

Connected to the I/O control portion 1003 are a control panel control portion 201, a sheet supply control portion 202, a sheet feeding-reading apparatus control portion 203, an image formation control portion 204, a sheet processing apparatus control portion 205, and a communication control portion 206.

The combination of the image forming apparatus and sheet processing apparatus is connected to the information transmission network through the communication control portion 206, which is one of the portions which are not found in the first and second embodiments. Therefore, it is possible for the combination to send out or receive various information, and to be freely remote controlled.

FIG. 29 is a flowchart of the display control routine for controlling the graphic images, on the monitor of the control panel, which shows the condition of the system in the third embodiment. The CPU 1002 checks whether or not the system is in the pause mode (Step S2901). If it is determined in Step S2901 by the CPU that the system is in the pause mode, the CPU displays, on the monitor of the control panel 301, the graphic message ((*c*) of FIG. 8) that the system is in the pause mode (Step S2902). Then, the CPU 1002 informs the device management apparatus that the system is in the pause mode (Step S2906).

If it is determined in Step S2901 by the CPU 1002 that the system is not in the pause mode, the CPU checks whether or not the performance setting of the system is at the lower level (Step S2903).

If it is determined in Step S2903 by the CPU 1002 that the performance setting of the system is at the lower level, the control panel 301 ((*b*) of FIG. 8) displays the lower level of the system (Step S2905). The CPU 1002 informs the device management apparatus that the system is in the lower level and in the abnormal condition (Step S2907)

If it is determined in Step S2903 by the CPU 1002 that the performance setting of the system is not at the lower level, the CPU 1002 checks whether or not the present electric current settings or driving speed settings of the driving systems are different from the normal electric current settings or driving speed settings of the driving systems, one for one (Step S2908).

If it is determined in Step S2908 by the CPU 1002 that the present electric current or driving speed settings of one or more of the driving systems are different from their normal electric current or driving speed settings, the CPU 1002 informs the device management apparatus that the system is in the abnormal condition (Step S2910).

Further, if it is determined in Step S2908 that the present electric current or driving speed settings of one or more of the driving systems are not different from their normal electric current or driving speed settings, the CPU displays on the monitor of the control panel 301 the message ((*a*) of FIG. 8) that the system is not in the abnormal condition (Step S2904). Further, the CPU informs the device management apparatus that the system is not in the abnormal condition (Step S2909), and again carries out Step S2901.

Next, the network device management apparatus in this embodiment of the present invention will be described with reference to the appended drawings.

<Structure of Remote Control System Based on Network>

FIG. 30 is a block diagram showing a case in which the image forming apparatus in this third embodiment of the present invention or a printer is connected to a printer A-031 of an open architecture type, with the interposition of a network board NEB A-030. The NEB A-030 is in connection with a local area network LAN A-000 through a LAN interface, for example, an Ethernet (R) interface 10Base-2 having a coaxial connector, 10Base-T having an RJ-45, 100 Base-T, etc.

A plurality of personal computers (PCs), such as PC A-011, are also in connection with the LAN A-000, being allowed to communicate with the NEB A-030 while being controlled by the network operating system. With the provision of this setup, it is possible to designate one of the PCs as the network control portion.

Also connected to the LAN A-000 is the device control PC A-0100 in this embodiment.

Further, a database control server (not shown) for controlling the database of the device control PC is in connection with the LAN A-010. The database control server may be a part of the device control server A-010.

The device control PC collects, and stores, the device data by using the specific data defined by MIB, and a specific protocol within the TCP/IP hierarchy.

A referential code A-001 designates the internet through which a plurality of LANs are connected, and a referential code A-020 designates a host apparatus which collects data from the device control PC connected to each LAN.

<Network Protocol for Device Control>

Several methods for controlling networked devices have been tried by various standardization organizations. The International Standardization Organization (ISO) offered a general purpose standard framework called Open System Interconnect: OSI. The OSI model of the network management protocol is called Common Management Information Protocol: CMIP, which is one of the common network management protocols in Europe.

In the United States, a protocol called Simple Network Management Protocol: SNMP, which is similar to CMIP, is available as a network management protocol higher in commonality.

According to the network management technology based on this SNMP, a network management system comprises at least one network management station, several management object nodes inclusive of agents, and the network protocol used by the management stations or agents for exchanging management information.

Further, each agent has data, regarding its own condition, in the form of a database, which is called MIB (Management Information Base).

The MIB is tree-structured, and is regulated by RFC 1155 Structure and Identification of Management Information for TCP/IP-based Internet.

The MIB contains a node called private MIB, which makes it possible for an enterprise or an organization to define its own MIB.

<Abnormal Management Operations Selectable Through User Mode)

Referring to the flowchart given in FIG. 37, a method for selecting one of the abnormal management operations (degradation or degeneracy) through the user mode will be described.

After the power sources of the image forming apparatus and (post) sheet processing 103 are turned on (Step S3701), first, it is checked whether or not the user mode button (not shown) of the image forming apparatus has been pressed (Step S3702). The pressing of the user mode button (Step S3703) makes it possible to set the sheet (post) pressing apparatus to the automatic abnormality management mode (Step S3704). As the automatic abnormality management mode is selected, it is stored in the abnormality information storing means (backup memory) of the image forming apparatus (Step S3705).

If the image forming apparatus is not set to the automatic abnormality management mode, the display is switched back to the user mode graphic.

<Abnormality Notification Clearance Sequence>

Next, referring to the abnormality notification clearance flow chart in FIG. 38, the sequence for notifying the clearance of the abnormality information will be described.

As the power sources of the image forming apparatus and (post-image formation) sheet processing apparatus 103 are turned on (Step S3801), the image forming apparatus looks up the abnormality related information in the backup memory (Step S3802). If the apparatus is not in the automatic abnormality management mode, the amount of the electric currents for driving the motors of the (post-image formation) sheet processing apparatus 103, and the speeds of the motors thereof are set to default values (Step S3803). Then, the apparatuses are initialized (Step S3804). If it is determined that there is no abnormality (Step S3805), the backup information in the image forming apparatus is looked up to check if the system was in the abnormality management mode in the preceding operation (Step S3806).

If it is determined that the apparatus was in the abnormality management mode in the preceding operation, the backup memory is cleared of the information regarding the preceding abnormality management operation (Step S3807). Then, the image forming apparatus informs the device management apparatus that the abnormality management information has been cleared (Step S3808), and remains on standby until the current image forming operation is completed (Step S3809).

If the automatic abnormality management mode of the image forming apparatus has been selected, the backup memory is looked up to check if the system has been in the abnormality management mode (Step S3810). If the system has been in the abnormality management mode, the amounts of electric currents supplied to the motors of the (post-image formation) sheet processing apparatus 103, and the motor speeds thereof, are set to the electric current values and motor speed values backed up in the backup memory (Step S3811), and the abnormality management information is sent to the device management apparatus (Step S3812).

<Device Management Apparatus>

FIG. 32 is a block diagram showing the structure of the communication controlling means in the device management apparatus A-300. Designated by a referential code A-301 is a CPU which controls the entirety of the device management apparatus, and designated by a referential code A-302 is a RAM which constitutes the working area necessary for the CPU operation. A referential code A-303 designates a hard disk in which the programs for controlling the CPU operations is stored, and a referential code A-304 designates the database for storing the status information, such as the values in various copy counters, jam information, error information, alarm information, component counter, and MIB. The database A-304 is in the hard disk A-303. A referential code A-305 designates a display device used by a user for reading the device management UI, and a referential code A-306 designates a serial port for communicating with a modem. A referential code A-307 designates an interface board for communicating with the network (LAN).

Next, the device management sequence for the device management apparatus will be described with reference to the flowchart in FIG. 33.

Normally, the device management apparatus is on standby (Step S3302), waiting for an event from the image forming apparatus. As the device management apparatus receives an event (Step S3303), it checks whether or not there is a device capable of dealing with the event (Step S3306). If there is a device capable of dealing with the event, the device management apparatus demands the data corresponding to the event (for example, jam data for jam), from the image forming apparatus (Step S3307). Then, the image forming apparatus sends out the data in response to the demand from the device management apparatus. Upon reception of the data from the image forming apparatus the device management apparatus accumulates the data in its database.

If there are such data as error data, of which the host needs to be immediately informed, the data are immediately transmitted to the host (Step S3308).

Similarly, the device management apparatus waits for an event from the host (Step S3302). If the counter values or component counts are requested (Step S3306), the requested data are transmitted from the management database of the device management apparatus (Step S3309).

The device management apparatus regularly checks the devices. In other words, for every predetermined length of time (Step S3304), the device management apparatus collects the values in the various counters of the devices under the watch of the device management apparatus (S3305). The data collected by the device management apparatus are stored in a predetermined format (not shown), in the database.

<Data Communication Sequence Between Device Management Apparatus and Host Apparatus>

There are three methods used for the data communication between the device management apparatus and host apparatus.

These are e-mail, modem, and TCP/IP based methods. In principle, their data transmission and reception sequences are identical. Therefore, only the method based on e-mail will be described with reference to the FIG. 34.

First, the transmission sequence (useable by both device management apparatus and host apparatus) will be described. As the transmitting side satisfies the call requirements (Step S3401), the transmitting side transmits, as an e-mail attachment, the data to be transmitted (Step S3402). Then, it waits for the response to the transmitted data (Step S3403), while checking if an e-mail response to the transmitted data arrives for a predetermined length of time (Step S3404). If a response arrives within the predetermined length of time, it checks whether or not the e-mail address of the respondent is the same as the preregistered e-mail address (Step S3405). If it is confirmed that the e-mail address of the respondent is the same as the preregistered e-mail address, the results of the communication are recorded in the database (Step S3406), and the sequence is ended (Step S3407).

If the response does not arrive within the predetermined length of time (Step S3404) while the transmitting side is waiting for a response to the transmitted data (S3403), the request is transmitted for the second time (Step S3408). If the number of times the request is transmitted is less than the predetermined value (Step S3402), a warning mail is sent to the system manager (manager on the user side, if transmitting side is device management, or operator if transmitting side is host) (Step S3409), and records the communication result (error) in the database (Step S3406), and ends the sequence (Step S3407).

Next, the reception sequence will be described.

The receiving side waits for the data (Step S3411). If it receives the data (Step 53412), it records the received data in the database (Step S3413), and records the communication result in the data base (Step S3414), ending the sequence (Step S3415).

<Controlling of Host Computer>

FIG. 35 is a block diagram showing the structure of the host computer. A referential code A-801 designates a CPU, which controls the entirety of the host computer. A referential code A-802 designates a RAM in which programs and data necessary for the CPU to process data are stored. A referential code A-803 designates a hard disk, in which the received data are stored, and also in which all of the device management data are stored. Designated by a referential code A-804 is a keyboard used by an operator to input instructions. A referential code A-305 designates a display through which the host computer outputs information. A referential code A-806 designates a serial port through which the data are exchanged between the host computer and a modem. A referential code A-807 designates an I/F board connected to a LAN, and a referential code A-808 designates a mail server through which data are e-mailed between the device management apparatus and host computer.

FIG. 36 is a flowchart of the sequence carried out by the host computer. Also in this case, only the data transmission and data reception in the form of e-mail will be described. Normally, the host computer is on standby, waiting for an e-mail from the device management apparatus (Step S3602). As it receives an e-mail from the device management apparatus, it checks the password (Step S3603, Step S3604), and accepts the counter values and component counts (Step S3604). As the c-mail is correctly received, the host computer sends an OK mail to the device management apparatus (Step 3605). If the e-mail could not be correctly received, the device management apparatus sends an error mail (Step S3610). Upon the correct data reception, the device management apparatus decrypts the encrypted data attached to the e-mail (Step S3606), and stores the counter values and component count in the hard disk (Step S3607). In this step, if the diagnostic result in the device side has already reached a warning level (Step S3608), the host computer shows the warning on the display (Step 3609) to inform the operator of this condition.

(Embodiment 4)

Next, the fourth embodiment of the present invention will be described. The portions of the fourth embodiment, which are duplications of certain portions of the first to third embodiments will not be described; only the portions which are not in the first to third embodiments will be described.

The image forming apparatus (copying machine main assembly 102) connected to the sheet processing apparatus 103 comprises: a non-volatile abnormality management information storing means, which recognizes that the sheet processing apparatus controlling means is in the abnormality management mode, and which stores this information; a nonvolatile data storing means for storing the data used for driving the driving means of the sheet processing apparatus in the reduced performance mode; a performance mode selecting means used to select the automatic reduced performance mode in which the abnormality management mode is automatically selected; a mode checking means which checks whether or not the automatic abnormality management selection mode has been selected by the performance mode selecting means; a mode checking means which looks up the abnormality management mode stored in the abnormality management information storing means, and determines whether or not the sheet processing apparatus should again be set in the abnormality management mode; a data establishing means which establishes, as driving data, the driving data stored in the performance reduction information storing means, based on the results from the aforementioned second mode checking means; and a transmitting means for transmitting the performance reduction information to the device management apparatus.

The device management apparatus is provided with a data transmitting means for sending data out onto the information transmission network. The device management apparatus collects the performance reduction information of the image forming apparatus, and sends the result of the collection to the host apparatus.

If it is determined by the mode checking means that it is unnecessary for the sheet processing apparatus to be placed in the reduced performance mode, the performance reduction information stored in the performance reduction information storing means is cleared, and the device management apparatus is informed of the clearing of the performance reduction information.

The host apparatus has a performance reduction information displaying means for displaying to an operator, the performance reduction information from the device management apparatus.

Next, the fourth embodiment of the present invention will be described with reference to the appended drawings. The portions of the fourth embodiment, which are duplications of certain portions of the first to third embodiments, will not be described.

FIG. 39 is a flowchart of the routine carried out to monitor the occurrences of the abnormalities in the driving systems. In this embodiment, the driving systems are classified in terms of function, and each class of driving systems are ranked in the descending order of, for example, A, B, C, and D, in terms of their influence upon the overall performance of the sheet processing apparatus. Then, the driving systems are monitored in such an order that the A ranked driving systems are given priority. More specifically, first, the CPU 1002 checks whether or not any of the A ranked driving systems is in the abnormal condition (Step S3901). If it is determined in Step S3901 that one or more of the A ranked driving system are in the abnormal condition, the CPU 1002 carries out the abnormality management process A (Step S3902). Concretely, the abnormality management process A is the routine shown in FIG. 21, and this routine is carried out (Step S3907). If it is determined in Step S3901 that none of the A ranked driving systems is in the abnormal condition, the CPU 1002 checks whether or not any of the B ranked driving systems is in the abnormal condition (Step S3903). If it is determined in Step S3903 that one or more of the B ranked driving systems are in the abnormal condition, the CPU 1002 carries out the abnormality management process B (Step S3904). Concretely, the abnormality management process B is the routine shown in FIGS. 22A, 22B and 22C, and this routine is carried out (Step S3907). If it is determined in Step S3907 that none of the B ranked driving systems is in the abnormal condition, the CPU checks whether or not any of the C ranked driving systems is in the abnormal condition (Step S3905). If it is determined in Step S3905 that one or more of the C ranked driving systems are in the abnormal condition, the CPU 1002 carries out the abnormality management process C (Step S3906). Concretely, the abnormality management process C is the routine shown in FIGS. 23A, 23B and 23C, and this routine is carried out. Then, the CPU 1002 carries out Step S3907. If it is determined in Step S2905 that none of the C ranked driving systems is in the abnormal condition, the CPU 1002 again carries out Step S3901. In Step S3907, if the driving speed or driving electric current of a given driving system is altered, the CPU 1002 stores the new driving speed value or driving electric current value of the given driving system, as the current driving speed or driving electric current values, in the backup ROM, and then, again carries out Step S3901.

FIG. 40 is a flowchart of the management routine for managing the system condition display. The CPU 1002 checks whether or not the system is in the pause mode (Step S4001). If it is determined by the CPU in Step S4001 that the system is in the pause mode, the CPU outputs the graphic ((*c*) of FIG. 8) on the display of the control panel 301 (Step S4002). Then, the CPU 1002 informs the device management apparatus that the system is in the pause mode (Step S4006).

If it is determined by the CPU 1002 in Step S4001 that the system is not in the pause mode, the CPU 1002 checks whether or not the system is in the reduced performance mode, in which the system is operated at a reduced performance level (S4003).

If it is determined in Step S4003 that the system is in the reduced performance mode, the CPU 1002 outputs on the display of the control panel 301, a graphic (*b*) of FIG. 8 indicating that the system is in the reduced performance mode (Step S4005). Then, the CPU informs the device management apparatus that the system is in both the pause mode and reduced performance mode (Step S4007). Then, the CPU stores in the backup ROM, the information that the system is in the reduced performance mode (Step S4012) If it is determined in Step S4003 by the CPU 1002 that the system is not in the pause mode, the CPU 1002 checks whether or not the values of the electric currents which are driving the driving systems, or the values of the current driving speeds of the driving systems, are different from the normal values preset for the driving systems, one for one (Step S4008).

If it is determined in Step S4008 by the CPU 1002 that the present electric current value or speed value of any of the driving systems is different from the value preset for this driving system, the CPU 1002 informs the device management apparatus that the system is in the reduced performance mode (Step S4011). Then, the CPU 1002 stores in the backup ROM, the information that the system is in the reduced performance mode (Step S4012).

If it is determined in Step S4008 that the present electric current or speed value of none of the driving systems is different from the normal value preset for each driving system, the CPU 1002 outputs a graphic ((*c*) of FIG. 8), on the display of the control panel 301, indicating that the system is in the normal mode (Step S4004) Then, the CPU 1002 informs the device management apparatus that the system is not in the reduced performance mode (Step S4009). Then, the CPU 1002 stores in the backup ROM, the information that the system is not in the reduced performance mode (Step S4007). Then, it carries out again Step S4001.

FIGS. 41A, 41B and 41C are flowcharts of the routine carried out if an abnormality is detected in any of the B ranked driving systems. Referring to FIGS. 22A, 22B and 22C, the CPU 1002 compares the preset maximum electric current limit for the driving system in which the abnormality was detected, to the present electric current setting for the driving system in which the abnormality was detected, thereby checking whether or not the present electric current setting of the driving system in which the abnormality was detected is no more than the preset maximum electric current limit for the driving system in which the abnormality was detected. In other words, the CPU 1002 checks if it is possible to increase the amount of the electric current for driving the driving system in which the abnormality was detected (Step S5201). If it is determined in Step S5201 that it is possible to increase the amount of the electric current for driving the driving system in which the abnormality was detected, the CPU 1002 carries out Step 55202. If it is determined in Step S5201 that it is impossible to increase the amount of the electric current for driving the driving system in which the abnormality was detected, the CPU 1002 carries out Step S5216.

In Step S5202, the CPU 1002 compares the preset maximum electric current limit for the entirety of the printing system to the sum of the values of the present electric current settings of all the driving systems, checking thereby that the sum of the values of the present current settings of all the driving systems is no more than the preset maximum limit for the entirety of the printing system. In other words, the CPU checks whether or not it is possible to increase the amount of the electric current for driving one or more of the driving systems (Step S5202).

In Step S5226, the CPU 1002 determines: the amount by which the electric current for driving the driving system in which the abnormality was detected must be increased in order to prevent the current performance of this driving system from declining (in order not to invite the performance decline); at least one of the driving systems (for example, B ranked driving systems other than B ranked system in which abnormality was detected), other than the driving system in which the abnormality was detected, the driving speed of which can be increased, while leaving the driving speed of the driving system in which the abnormality was detected, as it is, to compensate for the performance loss of the driving system in which the abnormality was detected, in order to prevent the overall performance (productivity) of the printing system from changing; a value to which the driving speed of the driving system, other than the driving system in which the abnormality was detected, is newly set; and a value to which the amount of the electric current for driving this driving system is set in proportion to the newly set speed thereto.

The CPU 1002 compares the amount of the electric current necessary to maintain the performance of the driving system in which the abnormality was detected, at the present level, to the amount of the electric current necessary to increase the driving speed of a given driving system other than the driving system in which the abnormality was detected, in order to prevent the overall performance of the printing system from declining, thereby selecting the driving system which is smaller in the amount by which the electric current supplied thereto must be increased in order to prevent the overall performance of the printing system from declining (Step S5227).

If the driving system in which the abnormality was detected is selected in Step S5227 by the CPU 1002, as the driving system, the electric current setting of which is to be raised by a predetermined value, the CPU 1002 increases by the predetermined value the amount of the electric current supplied to the driving system in which the abnormality was detected (Step S5209). Then, the CPU 1002 clears the flag indicating the presence of the abnormal condition in this driving system (Step S5204).

If at least one of the driving systems, other than the driving system in which the abnormality was detected, was selected in Step S5227 by the CPU 1002, as the driving system, the driving speed of which is to be increased in order to prevent the overall performance of the printing system from declining, the CPU 1002 increases at least one of the driving systems, other than the driving system in which the abnormality was detected, in order to prevent the overall performance of the printing system from declining (Step S5228). Then, the CPU 1002 increases the amount of the electric current for driving the driving systems, the driving speeds of which were increased, to the value proportional to the increased driving speed thereof (Step S5229). Then, the CPU 1002 modifies the abnormality reference value of the driving system in which the abnormality was detected, so that even if the performance of the driving system in which the abnormality was detected, declines, it is not determined that the driving system in which the abnormality was detected is in the abnormal condition (Step S5230) Then, the CPU 1002 clears the flag indicating the abnormal condition of the driving system in which the abnormality was detected (Step S5204).

If it is determined in Step S5202 that it is impossible to increase the total amount of the electric current being applied to the printing system, the CPU 1002 carries out the abnormality management process C1 (Step S5205). Concretely, the CPU 1002 carries out the routine given in FIG. 25. After the completion of the abnormality management routine C1, the CPU 1002 compares the preset maximum limit of the total amount of electric current for the entirety of the printing system, to the sum of the values of the current electric current settings of the driving systems, checking thereby whether or not the sum of the values of the current electric current settings of the driving system is no more than the preset maximum limit of the total amount of the electric current for the entirety of the printing system; in other words, the CPU 1002 checks if it is possible to increase the total amount of the electric current for driving the printing system (Step S5206).

If it is determined in Step S5206 that it is possible to increase the total amount of the electric current for the printing system, the CPU carries out Step S5203.

On the other hand, if it is determined in Step S5206 that it is impossible to increase the total amount of the electric current being supplied to the printing system, the CPU checks if the driving speed of any of the B ranked driving systems has already been increased from the normal speed in order to prevent the performance of the printing system from declining (Step S5218). If it is determined in Step S5218 that none of the B ranked driving systems has been increased in driving speed from the normal speed, the CPU 1002 carries out Step S5211.

If it is determined in Step S5218 that one or more of the B ranked driving systems have been increased in driving speed from their normal speeds, the CPU 1002 restores the driving speeds of these B ranked driving systems to the normal speeds (Step S5219), and resets the electric current values of these B ranked driving systems to lower values as it restores the driving speeds of these B ranked driving systems to their normal speeds (Step S5220).

Then, the CPU 1002 switches the performance (productivity) setting of the printing system to a lower level; it reduces the productivity of the printing system (Step S5221), and increases, by a predetermined value, the amount of the electric current supply to the B ranked driving system in which the abnormality was detected (Step S5209).

In Step S5211, the CPU 1002 compares the preset minimum driving speed limits for the B ranked driving systems, other than the B ranked system in which the abnormality was detected, to their current driving speed settings, one for one, checking thereby whether or not the current driving speed setting of any of them is higher than the preset minimum speed limit. In other words, the CPU 1002 checks if it is possible to reduce the speed of any of the B ranked driving systems, other than the B ranked driving system in which the abnormality was detected. Then, the CPU 1002 selects one of the B ranked driving Systems, the driving speeds of which can be reduced from their normal values (Step S5212). In this step, the selection is made so that the B ranked driving system, the driving speed of which is closest to its normal setting, is given priority. However, the selection may be made in such a manner that the B ranked driving system, which least affects the productivity of the printing system (shortest in driving time) is given priority. It is also possible to prepare a detailed ranking for the B ranked driving systems, and uses this detailed ranking to select the B ranked driving system, the driving speed of which is to be reduced. Then, the CPU 1002 lowers (slows), by a predetermined value, the current speed setting of the B ranked driving system selected in Step S5212 (Step S5213).

Then, the CPU 1002 lowers, by a predetermined value, the electric current setting of this B ranked driving system selected in Step S5212, to the value corresponding to the driving speed set in Step S5213 (Step S5214). Then, the CPU 1002 sets the printing system in the low performance mode (Step S5215), and increases by a predetermined value the amount of the electric current for driving the B ranked driving system in which abnormality was detected (Step S5209).

In Step S5216, the CPU 1002 compares the current driving speed setting of the B ranked driving system in which the abnormality was detected, to the preset minimum driving speed limit therefor, checking thereby whether or not the current driving speed setting of the B ranked driving system in which the abnormality was detected is higher than the preset minimum driving speed setting therefor. In other words, the CPU checks if it is possible to reduce the driving speed of the B ranked driving system in which the abnormality was detected. If it is determined in Step S5216 that the driving speed of the B ranked driving system in which the abnormality was detected can be reduced, the CPU 1002 lowers (slows), by a predetermined value, the current driving speed setting of the B ranked driving system in which the abnormality was detected (Step S5207).

Then, the CPU 1002 checks if it is possible to prevent the performance (productivity) of the printing system from changing, by increasing the driving speeds of the B ranked driving systems, other than the B ranked driving system in which the abnormality was detected, the driving speed of which can be increased, in order to compensate for the performance loss caused by the B ranked driving system in which the abnormality was detected (Step S5222). If it is determined in Step S5222 by the CPU 1002 that it is possible to compensate for the negative effect of the B ranked driving system in which the abnormality was detected, upon the performance of the printing system, by increasing the driving speeds of the B ranked driving systems other than the B ranked driving system in which the abnormality was detected, the CPU 1002 selects one or more of the B ranked driving systems, the driving speeds of which can be increased, in order to prevent the overall performance of the sheet driving system from declining (Step S5223). In this step, selection is made in such an order that the B ranked driving system, the current driving speed setting of which is closest, or equal, to the normal driving speed setting therefor is given priority. However, it is possible to rank the B ranked driving systems in the descending order of their effects upon the productivity of the printing system (in the order of driving time), and makes a selection based on the resultant ranking, that is, in such a manner that the B ranked driving system, which has the largest effect on the productivity of the printing system (longest in driving time) is given priority.

It is also possible to prepare a detailed ranking of the B ranked driving systems in terms of their effect upon the productivity of the printing system, and uses this detailed ranking to select the B ranked driving system, the speed of which is to be increased. Then, the CPU 1002 raises (increases), by a predetermined value, the driving speed setting of the B ranked driving system selected in Step S5223 (Step S5224). Then, the CPU 1002 raises the electric current setting of the this B ranked driving system selected in Step S5223, to the value corresponding to the driving speed value set in Step S5224 (Step S5225). Further, if it is determined in Step S5222 by the CPU 1002 that it is impossible to compensate for the negative effect of the driving system in which the abnormality was detected, upon the overall performance of the printing system, by increasing the speeds of the B ranked driving systems other than the B ranked driving system in which the abnormality was detected, the CPU 1002 sets the printing system in the reduced performance (productivity) mode (Step S5208), and carries out Step S5204. Further, if it is determined in Step S5216 that the driving speed of the B ranked driving system in which the abnormality was detected cannot be reduced, the CPU 1002 sets the printing system in the pause mode, in which the printing system cannot be operated (Step S5210), ending the abnormality management routine B.

FIGS. 42A, 42B and 42C are flowcharts of the routine carried out if an abnormality is detected in any of the C ranked driving systems. In this routine, the CPU compares the preset maximum electric current limit for the C ranked driving system in which the abnormality was detected, to the actual electric current setting thereof, checking thereby whether or not the actual electric current setting of this C ranked driving system in which the abnormality was detected is no more than the preset maximum electric current limit thereof. In other words, it checks whether or not the amount of the electric current for driving the C ranked driving system in which the abnormality was detected can be increased (Step S5301). If it is determined in Step S5301 that the amount of the electric current for driving the C ranked driving system in which the abnormality was detected can be increased, the CPU carries out Step S5302. If it is determined in Step S5301 that the amount of the electric current for driving the C ranked driving system in which the abnormality was detected cannot be increased, the CPU 1002 carries out Step S5310. In Step S5302, the CPU 1002 compares the preset maximum total electric current limit for the printing system to the sum of the actual electric current settings of the C ranked driving systems, checking thereby whether or not the sum of the values of the actual electric current settings of the C ranked driving systems is no more than the preset maximum electric current limit of the printing system. In other words, the CPU 1002 checks whether or not the total amount of the electric current for driving the printing system can be increased (Step S5302). If it is determined in Step S5302 that the total amount of the electric current for driving the printing system can be increased, the CPU 1002 calculates the amount of the electric current necessary to prevent the operation of the driving system from further changing (not to invite performance decline); selects at least one of the driving systems (for example, one of B ranked driving systems other than B ranked driving systems in which abnormality was detected), the driving speed of which can be increased, while preventing the operation of the driving system in which the abnormality was detected, from further changing, in order to compensate for the negative effect of the driving system in which the abnormality was detected, upon the overall performance of the printing system, that is, in order to prevent the overall performance (productivity) of the printing system from changing; calculates the value to which the driving speed of the selected driving system is to be set, and the new value to which the amount of the electric current for driving the selected driving system is to be set in proportion to the value of the newly set driving speed of the selected driving system.

Then, the CPU 1002 compares the amount of the electric current necessary to prevent the driving system in which the abnormality was detected, from further changing, to the amount of the electrical electric current necessary to increase the driving speed of the driving system (for example, one of C ranked driving systems other than C ranked driving system in which abnormality was detected) other than the driving systems in which the abnormality was detected, choosing thereby the driving system which is smaller in the additional amount of the electric current which the entirety of the printing system requires (Step S5327).

If the driving system in which the abnormality was detected was chosen, in Step S5327, as the driving system, the amount of the electric current for which is to be increased, the CPU 1002 increases the amount of the electric current for the driving system in which the abnormality was detected, by a predetermined value (Step S5309). Then, the CPU 1002 clears the flag indicating the abnormal condition of the driving system in which the abnormality was detected (Step S5304).

If at least one of the driving systems, other than the driving system in which the abnormality was detected, was chosen, in Step S5327, as the driving system, the driving speed of which is to be increased in order to prevent the overall performance of the printing system from declining, the CPU 1002 increases the driving speed of this driving system in order to prevent the overall performance of the printing system from declining (Step S5328). Then, the CPU 1002 increases the amount of the electric current for any of the driving systems selected in Step S5327, to the value proportional to the value to which the driving speed thereof was increased (Step S5329). Then, the CPU 1002 alters the value of the abnormality reference for the driving system in which the abnormality was detected, so that even if the performance of the driving system in which the abnormality was detected further declines, it is not determined that the performance of this driving system is in the abnormal condition (Step S5330). Then, the CPU 102 clears the abnormal condition of the driving system in which the abnormality was detected (Step S5304).

Furthermore, if it is determined in Step S5302 by the CPU 1002 that the amount of the electric current for the driving system as a system cannot be increased, the CPU 1002 checks whether or not any of the C ranked driving systems has been increased in driving speed from its normal driving speed in order to prevent the overall performance of the printing system from declining (Step S5317). If it is determined in Step S5317 that there is no C ranked driving system, which has been increased in driving speed from its normal speed, the CPU 1002 carries out Step S5311.

If it is determined in Step S5317 by the CPU 1002 that one or more of the C ranked driving systems have been increased in driving speed from their normal speeds, the CPU 1002 restores the speeds of these C ranked driving systems to their normal speeds (Step S5318). Then, the CPU lowers the electric current settings of the C ranked driving systems, the speeds of which were reduced to their normal speeds, to values corresponding to the reduced speeds of these C ranked driving systems (Step S5319).

Then, the CPU 1002 sets the printing system in the reduced performance (productivity) mode (Step S5320), and increases, by a predetermined value, the amount of the electric current supply to the driving system in which the abnormality was detected (Step S5309).

In Step S5317, the CPU 1002 compares the actual driving speed settings of the C ranked driving systems, other than the C ranked driving system in which the abnormality was detected, to their preset minimum driving speed limits, one for one, thereby checking if the actual driving speed settings of the C ranked driving systems, other than the C ranked driving system in which the abnormality was detected, are higher than their preset minimum driving speed limits, one for one. In other words, the CPU 1002 checks if it is possible to lower their current driving speeds (Step S5311). In Step S5311, the CPU 1002 chooses a C ranked driving system, the speed of which is to be lowered, from among the C ranked driving systems, the driving speeds of which can be lowered (Step S5312). In this step, the choice is made in such an order that the C ranked driving system, the actual driving speed setting of which is closest to its preset normal value, is given priority. However, it is acceptable to rank the C ranked driving systems in the order of their effects upon the overall productivity of the printing system, and choose, based on the resultant ranking, the C ranked driving system which has the smallest effect (shortest in driving time) on the overall performance of the printing system. Further, it is also possible to rank in advance the C ranked driving system, based on detailed definitions, and choose, based on the resultant ranking, a driving system, the speed of which is to be lowered. Then, the CPU 1002 lowers (slows) the driving speed of the driving system chosen in Step S5312, by a predetermined value, from its current driving speed setting (Step S5313). Then, the CPU 1002 lowers, by a predetermined value, the electric current setting of the driving system chosen in Step S5312, from its electric current electric current setting to a level proportional to the driving speed set for this driving system in Step S5213 (Step S5314). Then, the CPU 1002 switches the performance (productivity) of the printing system to a lower level (Step S5315), and increases, by a predetermined value, the amount of the electric current for driving the driving system in which the abnormality was detected (Step S5309).

In Step S5310, the CPU 1002 compares the current driving speed setting of the driving system in which the abnormality was detected, to its preset minimum driving speed limit, thereby checking if the current driving speed setting of the driving system in which the abnormality was detected is higher than its preset minimum driving speed limit. In other words, the CPU 1002 checks if it is possible to lower the current driving speed of the driving system in which the abnormality was detected. If it is determined in Step S5310 that the driving speed of the driving system in which the abnormality was detected can be lowered, the CPU 1002 lowers (slows) the driving speed of the driving system in which the abnormality was detected, by a predetermined value from its current driving speed setting (Step S5307).

Then, the CPU 1002 checks if it is possible to prevent the overall performance (productivity) of the printing system from declining, by compensating for the negative effect of the driving system in which the abnormality was detected, upon the overall performance of the printing system, by increasing the driving speeds of the driving systems, other than the C ranked driving system in which the abnormality was detected (Step S5321). If it is determined in Step S5321 that the negative effect of the driving system in which the abnormality was detected, upon the overall performance of the printing system, can be compensated for by increasing the speeds of the driving systems other than the driving system in which the abnormality was detected, the CPU 1002 chooses a driving system, the speed of which is to be increased to compensate for the negative effect of the driving system in which the abnormality was detected, upon the overall performance of the sheet processing apparatus (Step S5322). In Step S5322, selection is made in such a manner that the driving system, the value of the current speed setting of which is closest, or equal, to the value of its normal speed setting, is given priority. However, a selecting method in which the C ranked driving systems are ranked in the descending order in terms of their effects upon the overall productivity of the printing system, and the C ranked driving system which has the highest effect upon the productivity (longest in driving time) is given priority, may be employed. It is also possible to rank in advance the C ranked driving systems in terms of their influence upon the overall productivity of the printing system, based on detailed definitions, and select a C ranked driving system, the speed of which is to be increased, based on the ranking established based on the detailed definitions. Then, the CPU 1002 raises (speeds) the driving speed of the C ranked driving system selected in Step S5322 by a predetermined value from the current driving speed setting thereof (Step S5323). Then, the CPU 1002 increases the amount of the electrical electric current for driving the C ranked driving system selected in Step S5323 from the electric current electric current setting, by a predetermined amount, to a level corresponding to the driving speed set in Step S5323 (Step S5324). Further, if it is determined in Step S5321 that the negative effect of the driving system in which the abnormality was detected, upon the overall performance of the printing system, can be compensated for by increasing the driving speeds of the driving systems other than the driving system in which the abnormality was detected, the CPU 1002 switches the performance (productivity) setting of the printing system to the reduced level (Step S5308), and carries out Step S5304.

If it is determined in Step S5310 that the driving speed of the driving system in which the abnormality was detected cannot be reduced, the CPU 1002 sets the printing system in the pause mode, in which the printing system is not operable (Step S5305), ending the abnormality management process C.

As described above, according to the present invention, if an abnormality is detected in a given driving system of a printing system, and the amount of the electric current being supplied to this driving system has been increased to the maximum electrical electric current limit for this driving system, it being therefore impossible for the amount of the electric current supplied to this driving system, to be increased, the speed of the driving system in which the abnormality was detected is reduced, and the negative effect of the driving system in which the abnormality was detected, upon the overall performance of the printing system is compensated for by increasing the speeds of the driving systems other than the driving system in which the abnormality was detected, in the prioritized order in terms of their effect upon the overall performance of the printing system. Therefore, even if an abnormality is detected in the driving systems of the printing system, the sheet processing is prevented from simply shutting down, and is capable of maintaining its performance level.

Further, abnormality detection is prohibited during sheet conveyance. Therefore, the abnormality of the driving means traceable to a sheet jam can be differentiated from the abnormality of the driving means itself by simple control.

Further, not only can it be instantly known by a remote control operator or a service person that the printing system is operating in the mode which prevents the system from shutting down, but also it makes it unnecessary to immediately call for a service person, reducing thereby maintenance cost. Also according to the present invention, if an abnormality is detected in the driving portions of a printing system, the amount of the electric power necessary to sustain the performance of the driving portion in which the abnormality was detected, is compared to the amount of the electric power necessary to increase the speeds of the driving portions other than the driving portion in which the abnormality was detected, choosing thereby the driving portion which is smaller in terms of the total amount of the electric power necessary to sustain the productivity of the printing system. Therefore, the amount of the electric power increase resulting from the occurrence of the abnormality in the driving portions is minimized.

Also according to the present invention, it is possible for an remote control operator or a service person to instantly know that the system is operating in the mode which prevents the system from shutting down.

While the invention has been described with reference to the structures disclosed herein, it is not confined to the details set forth, and this application is intended to cover such modifications or changes as may come within the purposes of the improvements or the scope of the following claims.

What is claimed is:

1. A sheet feeding apparatus comprising:

a plurality of driving portions to perform sheet feeding;

detecting means for detecting an abnormality relating to a feeding ability in any one of said plurality of driving portions; and a controller, responsive to a result of detection of said detecting means, for decreasing a driving speed of said any one of said plurality of driving portions at which an ability relating to a feeding ability in said any one of said plurality of driving portions is detected by said detecting means and for increasing a driving speed of another one of said plurality of driving portions, wherein in a state in which said controller cannot increase the driving speed of said any one of said plurality of driving portions, said controller decreases the driving speed of said any one of said plurality of driving portions and increases the driving speed of said another one of said plurality of driving portions.

2. A sheet feeding apparatus according to claim 1, wherein said detecting ability detects an abnormality when a sensor which detects that a load driven by said any one of said plurality of driving portions is in a predetermined position does not detect the load within a predetermined period of time.

3. A sheet feeding apparatus comprising:

a plurality of driving portions to perform sheet feeding;

detecting means for detecting an abnormality relating to a feeding ability in any one of said plurality of driving portions; and a controller, responsive to a result of detection of said detecting means, for decreasing a driving speed of said any one of said plurality of driving portions at which an abnormality relating to a feeding ability in said any one of said plurality of driving portions is detected by said detecting means and for increasing a driving speed of another one of said plurality of driving portions, wherein said detecting means detects that a driving speed of said any one of said plurality of driving portions is lower than a target speed, as being abnormal.

4. A sheet feeding apparatus according to claim 3, wherein said detecting means detects an abnormality when a sensor which detects that a load driven by said any one of said plurality of driving portions is in a predetermined position does not detect the load within a predetermined period of time.

5. A sheet feeding apparatus comprising:

a plurality of driving portions to perform sheet feeding;

detecting means for detecting an abnormality relating to a feeding ability in any one of said plurality of driving portions; and a controller, responsive to a result of detection of said detecting means, for increasing an electric current of said any one of said plurality of driving portions at which an abnormality relating to a feeding ability in said any one of said plurality of driving portions is detected by said detecting means and for decreasing an electric current of another one of said plurality of driving portions, wherein in a state in which said controller cannot increase the electric current of said any one of said plurality of driving portions, said controller decreases the electric current of said any one of said plurality of driving portions and increases the electric current of said another one of said plurality of driving portions.

6. A sheet feeding apparatus according to claim 5, wherein said detecting means detects an abnormality when a sensor which detects that a load driven by said any one of said plurality of driving portions is in a predetermined position does not detect the load within a predetermined period of time.

7. A sheet feeding apparatus comprising:

a plurality of driving portions to perform sheet feeding;

detecting means for detecting an abnormality relating to a feeding ability in any one of said plurality of driving portions; and a controller, responsive to a result of detection of said detecting means, for increasing an electric current of said any one of said plurality of driving portions at which an abnormality relating to a feeding ability in said any one of said plurality of driving portions is detected by said detecting means and for decreasing an electric current of another one of said plurality of driving portions, wherein said detecting means detects that a driving speed of said any one of said plurality of driving portions is lower than a target speed, as being abnormal.

8. A sheet feeding apparatus according to claim 7, wherein said detecting means detects an abnormality when a sensor which detects that a load driven by said any one of said plurality of driving portions is in a predetermined position does not detect the load within a predetermined period of time.

* * * * *

UNITED STATES PATENT AND TRADEMARK OFFICE

CERTIFICATE OF CORRECTION

PATENT NO. : 7,156,391 B2
APPLICATION NO. : 10/438073
DATED : January 2, 2007
INVENTOR(S) : Kiyoshi Okamoto et al.

It is certified that error appears in the above-identified patent and that said Letters Patent is hereby corrected as shown below:

IN THE DRAWINGS:
Sheet No. 20, Figure 22B, “ABNOMALITY” (both occurrences) should read --ABNORMALITY--.

Sheet No. 23, Figure 23B, “ABNOMALITY” (both occurrences) should read --ABNORMALITY--.

Sheet No. 43, Figure 41B, “ABNOMALITY” (both occurrences) should read --ABNORMALITY--.

Sheet No. 46, Figure 42B, “ABNOMALITY” (both occurrences) should read --ABNORMALITY--.

COLUMN 1:
Line 34, “connected” should read --connected,--.

COLUMN 4:
Line 37, “mote” should read --more--.

COLUMN 5:
Line 67, “Step” should read --step--.

COLUMN 9:
Line 62, “moans,” should read --means,--.

COLUMN 10:
Line 27, “the” (first occurrence) should be deleted.

COLUMN 11:
Line 43, “arc” should read --are--.

COLUMN 14:
Line 19, “be” should be deleted.

COLUMN 18:
Line 58, “in” should read --in the--.

COLUMN 19:
Line 58, “FIG.” should read --FIGS.--.

UNITED STATES PATENT AND TRADEMARK OFFICE

CERTIFICATE OF CORRECTION

PATENT NO. : 7,156,391 B2
APPLICATION NO. : 10/438073
DATED : January 2, 2007
INVENTOR(S) : Kiyoshi Okamoto et al.

It is certified that error appears in the above-identified patent and that said Letters Patent is hereby corrected as shown below:

COLUMN 21:
Line 20, “in” should read --in the--.
Line 21, “of,” should read --of--.

COLUMN 22:
Line 31, “exceeds” should read --exceed--.
Line 32, “sets” should read --set--.
Line 55, “connected” should read --connected to--.

COLUMN 23:
Line 5, “ling” should read --line--.
Line 7, “76; etc.” should read --76, etc.--.
Line 36, “013,” should read --103,--.

COLUMN 24:
Line 33, “a/knurled” should read --a knurled--.

COLUMN 27:
Line 9, “stepper” should read --stopper--.
Line 11, “stepper” should read --stopper--.
Line 45, “8b” should read --85--.

COLUMN 28:
Line 32, “is” should read --are--.

COLUMN 33:
Line 36, “of” should be deleted.

COLUMN 39:
Line 6, “(Step S2004)” should read --(Step S2004).--.

COLUMN 40:
Line 12, “B1.” should read --B1--.
Line 30, “of” should be deleted.
Line 65, “S22 16.” should read --S2216.--.

COLUMN 41:
Line 40, “S2218)” should read --S2218--.

COLUMN 42:
Line 66, “The” should be deleted.

UNITED STATES PATENT AND TRADEMARK OFFICE

CERTIFICATE OF CORRECTION

PATENT NO. : 7,156,391 B2
APPLICATION NO. : 10/438073
DATED : January 2, 2007
INVENTOR(S) : Kiyoshi Okamoto et al.

It is certified that error appears in the above-identified patent and that said Letters Patent is hereby corrected as shown below:

COLUMN 45:
Line 30, "in-Step" should read --in Step--.
Line 40, "S2301." should read --S2304.--.

COLUMN 46:
Line 4, "52402," should read --S2402,--.
Line 5, "driving," should read --driving--.
Line 21, "priority however," should read --priority. However--.
Line 41, "(Step S2408)," should read --(Step S2408)),--.

COLUMN 48:
Line 5, "(Step 52606)," should read --(Step S2606),--.

COLUMN 49:
Line 38, "(Step S2907)" should read --(Step S2907).--.

COLUMN 53:
Line 6, "(Step 53412)," should read --(Step S3412),--.
Line 37, "c-mail" should read --e-mail--.

COLUMN 55:
Line 34, "(Step S4012) If" should read --(Step S4012). ¶ If--.
Line 55, "(Step S4004)" should read --(Step S4004).--.

COLUMN 56:
Line 12, "55202." should read --S5202.--.

COLUMN 57:
Line 19, "(Step S5230)" should read --(Step S5230).--.

COLUMN 59:
Line 19, "the" should be deleted.

UNITED STATES PATENT AND TRADEMARK OFFICE

CERTIFICATE OF CORRECTION

PATENT NO. : 7,156,391 B2
APPLICATION NO. : 10/438073
DATED : January 2, 2007
INVENTOR(S) : Kiyoshi Okamoto et al.

It is certified that error appears in the above-identified patent and that said Letters Patent is hereby corrected as shown below:

COLUMN 63:
Line 43, "ability" (first occurrence) should read --abnormality--.
Line 53, "ability" should read --means--.

Signed and Sealed this

Seventh Day of August, 2007

JON W. DUDAS
*Director of the United States Patent and Trademark Office*